US006260545B1

(12) United States Patent
Suzuki

(10) Patent No.: US 6,260,545 B1
(45) Date of Patent: Jul. 17, 2001

(54) INTERNAL COMBUSTION ENGINE HAVING COMBUSTION HEATER

(75) Inventor: Makoto Suzuki, Mishima (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/332,960

(22) Filed: Jun. 14, 1999

(30) Foreign Application Priority Data

Jun. 15, 1998 (JP) ..... 10-167545
Mar. 5, 1999 (JP) ..... 11-059453

(51) Int. Cl.[7] ..... F01N 3/10
(52) U.S. Cl. ..... 123/550
(58) Field of Search ..... 123/550

(56) References Cited

U.S. PATENT DOCUMENTS 4,002,025 1/1977 Yamaguchi et al. .
4,030,464 6/1977 Yamaguchi et al. .
4,368,715 * 1/1983 Molewk et al. ..... 123/550
4,506,505 * 3/1985 Melzer ..... 123/550
6,119,660 * 9/2000 Suzuki ..... 123/550

* cited by examiner

*Primary Examiner*—Marguerite McMahon
(74) *Attorney, Agent, or Firm*—Kenyon & Kenyon

(57) ABSTRACT

An internal combustion engine having a combustion heater is capable of surely effecting an ignition of the combustion heater. In the engine having the vaporization type combustion heater operated at a cold time to raise a temperature of engine cooling water, the combustion heater has a glow plug for forming a latent flame by igniting a combustion fuel, a combustion camber for growing the latent flame formed by the glow plug into flames, an air supply pipe for supplying the combustion chamber with the air for combustion, a combustion gas discharge pipe for discharging the combustion gas from the combustion chamber, and a communicating passageway for connecting the air supply passageway to the combustion gas discharge pipe. A valve means provided in the communicating passageway controls the connecting passageway so as to open and close. The communicating passageway opens when the glow plug start the ignition in the vaporization type combustion heater, whereby the air flows directly between the air supply pipe and the combustion gas discharge pipe.

19 Claims, 19 Drawing Sheets

INTERNAL COMBUSTION ENGINE HAVING COMBUSTION HEATER

BACKGROUND OF THE INVENTION

1. Field of the Invention

The present invention relates generally to an internal combustion engine having a combustion heater and, more particularly, to an internal combustion engine having a combustion heater, which is constructed to enhance a low-temperature starting property of the internal combustion engine, speed up a warm-up of the internal combustion engine, enhance a performance of a heating system in a car room, and speed up a warm-up of an exhaust emission control system by raising temperatures of engine related elements such as cooling water and intake air or an exhaust gas.

2. Description of the Prior Art

It is desired that an internal combustion engine be constructed to enhance a starting property and speed up a warm-up thereof especially at a cold time. In particular, a diesel engine and other lean-burn engines are required to further enhance the starting property and a performance of the warm-up, because these engines have a less exothermic amount as compared to a general gasoline engine.

Such being the case, there has hitherto been known a technology (see, e.g., Japanese Patent Application Laid-Open Publication No.60-78819) of heating a thermal medium such as engine cooling water and the like by utilizing combustion heat emitted from a combustion heater attached to, e.g., an intake passageway of the internal combustion engine, sending the thus heated thermal medium to a water jacket of the engine body, a heater core for warming a car room and other necessary places, and raising temperatures of those necessary places.

What is suitable as a combustion heater may be a vaporization type combustion heater which vaporizes a combustion fuel of the combustion heater into a vaporized fuel, forms a latent flame by igniting this vaporized fuel, and growing the latent flame into flames.

As known well, the vaporization type combustion heater includes at least a combustion chamber for producing the flames, a fuel supply unit for supplying this combustion chamber with a liquefied fuel for the combustion, a fuel vaporizing unit for vaporizing the liquefied fuel supplied by the fuel supply unit, a glow plug serving as an igniting device for forming the latent flame by igniting the vaporized fuel vaporized by the fuel vaporizing unit, an air blow fan for growing the latent flame made by the glow plug into flames with a proper magnitude and force by controlling an air supply quantity to the latent flame, a cooling water passageway through which to flow engine cooling water which absorbs the combustion heat evolved by the flames and raises its temperature, and an air flow passageway including an air supply passageway for supplying the combustion chamber with the air for combustion and a combustion gas discharge passageway for discharging the combustion gas produced by the combustion out of the combustion chamber.

The internal combustion engine having the combustion heater disclosed in the above-mentioned Japanese Patent Application Laid-Open Publication No. 60-78819 is so configured that a portion of the intake air flowing through an intake passageway of the internal combustion engine is supplied as the air for combustion to the combustion heater, and the combustion gas of the combustion heater is discharged to an exhaust passageway of the engine.

On the occasion of supplying the combustion heater with the air for combustion, an air intake port of the combustion heater is connected to the intake passageway via an intake duct which is an air supply passageway. Further, for returning the combustion gas to the exhaust passageway, the combustion gas discharge port of the combustion heater is connected to the exhaust passageway via an exhaust duct classified which is a combustion gas discharge passageway.

Further, according to the technology disclosed in the above publication, the liquefied fuel supplied to the combustion chamber of the combustion heater is vaporized into the vaporized fuel, and the air for combustion sent to the combustion heater is pressure-supplied by the air blow fan into the combustion chamber. The air for combustion supplied by pressurization is mixed with the vaporized fuel into an air-fuel mixture, and the combustion gas produced when the air-fuel mixture is burned in the combustion chamber, is as described above discharged to the exhaust passageway via the exhaust duct.

A connecting point on the exhaust passageway where the exhaust passageway is connected to the exhaust duct is disposed upstream of a catalyst converter which is an exhaust gas purification device and disposed on the exhaust passageway. Therefore, the combustion gas flowing to the exhaust passageway via the exhaust duct is purified together with the exhaust gas discharged from the internal combustion engine by the catalyst converter.

In the case where the intake duct is connected to the intake passageway and the exhaust duct is connected to the exhaust passageway, as described above, a pressure in the exhaust passageway becomes higher than a pressure in the intake passageway due to an exhaust gas pressure depending on an operating state of the engine. Accordingly, it might be considered in this case that the combustion gas of the combustion heater is unable to flow to the exhaust passageway.

Even in such a case, however, if a supercharger is provided in the internal combustion engine having the combustion heater and a pressure of the intake air is raised by increasing a supercharging pressure of the supercharger, the intake air with the increased pressure can be introduced into the combustion heater.

If the supercharging pressure is high, however, a pressure of the air for combustion led into the combustion heater also rises. Thereupon, there increases a differential pressure between the air intake port and the combustion gas discharge port of the combustion heater, with the result that a quantity of the air flowing inside the combustion heater excessively augments, and there might be a possibility that the air blow quantity by the air blow fan of the combustion heater does not work. If the excessive air flows, this might induce a decline of the ignition in the combustion heater, or destabilized flames because of the air/fuel ratio becoming lean, or an unstable combustion, or a lean accidental fire.

On the other hand, aiming at warming up the engine and so forth, the combustion gas discharge passageway is connected to the intake passageway in place of the exhaust passageway as the case may be. That is to say, the intake duct and the exhaust duct are connected to the intake passageway.

In some cases, however, there are differences in terms of a sectional size and configuration of the intake passage between a connecting point of the intake duct to the intake passageway and a connecting point of the exhaust duct to the intake passageway. In such a case, a differential pressure is liable to occur between the connecting point of the intake duct and the connecting point of the exhaust duct.

Further, if both of the connecting points of the intake duct and of the exhaust duct are provided downstream of a supercharger, the differential pressure is further liable to occur. Hence, there might arise the problems such as the decline of the ignition and the like.

Moreover, what is exemplified as causing the problems such as the decline of ignition due to the differential pressure occurred may be a case where neither the intake duct nor the exhaust duct communicates with the intake passageway or the exhaust passageway, but both of these ducts are open to the atmospheric air, and a case where the vehicle travels at a high speed.

In the case of such settings, the differential pressure still occurs in terms of a positional relationship of the intake duct and the exhaust duct when they are mounted in the vehicle.

Further, what can be considered as causing the differential pressure may be a case where an engine rotational speed is high when the intake duct is open to the atmospheric air and the exhaust duct is connected to the intake passageway.

SUMMARY OF THE INVENTION

It is a primary object of the present invention, which was made in view of the above-described situation, to provide an internal combustion engine having a combustion heater capable of surely effecting an ignition and operating with a stability irrespective of an installing condition of the combustion heater.

To accomplish the above object, the internal combustion engine having the combustion heater according to the present invention adopts the following constructions.

According to a first aspect of the invention, an internal combustion engine having a combustion heater operating and raising temperatures of engine related elements when the internal combustion engine is in a predetermined operating state, comprises an igniting means for making a latent flame by igniting a combustion fuel of the combustion heater, a combustion chamber for growing the latent flame formed by the igniting means into flames, an air supply passageway for supplying the combustion chamber with the air for combustion, a combustion gas discharge passageway for discharging a combustion gas out of the combustion chamber, and an air quantity control means for controlling a quantity of the air flowing within the combustion chamber in accordance with a differential pressure occurred between the side of the air supply passageway and the side of the combustion gas discharge passageway in the combustion chamber.

Herein, (1) the "time when the internal combustion engine is in a predetermined operation state" implies during an operation of the engine or after starting up the engine at a cold time or at an extremely cold time, when an exothermic quantity of the internal combustion engine itself is small (e.g., when a consumption of the fuel is small), when an amount of heat received by the engine cooling water is small due to the small exothermic quantity of the internal combustion engine itself, and when warming up the engine immediately after the start-up at a normal temperature. "The cold time" implies when the outside temperature falls within a temperature range from approximately −10° C. to approximately 15° C., and "the extremely cold time" implies that the outside temperature is within a temperature range of substantially −10° C. or below.

(2) "The engine related elements" imply, e.g., the engine cooling water and the internal combustion engine body where the combustion gas of the combustion heater is introduced into intake air, and an exhaust gas purifying device (a DPF (Diesel Particulate Filter) or a catalyst) provided in the exhaust passageway.

(3) What is preferable as "the igniting means" is, for example, a glow plug for emitting the heat upon conduction by a battery.

(4) "The combustion chamber" includes therein an air flow passageway which is connected with the air supply passageway and the combustion gas discharge passageway.

(5) What is preferable as "the combustion heater" may be a vaporization type combustion heater. Further, in the combustion heater, the combustion chamber thereof is connected to the intake passageway of the internal combustion engine via the air supply passageway, or is open to the atmospheric air, and further connected to the intake passageway of the internal combustion engine via the combustion gas discharge passageway. Hence, the air enters the air supply passageway from the intake passageway or from the atmosphere. The air is thereafter supplied into the combustion chamber and used for burning a fuel for combustion. Then, the combustion gas discharged from the combustion heater again flows back to the intake passageway via the combustion gas discharge passageway. Thereafter, the combustion gas, which is sent into the cylinders of the internal combustion engine body, turns out to be the air for combustion this time in the internal combustion engine and is used again for the combustion. Note that the combustion gas discharge passageway may be open to the atmospheric air.

It is necessary to control a conduction (exothermic) time of the glow plug for making the latent flame. Further, in order to make the latent flame grow into the flames with a large magnitude it is necessary to control an output of the air blow fan, an air supply quantity and a fuel supply quantity. These control processes are executed by a computer, i.e., a CPU (Central Processing Unit) serving as a central unit of an ECU (Electronic Control Unit).

In the internal combustion engine having the combustion heater according to the present invention, the air quantity control means controls the quantity of the air flowing within the combustion chamber in accordance with the differential pressure occurred between the side of the air supply passageway and the side of the combustion gas discharge passageway in the combustion chamber, and, consequently, when the pressure in the combustion chamber increases, and if the quantity of the air flowing to the combustion chamber augments due to the increased pressure, the air quantity control means controls the quantity of the air flowing to the combustion chamber so that this air quantity is sufficiently reduced or further down to 0 (zero), thereby eliminating such a possibility that the air blow strong enough to make the ignition unable to be effected occurs in the combustion chamber. It is, therefore, feasible to effect the ignition in the combustion heater. Namely, it is certain to ensure the latent flame.

Further, since the ignition is ensured, it is possible to prevent emissions of white smokes and of disagreeable smell derived from a generation of unburned hydrocarbon.

Moreover, if there might be a possible that an accidental fire with the increased quantity of the air flowing to the combustion chamber would occur, because of the large differential pressure after being ignited once, as explained above, the air quantity control means reduces the quantity of the air flowing within the combustion chamber, whereby the air blow strong enough to set the accidental fire does not occur. Hence, the accidental fire can be certainly prevented.

According to a second aspect of the present invention, in the internal combustion engine having the combustion heater according to the first aspect of the invention, it is desirable that the air quantity control means restricts the quantity of the air flowing within the combustion chamber, when the differential pressure comes to a predetermined value or over.

"The predetermined value" given herein means a minimum value of the differential pressures large enough to produce an excessive air blow quantity in such a case that an air blow quantity produced within the combustion heater due to the differential pressure between the side of the air supply passageway and the side of the combustion gas discharge passageway in the combustion chamber becomes excessive enough to make ignition unable to be effected and to cause the accidental fire.

According to a third aspect of the present invention, in the internal combustion engine having the combustion heater according to the first aspect of the invention, it is desirable that there be provided a communicating passageway for connecting the air supply passageway to the combustion gas discharge passageway.

"The communicating passageway" given herein means a passageway for connecting the air supply passageway to the combustion gas discharge passageway to permit the air flow between the air supply passageway and the combustion gas discharge passageway.

In the internal combustion engine having the combustion heater according to the present invention, the communicating passageway for connecting the air supply passageway to the combustion gas discharge passageway is provided so that the air flows between the air supply passageway and the combustion gas discharge passageway. Hence, when the air flowing through the air supply passageway toward the combustion chamber arrives at the communicating passageway, the air diverges to the communicating passageway and to the combustion chamber. With this divergence, the pressure in the air supply passageway escapes to the combustion gas discharge passageway via the communicating passageway, with the result that there diminishes the differential pressure between the air supply passageway and the combustion gas discharge passageway.

Accordingly, at least when the combustion heater starts the ignition, i.e., speaking of a case where the above-mentioned glow plug is applied to the igniting device, it is so arranged that, when this glow plug emits the heat upon conduction, the quantity of the air flowing through this communicating passageway is controlled, and the differential pressure is decreased thereby the quantity of the air flowing toward the combustion chamber is reduced enough to enable the combustion heater to surely effect the ignition or further reduced down to 0 (zero). This removes a possibility wherein the air blow strong enough to make the ignition unable to be carried out occurs in the air flow passageway in the combustion chamber.

Hence, the ignition in the combustion heater can be surely executed.

Further, after being ignited once, the control of the quantity of the air flowing through the communicating passageway serves to prevent the accidental fire.

According to a fourth aspect of the present invention, in the internal combustion engine having the combustion heater according to the first aspect of the invention, the air quantity control means may restrict the quantity of the air flowing within the combustion chamber by controlling an air flow quantity through a communicating passageway for connecting the air supply passageway to the combustion gas discharge passageway.

Herein, "a communicating passageway" is the same as that stated in the third aspect of the invention. The communicating passageway, as explained above, serves to permit the air flow between the air supply passageway and the combustion gas discharge passageway, and therefore, when the air flowing through the air supply passageway toward the combustion chamber arrives at the communicating passageway, the air diverges to the communicating passageway and to the combustion chamber.

Then, in the internal combustion engine having the combustion heater according to the present invention, the quantity of the air flowing within the combustion chamber is restricted by controlling the quantity of the air flowing through the communicating passageway. Therefore, for example, if the quantity of the air flowing through the communicating passageway is increased under the above control, the quantity of the air diverging to the communicating passageway from the air supply passageway augments to a degree corresponding thereto. Accordingly, the quantity of the air flowing through the air supply passageway decreases correspondingly, and hence the quantity of the air flowing trough the combustion chamber is reduced, i.e., restricted. Therefore, the quantity of the air flowing toward the combustion chamber is reduced enough to enable the combustion heater to surely effect the ignition or further reduced down to 0 (zero), depending on the restriction described above. Hence, there is no possibility in which the air blow strong enough to make the ignition unable to be done occurs in the combustion chamber.

Further, after being ignited once, the control of the quantity of the air flowing through the communicating passageway serves to prevent the accidental fire.

According to a fifth aspect of the present invention, in the internal combustion engine having the combustion heater according to the fourth aspect of the invention, the air quantity control means may include a communicating passageway opening/closing mechanism, disposed in the communicating passageway, for opening and closing the communicating passageway.

"The communicating passageway opening/closing mechanism" given herein may be whatever is capable of controlling the opening and the closing of the communicating passageway, however, it is desirable that this mechanism be capable of largely reducing or further reducing down to 0 (zero) the quantities of the air flowing through the air supply passageway (more precisely an air supply passageway segment disposed more downstream than the connecting point of the communicating passageway to the air supply passageway), the air flowing through the combustion chamber, and the air flowing through the combustion gas discharge passageway (more accurately an combustion gas discharge passageway segment disposed more upstream than the connecting point of the communicating passageway to the combustion gas discharge passageway) by increasing the quantity of the air flowing through the communicating passageway when the combustion heater starts the ignition by use of the igniting device. What is suitable as the communicating passageway opening/closing mechanism may be a valve device having a valve member which is capable of controlling the opening and the closing of the communicating passageway, under the control of an ECU (CPU).

"The valve device" includes the valve member for opening and closing the communicating passageway, a driving unit for driving this valve member, and the CPU for controlling an operation of this driving unit. "The driving unit"

preferably may include an opening/closing mechanism constructed to throttle the communicating passageway, more specifically, to open and close the communicating passageway according to a degree of throttling by operating the valve member with a proper drive motor.

Then, a state, wherein a flow quantity of the combustion gas flowing through the communicating passageway is decreased by closing the communicating passageway with the valve member, is called the communicating passageway is throttled.

According to a sixth aspect of the present invention, in the internal combustion engine having the combustion heater according to the fifth aspect of the invention, it is desirable that the communicating passageway is a pipe member, which is opened when the igniting means starts the ignition and making the air supply passageway and the combustion gas discharge passageway communicate with each other.

In the internal combustion engine having the combustion heater according to the present invention, the communicating passageway is the pipe member through which the air supply passageway communicates with the combustion gas discharge passageway, and opens when the igniting device starts the ignition. Therefore, even if the air flowing through the air flow passageway of the combustion heater has a momentum, this momentum is attenuated after the air has flown to the combustion gas discharge passageway via the communicating passageway from the air supply passageway. Alternatively, if a degree of opening of the communicating passageway is made sufficiently large before the air flowing through the air flow passageway gains the momentum, the quantity of the air flowing toward the combustion chamber can be sufficiently reduced to such an extent that the ignition can be surely effected in the combustion heater, or further reduced down to 0 (zero). Hence, there is no possibility in which the air blow strong enough to make the ignition unable to be implemented occurs in the combustion chamber.

Thus, since the strong air does not blow in the air flow passageway of the combustion chamber, the ignition can be carried out with the certainty in the combustion heater. Besides, because of the ignition being ensured, it is possible to prevent emissions of white smokes and of disagreeable smell derived from a generation of unburned hydrocarbon.

According to a seventh aspect of the present invention, in the internal combustion engine having the combustion heater according to the sixth aspect of the invention, the communicating passageway may be so configured to be closed after completion of the ignition by the igniting means to avoid the communication between the air supply passageway and the combustion gas discharge passageway.

Herein, "the completion of the ignition" implies that the latent flame is formed in the combustion chamber.

In the internal combustion engine having the combustion heater according to the present invention, after completing the ignition, i.e., after ensuring the latent flame, the communicating passageway is closed, and consequently the air which has flown to the combustion gas discharge passageway when the communicating passageway is opened, flows into the combustion chamber. At that time, however, the latent flame has already been formed and can be therefore grown into the flames without an extinction of the latent flame.

According to an eighth aspect of the present invention, in the internal combustion engine having the combustion heater according to the first aspect of the invention, a supercharger may be provided in an intake passageway of the internal combustion engine.

According to a ninth aspect of the present invention, in the internal combustion engine having the combustion heater according to the first aspect of the invention, the air quantity control means may include a flow quantity control mechanism for controlling a flow quantity of at least either the air flowing through the air supply passageway or the combustion gas flowing through the combustion gas discharge passageway.

In this case, when the flow quantity control mechanism controls the flow quantity of at least either the air flowing through the air supply passageway or the combustion gas flowing through the combustion gas discharge passageway, it follows that the quantity of the air flowing within the combustion chamber is to be controlled. For instance, when the flow quantity control mechanism performs the control of restricting the flow quantity of at least either the air flowing through the air supply passageway or the combustion gas flowing through the combustion gas discharge passageway, the quantity of the air flowing through the air flow passageway of the combustion chamber is reduced correspondingly. This eliminates the possibility in which the air blow strong enough to make the ignition unable to be done occurs in the combustion chamber. Hence, the ignition is ensured, and there is no probability of causing the accidental fire.

According to a tenth aspect of the present invention, in the internal combustion engine having the combustion heater according to the ninth aspect of the invention, it is desirable that the flow quantity control mechanism is a flow quantity reducing means for reducing the flow quantity of at least either the air flowing through the air supply passageway or the combustion gas flowing through the combustion gas discharge passageway.

Further, "the flow quantity reducing device" may be whatever is capable of reducing the flow quantity of at least either the air flowing through the air supply passageway or the combustion gas flowing through the combustion gas discharge passageway, however, it is desirable that the device be capable of largely reducing or further reducing down to 0 (zero) the flow quantity of at least either the air flowing through the air supply passageway or the combustion gas flowing through the combustion gas discharge passageway, at least when the combustion heater starts the ignition by use of the igniting device thereof. What is suitable as the flow quantity reducing device may be a valve device having a valve member which is capable of controlling the opening and the closing of the air supply passageway or the combustion gas discharge passageway, under the control of ECU (CPU).

The internal combustion engine having the combustion heater according to the present invention is provided with the flow quantity reducing device for reducing the flow quantity of at least either the air flowing through the air supply passageway or the combustion gas flowing through the combustion gas discharge passageway. This flow quantity reducing device is capable of controlling the flow quantity of at least either the air flowing through the air supply passageway or the combustion gas flowing through the combustion gas discharge passageway, and therefore, at least when the combustion heater starts the ignition, the flow quantity of at least either the air or the combustion gas is sufficiently reduced or further reduced down to 0 (zero) under the above control. With this reduction, the air flow in the air flow passageway of the combustion chamber is restrained, thereby eliminating the possibility that the air blow strong enough to make the ignition unable to be executed is produced in the air flow passageway. Accordingly, since the strong air does not blow in the air flow passageway, the ignition in the combustion heater can be surely attained at one time. Further, there is no anxiety for the accidental fire.

According to an eleventh aspect of the present invention, in the internal combustion engine having the combustion heater according to the first aspect of the invention, it is preferable that the air quantity control means includes an air supply device for supplying the combustion chamber with the air.

Herein, for instance, an air blow fan is suitable as "the air supply device".

In the internal combustion engine having the combustion heater according to the present invention, the air quantity control means for controlling the quantity of the air flowing within the combustion chamber in accordance with the differential pressure between the side supplied with the air and the side from which to discharge the combustion gas within the combustion chamber, is the air supply device for supplying the air to the combustion chamber. Therefore, when the differential pressure in the combustion chamber increases with the result that the quantity of the air flowing to the combustion chamber augments due to this increased differential pressure, the air supply device sufficiently reduces the quantity of the air flowing to the combustion chamber or further reduces it down to 0 (zero), thereby eliminating the possibility that the air blow strong enough to make the ignition unable to be effected occurs in the combustion chamber. Hence, the ignition in the combustion heater can be surely carried out. That is, the latent flame is certainly ensured. Further, the accidental fire can be for sure prevented.

According to a twelfth aspect of the present invention, in the internal combustion engine having a combustion heater according to the eleventh aspect of the invention, it is preferable that the air supply means is provided in the combustion chamber on the side of the air supply passageway.

According to a thirteenth aspect of the present invention, in the internal combustion engine having a combustion heater according to the first aspect of the invention, wherein the combustion heater introduces the air for combustion from an intake passageway of the internal combustion engine and raises temperatures of engine related elements by utilizing heat held by a combustion gas produced by burning the air-fuel mixture by mixing a fuel for combustion with the air for combustion in the combustion chamber; the intake passageway includes a supercharger for increasing a pressure of intake air in the intake passageway; the air supply passageway introduces, from the intake passageway, the intake air, of which the pressure has been increased by the supercharger, as the air for combustion into the combustion chamber; the combustion gas discharge passageway, bypassing cylinders of the internal combustion engine, discharges the combustion gas to an exhaust passageway of the internal combustion engine; the air supply passageway is communicated with the combustion gas discharge passageway by a communicating passageway; and the air quantity control means, provided in the communicating passageway, for controlling a flow quantity of the air flowing through the communicating passageway when a pressure in the air supply passageway becomes equal to or larger by a predetermined value than a pressure in the combustion gas discharge passageway.

"The predetermined value" given herein is the same as stated in the second aspect of the invention. Further, "the communicating passageway" is the same as those stated in the third and sixth aspects of the invention.

In the internal combustion engine having the combustion heater according to the present invention, the communicating passageway is provided with the air quantity control means for controlling the flow quantity of the air flowing through the communicating passageway when the pressure in the air supply passageway becomes equal to or larger by the predetermined value than the pressure in the combustion gas discharge passageway. Therefore, if the pressure in the air supply passageway becomes equal to or larger by the predetermined value than the pressure in the combustion gas discharge passageway, the air quantity control means performs the control of increasing the flow quantity of the air flowing through the communicating passageway. Namely, the air escapes toward the combustion gas discharge passageway via the communicating passageway from the air supply passageway. Thereupon, the pressure in the air supply passageway decreases, whereas the pressure in the combustion gas discharge passageway rises to a degree corresponding thereto, with the result that there is reduced the differential pressure caused between the air supply passageway and the combustion gas discharges passageway. Hence, the flow quantity of the air flowing through the communicating passageway is controlled so that the quantity of the air flowing to the combustion chamber is reduced enough to enable the combustion heater to surely execute the ignition or further reduced down to 0 (zero), thereby showing no probability that the air blow strong enough to make the combustion heater unable to effect the ignition occurs in the combustion chamber. Hence, the ignition in the combustion heater can be implemented with certainty. Namely, the latent flame is certainly ensured. Further this serves to prevent the accidental fire.

According to a fourteenth aspect of the present invention, in the internal combustion engine having the combustion heater according to the thirteenth aspect of the invention, it is desirable that the air quantity control means is a valve mechanism which opens when the pressure in the air supply passageway becomes equal to or larger by the predetermined value than the pressure in the combustion gas discharge passageway, otherwise closes.

Herein, "the valve mechanism" may be constructed of a differential pressure detecting means for detecting the differential pressure between the air supply passageway and the combustion gas discharge passageway, and of a flow quantity control valve provided in the communicating passageway, whereby a degree of opening of the flow quantity control valve may be controlled in accordance with a magnitude of the differential pressure detected by the differential pressure detecting means.

In the internal combustion engine having the combustion heater according to the present invention, when the pressure in the air supply passageway becomes equal to or larger by the predetermined value than the pressure in the combustion gas discharge passageway, the valve mechanism opens, whereby the air for combustion flowing through the air supply passageway flows to the combustion gas discharge passageway via the communicating passageway. As a result, the pressure in the air supply passageway decreases, whereas the pressure in the combustion gas discharge passageway rises, with the result that there is reduced the differential pressure occurred between the air supply passageway and the combustion gas discharge passageway. Accordingly, the excessive air does not flow to the combustion chamber of the combustion heater, an air/fuel ratio in the combustion heater is stabilized, and the lean accidental fire does not occur.

According to a fifteenth aspect of the present invention, in the internal combustion engine having the combustion heater according to the fourteenth aspect of the invention, it is desirable that the valve mechanism is a check valve for permitting a unidirectional flow of a fluid and automatically shutting off the passageway with respect to a back flow.

According to a sixteenth aspect of the present invention, in the internal combustion engine having a combustion heater according to the first aspect of the invention, wherein the combustion heater introduces the air for combustion from an intake passageway of the internal combustion engine and raises temperatures of engine related elements by utilizing heat held by a combustion gas produced by burning the air-fuel mixture by mixing a fuel for combustion with the air for combustion in the combustion chamber; the intake passageway includes a supercharger for increasing a pressure of intake air in the intake passageway; the air supply passageway introduces, from the intake passageway, the intake air, of which the pressure has been increased by the supercharger, as the air for combustion into the combustion chamber; the thus introduced air for combustion is supplied to the combustion chamber by an air blower means; the combustion gas discharge passageway, bypassing cylinders of the internal combustion engine, discharges the combustion gas to an exhaust passageway of the internal combustion engine; and the air quantity control means controls a flow quantity of the air flowing through the combustion chamber by controlling the operation of the air blower means when a pressure in the air supply passageway becomes equal to or larger by a predetermined value than a pressure in the combustion gas discharge passageway.

"The predetermined value" given herein is the same as stated in the second aspect of the invention.

The internal combustion engine having the combustion heater according to the present invention is provided with the air quantity control means for, when the pressure in the air supply passageway becomes equal to or larger by the predetermined value than the pressure in the combustion gas discharge passageway, operating the air blowing means and thus controlling the quantity of the air flowing within the combustion chamber. With this construction, when the pressure in the air supply passageway becomes equal to or larger by the predetermined value than the pressure in the combustion gas discharge passageway, the air quantity control means controls the operation of the air blowing means to reduce a pressure of the air for combustion. The control being thus done, the differential pressure between the air supply passageway and the combustion gas discharge passageway decreases, and there is no possibility in which the air blow strong enough to make the combustion heater unable to effect the ignition occurs in the combustion chamber. Hence, the ignition in the combustion heater can be implemented with certainty. Further, this serves to prevent the accidental fire.

According to a seventeenth aspect of the present invention, in the internal combustion engine having the combustion heater according to the sixteenth aspect of the invention, it is desirable that the air quantity control means decreases an introduction quantity of the air for combustion into the combustion chamber by controlling the operation of the air blowing means.

In this case, when the pressure in the air supply passageway becomes equal to or larger by the predetermined value than the pressure in the combustion gas discharge passageway, the air quantity control means controls the operation of the air blowing means to reduce an introduction quantity of the air for combustion into the combustion chamber. The pressure applied to the air for combustion by the air blowing means is thereby decreased, and there disappears the differential pressure between the air supply passageway and the combustion gas discharge passageway, thus reducing the introduction quantity of the air for combustion down to a proper quantity. Accordingly, the excessive air does not flow into the combustion chamber, and it is feasible to surely effect the ignition in the combustion heater. Further, the air/fuel ratio in the combustion heater is stabilized, and the lean accidental fire is not caused.

According to an eighteenth aspect of the present invention, in the internal combustion engine having the combustion heater according to the seventeenth aspect of the invention, the air blowing means is a rotational fan, and the operation control of the air blowing means by the air quantity control means is reduction control of reducing the number of rotations of the rotational fan. Further, a halt of the rotational fan may be embraced in the reduction control of reducing the number of rotations., According to a nineteenth aspect of the present invention, in the internal combustion engine having the combustion heater according to the eighteenth aspect of the invention, a portion of the intake passageway located more downstream than a connecting point of the air supply passageway to the intake passageway is connected to the combustion gas discharge passageway via a combustion gas route switching means capable of selectively switching over the exhaust passageway and the intake passageway to introduce the combustion gas into either the exhaust passageway or the intake passageway. the combustion gas route switching means given herein refers to, for example, a three-way switching valve.

In the internal combustion engine having the combustion heater according to the present invention, the combustion gas route switching means is capable of switching over a route through which the combustion gas flows, and, with this switch-over, it is feasible to raise temperatures of the engine related elements of the intake system by introducing the combustion gas into the intake passageway or to raise temperatures of the engine related elements of the exhaust system by introducing the combustion gas into the exhaust passageway.

According to a twentieth aspect of the present invention, in the internal combustion engine having a combustion heater according to the first aspect of the invention, wherein the combustion heater introduces the air for combustion from an intake passageway of the internal combustion engine and raises temperatures of engine related elements by utilizing heat held by a combustion gas produced by burning the air-fuel mixture by mixing a fuel for combustion with the air for combustion, in the combustion chamber; the intake passageway includes a supercharger for increasing a pressure of intake air in the intake passageway; the air supply passageway, connected to the intake passageway, introduces the intake air, of which the pressure has been increased by the supercharger, as the air for combustion into the combustion chamber; the combustion gas discharge passageway, bypassing cylinders of the internal combustion engine, discharges the combustion gas to an exhaust passageway of the internal combustion engine; a communicating passageway for making the combustion gas discharge passageway communicate with a portion of the intake passageway located more downstream than a connecting point of the air supply passageway to the intake passageway; and the air quantity control means provided in the communicating passageway controls a flow quantity of the air flowing through the combustion chamber by opening and closing the communicating passageway in accordance with a differential pressure occurred between the side of the air supply passageway and the side of the combustion gas discharge passageway in the combustion chamber.

Further, "the communicating passageway" given herein means a passageway for connecting the intake passageway to the combustion gas discharge passageway to permit the air flow between the intake passageway and the combustion gas discharge passageway for discharging the combustion gas to the exhaust passageway of the internal combustion engine.

In the internal combustion engine having the combustion heater according to the present invention, the air quantity control means provided in the communicating passageway for connecting the intake passageway to the combustion gas discharge passageway, controls the quantity of the air flowing within the combustion chamber by opening and closing the communicating passageway in accordance with the differential pressure produced between the side of the air supply passageway and the side of the combustion gas discharge passageway in the combustion chamber.

That is, when the differential pressure in the combustion chamber increases and the quantity of the air flowing to the combustion chamber augments due to this increased differential pressure, the air quantity control means opens the communicating passageway to make the intake passageway and the combustion gas discharge passageway communicate with each other, whereby the combustion gas discharge passageway is connected to the intake passageway together with the air supply passageway originally connected to the intake passageway. Therefore, the pressure in the intake passageway acts on the side of the air supply passageway and on the side of the combustion gas discharge passageway in the combustion chamber, and consequently the pressures on both sides are equalized, or there is almost no differential pressure therebetween. Hence, the differential pressure in the combustion chamber is reduced, thereby sufficiently reducing the quantity of the air flowing to the combustion chamber or further reducing down to 0 (zero). Accordingly, there is no possibility in which the air blow strong enough to make the combustion heater unable to effect the ignition occurs in the combustion chamber. Hence, the ignition in the combustion heater can be implemented with certainty. The accidental fire can be surely prevented.

According to a twenty first aspect of the present invention, in the internal combustion engine having the combustion heater according to the twentieth aspect of the invention, it is desirable that the air quantity control means opens the communicating passageway when a pressure in the air supply passageway becomes equal to or larger by a predetermined value than a pressure in the combustion gas discharge passageway. "The predetermined value" given herein is the same as that stated in the second aspect of the invention.

In the internal combustion engine having the combustion heater according to the present invention, when the pressure in the air supply passageway becomes equal to or larger by the predetermined value than the pressure in the combustion gas discharge passageway, the air quantity control means provided in the communicating passageway opens the communicating passageway. With this construction, when the pressure in the air supply passageway becomes equal to or larger by the predetermined value than the pressure in the combustion gas discharge passageway, the air quantity control means opens the communicating passageway, whereby as described in the twentieth aspect of the invention, the ignition can be surely effected, and the effect of preventing the accidental fire can also be expected.

According to a twenty second aspect of the present invention, in the internal combustion engine having the combustion heater according to the twentieth aspect of the invention, it is desirable that the air quantity control means is a valve mechanism for opening the communicating passageway when the pressure in the air supply passageway becomes equal to or larger by the predetermined value than the pressure in the combustion gas discharge passageway, otherwise closes.

"The valve mechanism" given herein is, e.g., a three-way switching valve.

According to a twenty third aspect of the present invention, in the internal combustion engine having the combustion heater according to the twenty second aspect of the invention, the communicating passageway is a segment of another combustion gas discharge passageway for discharging the combustion gas emitted from the combustion heater to a portion of the intake passageway located more downstream than a connecting point to the air supply passageway, the valve mechanism is capable of performing a selective switch-over as to whether the combustion gas is introduced via the combustion gas discharge passageway into the exhaust passageway or introduced via another combustion gas discharge passageway into the intake passageway, and, when the pressure in the air supply passageway becomes equal to or larger by the predetermined value than the pressure in the combustion gas discharge passageway, an operation of the valve mechanism is controlled to make the combustion gas discharge passageway and another combustion gas discharge passageway communicate with each other.

In the internal combustion engine having the combustion heater according to the present invention, the combustion gas route switching means is capable of switching over the route of the combustion gas, and, with this switch-over, it is feasible to raise temperatures of the engine related elements of the intake system by introducing the combustion gas into the intake passageway or to raise temperatures of the engine related elements of the exhaust system by introducing the combustion gas into the exhaust passageway.

Note that the present invention is applicable to a case where a supercharging pressure of the supercharger may be a substitute for the differential pressure between the air supply passageway and the combustion gas discharge passageway, and it may be presumed that the supercharging pressure is over the predetermined value.

Furthermore, the present invention is applicable to a case where an intake pressure on the upstream-side of the cylinders of the internal combustion engine may replace the above differential pressure, and it may also be assumed that the intake pressure on the upstream-side is over the predetermined value.

These together with other objects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Other objects and advantages of the present invention will become apparent during the following discussion in conjunction with the accompanying drawings, in which.

DESCRIPTION OF THE PREFERRED EMBODIMENTS

Figure 1:
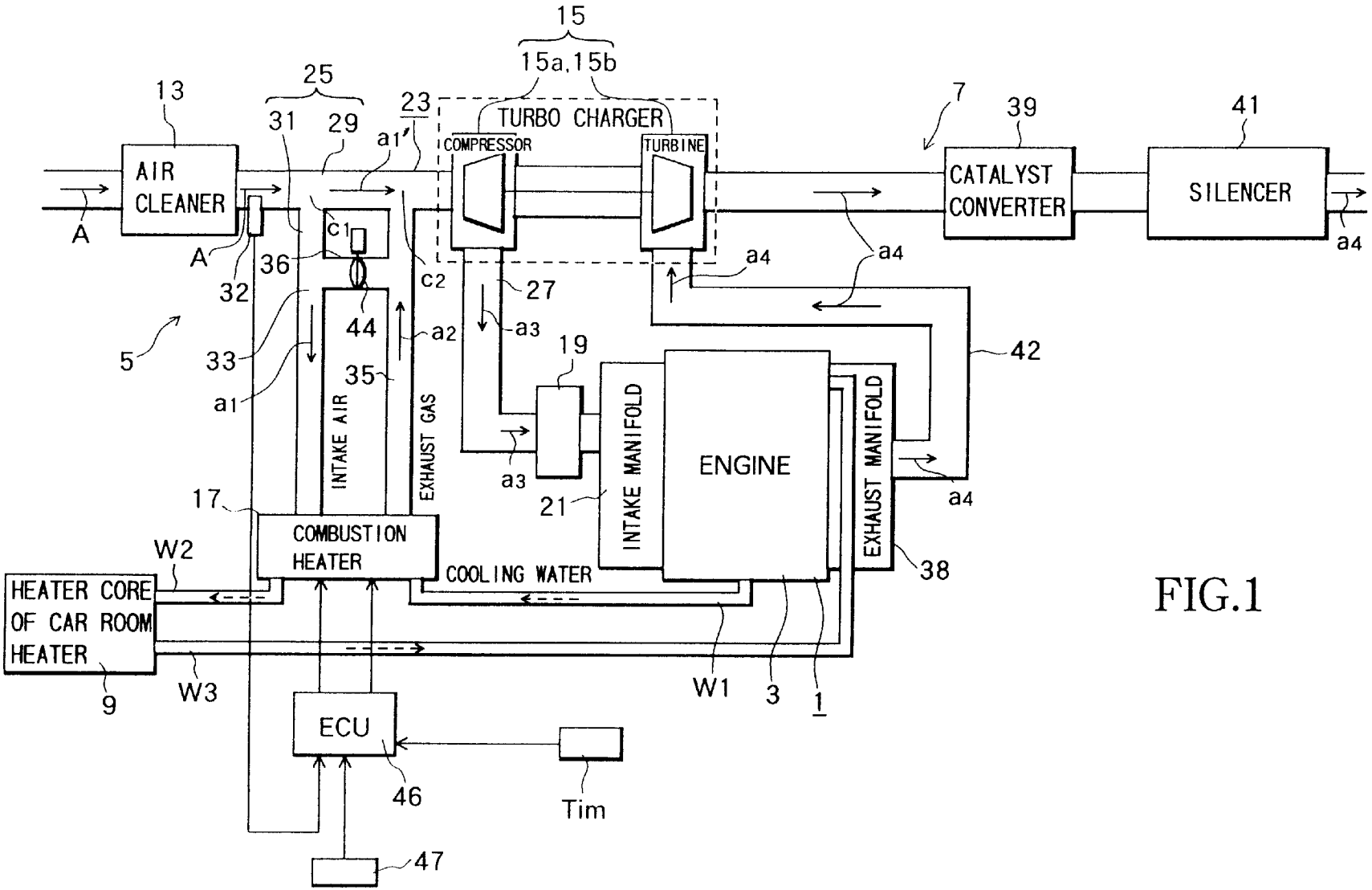
FIG. 1 is a schematic diagram showing a construction of an internal combustion engine having a combustion heater in a first embodiment of the present invention.

Embodiments of the present invention will hereinafter be described with reference to the accompanying drawings.

<First Embodiment>

A first embodiment will be described by referring to FIGS. 1 through 6.

An engine 1 serving as an internal combustion engine is classified as a water cooling type diesel engine or a gasoline direct injection lean-burn engine. The engine 1 includes an engine body 3 equipped with an unillustrated water jacket through which to circulate the engine cooling water defined as one of engine related elements, an air intake device 5 for supplying inside a plurality of unillustrated cylinders of the engine body 3 with the air needed for combustion, an exhaust device 7 for discharging into the atmospheric air an exhaust gas produced after an air-fuel mixture composed of the air supplied to the cylinders via the air intake device 5 and an injection fuel from an unillustrated fuel injection device has been burned in the cylinders, a heater core 9 of a car-room heater for warming the interior of a room of a vehicle mounted with the engine 1, and an ECU 46 defined an engine controller for controlling the whole engine.

The air intake device 5 has an intake pipe (an intake passageway) 23 starting with an air cleaner 13 for filtering the outside air and terminating with an unillustrated intake port of the engine body 3. The intake pipe 23 is, from the air cleaner 13 down to the intake port, provided, as intake system structures, with a compressor 15*a* of a turbo charger 15, a vaporizing combustion heater 17 (hereinafter simply referred to as a "combustion heater 17") for effecting the combustion under an atmospheric pressure, an inter cooler 19 for cooling a temperature of the suction air of which a temperature rises due to compression heat evolved when operating the compressor 15*a*, and an intake manifold 21 classified as a suction branch pipe.

The intake pipe 23 is separated, at the compressor 15*a* as a boundary, into a downstream-side connecting pipe 27 brought into a pressurized state because of the outside air entering the air intake device 5 being forcibly intruded by the compressor 15*a*, and an upstream-side connecting pipe 25 not brought into the pressurized state.

One upstream-side connecting pipe 25 is, referring to FIG. 1, constructed of a mainstream pipe 29 extending from the air cleaner 13 toward the compressor 15*a*, and a branch pipe 31 for the heater as a tributary pipe connected in bypass to the mainstream pipe 29.

An outside air temperature sensor 32 is attached to a portion, vicinal to a downstream-side of the air cleaner 13, of the mainstream pipe 29. Outside air A entering the mainstream pipe 29 from the air cleaner 13 is the fresh air for the combustion heater 17 as well as for the engine 1, and the outside temperature sensor 32 detects a temperature of the outside air A.

The branch pipe 31 for the heater takes a substantially "U" shape on the whole and embraces the combustion heater 17 disposed midways of this pipe 31. Further, the branch pipe 31 for the heater has, as other constituting members thereof, an air supply pipe 33 as an air supply passageway for supplying the combustion heater 17 with the fresh air, i.e., the fresh air (pre-combustion air) a1 for the combustion in the combustion heater 17 from the mainstream pipe 29 as well as for connecting an upstream-side portion of the combustion heater 17 to the mainstream pipe 29 in an air flowing direction, and a combustion gas discharge pipe 35 as a combustion gas discharge passageway for discharging a combustion gas (post-combustion air) a2 emitted from the combustion heater 17 into the mainstream pipe 29 as well as for connecting a downstream-side portion of the combustion heater 17 to the mainstream pipe 29 in the air flowing direction. Hence, the branch pipe 31 for the heater serves to supply and discharge the air to and from the combustion heater 17 via the air supply pipe 33 and the combustion gas discharge pipe 35.

Further, the branch pipe 31 for the heater also includes a communicating passageway 36 as a pipe member for connecting, at a portion closer to the mainstream pipe 29, the air supply pipe 33 to the combustion gas discharge pipe 35. The communicating passageway 36 is a pipe through which the air flows between the air supply pipe 33 and the combustion gas discharge pipe 35. Then, a valve device 44 serving as a flow quantity control mechanism for controlling a quantity of air flowing through the communicating passageway, is provided at the center inside the communicating passageway 36.

Note that air supply passageway 33 and the combustion gas discharge passageway 35 are used for only the combustion heater 17, and the communicating passageway 36 serves to connect the air supply pipe 33 and the combustion gas discharge pipe 35 which are dedicated to the combustion heater 17, and these members 33, 35 and 36 may therefore be called members belonging to the combustion heater 17.

Figure 2:
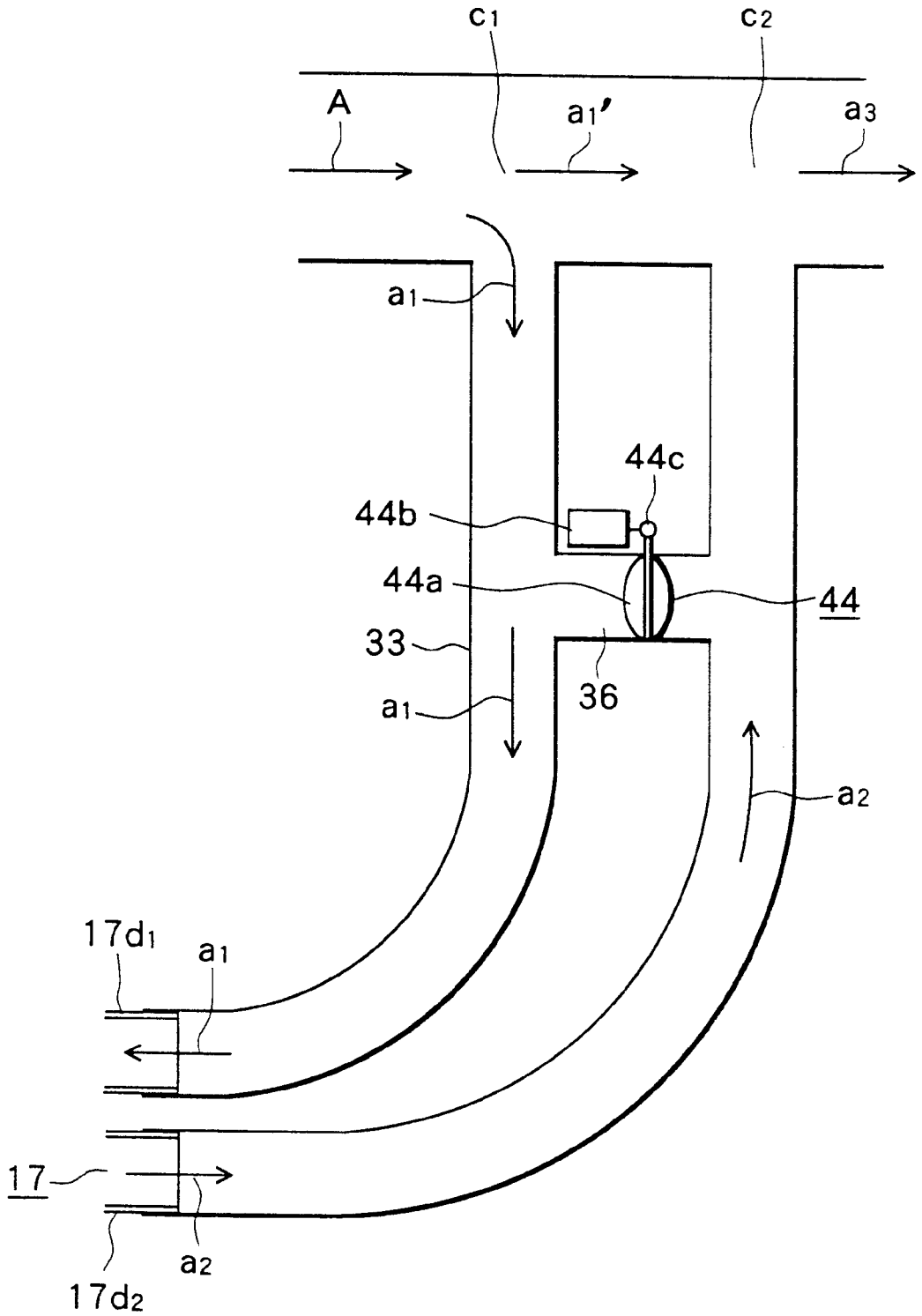
FIG. 2 is an enlarged view showing the principal portion in FIG. 1.

The valve device 44 is, as shown in FIG. 2, constructed of a valve member 44*a* functioning as a throttle valve, a driving motor 44*b*. drives this valve member 44*a* so as to open and close the valve member 44*a*, and an opening/closing mechanism unit 44*c* disposed between the driving motor 44*b* and the valve member 44*a*. An operation of the valve device 44 is controlled by an unillustrated CPU defined as a central unit of a computer, i.e., the ECU 46. To be more specific, the valve device 44, when an ignition of the combustion heater 17 is i.e. started by a glow plug 17*g* defined as an igniting device, opens the valve member 44*a* and, upon a completion of the ignition, throttles the valve member 44*a*. Namely, the communicating passageway 36, with the opening/closing of the valve member 44*a* by the operation of the valve device 44, opens when starting the ignition and closes after completing the ignition, thereby making the air supply pipe 33 and the combustion gas discharge pipe 35 communicative with each other or hindering the communication therebetween. The communicating passageway 36 opens and closes corresponding to such operations of the valve member 44*a*. Hence, the valve device 44 including the valve member 44*a* may be called a communicating passageway opening/closing mechanism, provided in the communicating passageway 36, for opening and closing the communicating passageway 36. Then, with the opening/closing thereof, the air flows or ceases to flow between the air supply pipe 33 and the combustion gas discharge pipe 35. The quantity of air flowing to the combustion heater 17 is regulated by permitting and stopping the air flow between the air supply pipe 33 and the combustion gas discharge pipe 35 through the communicating passageway 36.

Further, with respect to individual connecting points C1, C2 of the air supply passageway 33 and the combustion gas discharge passageway 35 to the mainstream pipe 29, the connecting point C1 is disposed more upstream of the mainstream pipe 29 than the connecting point C2. Therefore, the outside air (the fresh air) A from the air cleaner 13 is separated into the air a1 diverging at the connecting point C1 to the heater branch pipe 31, and air a1' flowing toward the connecting point C2 through the mainstream pipe 29 without diverging.

The air a1 diverging at the connecting point C1 flows via a route such as the air supply passageway 33→the combustion heater 17→the combustion gas discharge passageway 35, and flows back as the air a2 to the mainstream pipe 29 from the connecting point C2. Further, the air a2 becomes confluent with the fresh air a1' at the connecting point C2, and turns out to be combustion gas mixed air a3 as air for the combustion of the engine 1.

Note that generally the combustion gas from the combustion heater is a gas emitting almost no smokes in a normal combustion state, in other words, containing no carbon. This is the same as that in the combustion heater 17 in this embodiment. It is therefore no problem to use the combustion gas a2 of the combustion heater 17 as the suction air of the internal combustion engine.

The downstream-side connecting pipe 27 is, as shown in FIG. 1, a pipe for connecting the compressor 15*a* to the intake manifold 21. Further, the inter cooler 19 is disposed at a portion, closer to the intake manifold 21, of the downstream-side connecting pipe 27.

On the other hand, the exhaust device 7 includes an exhaust pipe (an exhaust passageway) 42 structurally starting with an unillustrated exhaust port of the engine body 3 and terminating with a silencer 41. From the exhaust port down to the silencer 41, along the exhaust pipe 42, there are disposed in sequence, as exhaust system structures, an exhaust manifold 38 as an exhaust gas collecting pipe, a turbine 15*b* of the turbo charger 15 and a catalyst converter 39 defined as an exhaust gas purifying device.

What can be exemplified as a catalyst contained in the catalyst converter 39 may be a selective reduction type NOx catalyst, an occlusion reducing type NOx catalyst, or DPF (Diesel Particulate Filter) bearing an oxide catalyst.

Further, the air flowing through the exhaust device 7 is designated by the symbol a4 as an exhaust gas of the engine 1.

Figure 3:
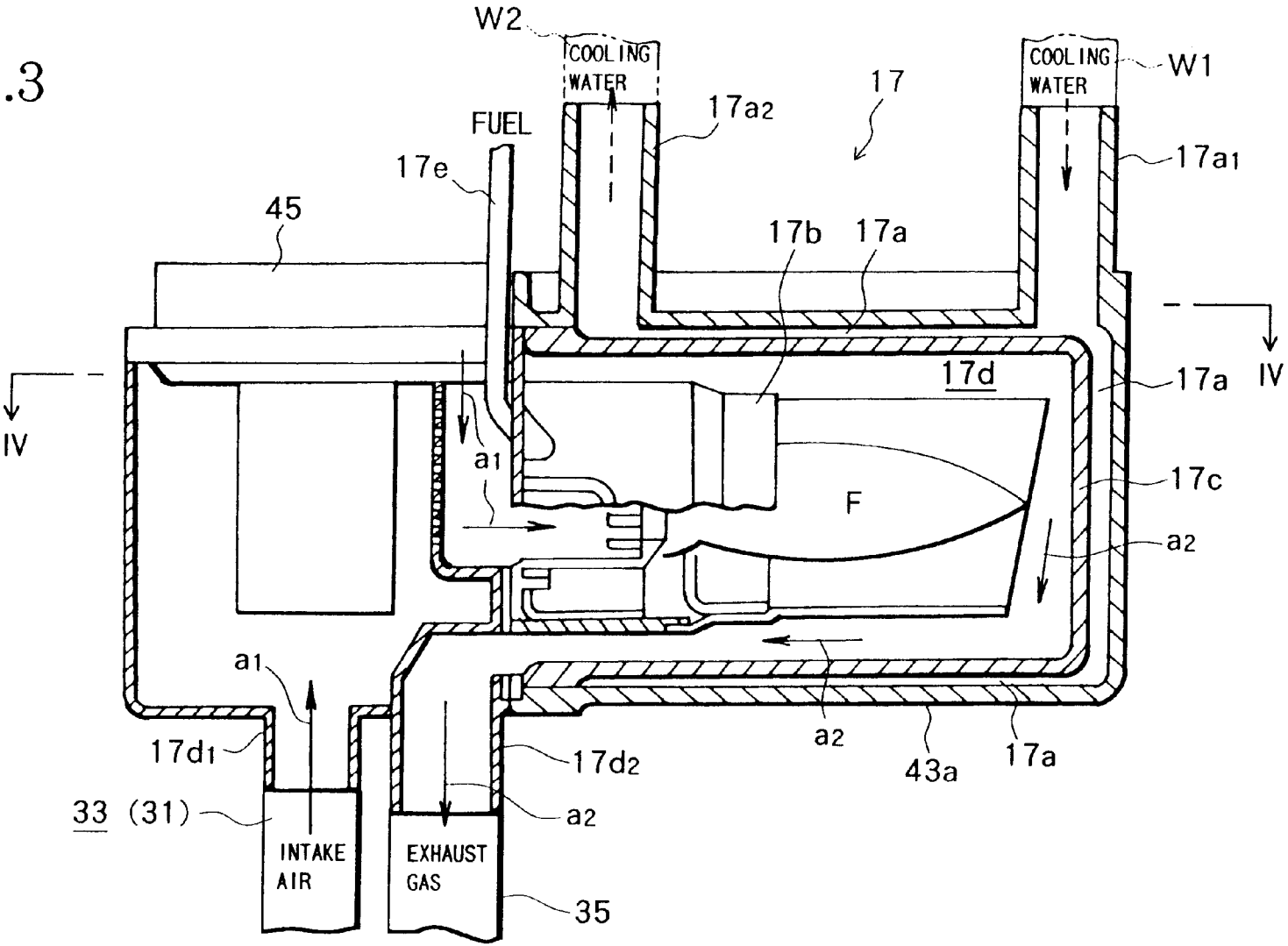
FIG. 3 is a schematic sectional view showing the combustion heater in the embodiment of the present invention.
Figure 4:
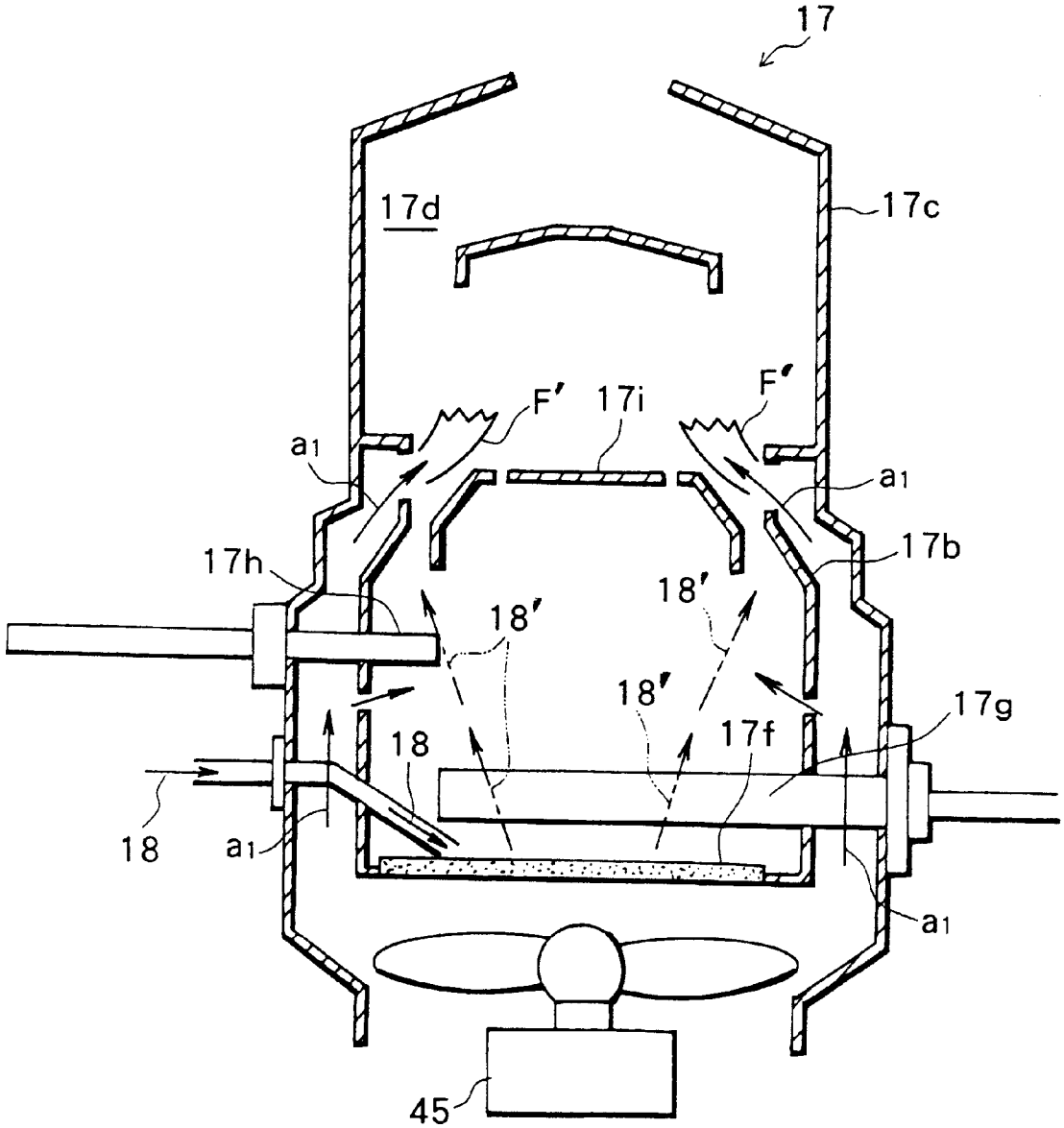
FIG. 4 is a sectional view cut off by an imaginary section containing the line IV—IV in FIG. 3 as viewed in an arrow direction.

Next, a structure of the combustion heater 17 is schematically shown in FIGS. 3 and 4.

The combustion heater 17 is capable of raising a temperature of the suction air flowing through the air intake device 5 by utilizing the heat held by the combustion gas produced when the same fuel as the fuel used in the engine 1 is burned, with this combustion gas being introduced into the intake pipe 23 beforehand. Further, the CPU controls a combustion state of the combustion heater 17.

The combustion heater 17 is connected to the water jacket of the engine body 3 and includes an engine cooling water passageway 17*a* through which to flow engine cooling water from the water jacket thereinto. The engine cooling water flowing through the engine cooling water passageway 17*a*, as indicated by the broken line in FIG. 3, passes through round a combustion chamber 17*d*, formed inwardly of the combustion heater 17, for growing a latent flame into flames, during which the engine cooling water receives the heat from the combustion chamber 17*d* and is thus warmed up.

The combustion chamber 17*d* is constructed of a combustion cylinder 17*b* from which flames are emitted, and a cylindrical partition wall 17*c* for covering the combustion cylinder 17*b* to prevent the flames from leaking outside. By covering the combustion cylinder 17*b* with the cylindrical partition wall 17*c*, the combustion chamber 17*d* is defined within the partition wall 17*c*. Then, the partition wall 17*c* is also covered with an outer wall 43*a* of the combustion heater 17, whereby a spacing is provided therebetween. With this spacing, the engine cooling water passageway 17*a* is formed between an inner surface of the external wall 43*a* and an outer surface of the partition wall 17*c*.

Further, the combustion chamber 17*d* has an air supply port 17*d* l and an exhaust gas discharge port 17*d*2, which are connected to the air supply passageway 33 and the combustion gas discharge passageway 35, respectively.

Then, the air a1 entering the combustion chamber 17*d*. via the air supply port 17*d* 1 from the air supply passageway 33, flows via the combustion chamber 17*d* to the exhaust gas discharge port 17*d* 2. Thereafter, the air a1 flows through the combustion gas discharge pipe 35 and, as already described above, flows as the air a2 into the mainstream pipe 29.

Consequently, the combustion chamber 17*d* takes a form of a series of air flow passageways through which to flow the air a1 changed into the air a2 within the combustion heater 17.

After the combustion in the combustion heater 17, the air a2 flowing back to the mainstream pipe 29 via the combustion gas discharge pipe 35, is a so-called combustion gas discharged from the combustion heater 17 and therefore holds the heat. Then, the air a2 holding the heat arrives at the combustion gas discharge pipe 35 out of the combustion chamber 17*d*, during which the heat held by the air a2 is transmitted to the engine cooling water flowing along the engine cooling water passageway 17*a* via the partition wall 17*c* and, as already explained above, warms the engine cooling water. The thus warmed engine cooling water flows to the water jacket of the engine 1 and warms up the engine body 3.

Further, the combustion cylinder 17*b* includes a fuel supply pipe 17*e* connected to an unillustrated fuel pump. The fuel supply pipe 17*e* supplies a fuel for combustion, upon receiving a pump pressure of the fuel pump, to the combustion cylinder 17*b*. Hence, the fuel pump and the fuel supply pipe 17*e* may be referred to as a fuel supply mechanism. A RAM (Random Access Memory) of the ECU 46 for controlling the combustion state of the combustion heater 17 is temporarily stored with a fuel supply quantity based on the operation of the fuel pump, as an integrated value of the fuel supply quantity since the operation of the fuel pump has been started. The integrated value is invoked to the CPU as the central unit of the ECU 46 as the necessity arises.

The combustion fuel to be supplied is an liquefied fuel 18. The liquefied fuel 18 is fed through a fuel vaporizing unit 17*f* shown in FIG. 4 and turns out a vaporized fuel 18'. The vaporized fuel 18' is ignited by a glow plug 17*g* for emitting the heat upon conduction thereof by an unillustrated battery, which is defined as an igniting device. Upon an exothermic process of the glow plug 17*g*, a timer Tim (see FIG. 1) counts an actual elapse time Tm1 since the electrification has been started, and a count value is also temporarily stored in the RAM. Then, the count value is invoked to the CPU as the necessity arises.

Referring to FIG. 4, the symbol 17*h* represents a combustion gas temperature sensor serving as an ignition sensor for detecting using a combustion gas temperature whether or not the combustion fuel is ignited by the glow plug 17*g* as the igniting device, and the symbol 17*i* designates a fuel heating evaporation plate. The vaporized fuel 18' is ignited in the vicinity of the fuel heating evaporation plate 17*i*, thereby obtaining a latent flame F' as a source of flames F. For growing this latent flame F' into the flames F, an air blow fan 45 provided on the side of the air supply pipe 33 with respect to the combustion chamber 17*d* controls a quantity of the air flowing inside the combustion chamber 17*d*.

The air blow fan 45 provided in the combustion heater 17 is positioned upstream of the combustion chamber 17*d* taking the form of the air flow passageway. Then, the CPU of the ECU 46 controls the operation of the air blow fan 45, thereby controlling an output thereof. This output control changes a quantity of the air flowing within the combustion chamber 17*d*. Namely, the quantity of the air flowing inside the combustion chamber 17*d* can be controlled by controlling the output of the air blow fan 45.

Further, a ROM (Read-Only-Memory) of the ECU 46 stores therein a predetermined time T1, which is a comparative time for comparing with the elapse time Tm1 since the start of conduction of the glow plug 17*g*, and serves as a yardstick for executing the control of the operation of the fuel pump.

Next, a circulation of the engine cooling water via the engine cooling water passageway 17*a*, will be explained with reference to FIGS. 1 and 3.

The engine cooling water passageway 17*a* is formed with a cooling water introducing port 17*a*1 communicating with the water jacket of the engine body 3, and an engine cooling water discharge port 17*a*2 leading to the heater core 9.

The engine cooling water introducing port 17*a*1 is connected via a water conduit W1 to the engine body 3. Further, the engine cooling water discharge port 17*a*2 is connected via a water conduit W2 to the heater core 9.

The combustion heater 17 is connected to the water jacket of the engine body 3 and to the heater core 9 via these water conduits W1, W2. Moreover, the heater core 9 is also connected via the water conduit W3 to the engine body 3.

Accordingly, the engine cooling water in the water jacket of the engine body 3 flows in the following sequences of (1)–(3).

(1) The engine cooling water flows to the combustion heater 17 from the engine cooling water introducing port 17*a*l via the water conduit W1, and is warmed up therein.

(2) The thus warmed engine cooling water arrives at the heater core 9 from the engine cooling water discharge port 17*a*2 of the combustion heater 17 via the water conduit W2.

(3) The engine cooling water, of which a temperature has decreased due to a heat exchange in the heater core 9, thereafter flows back to the water jacket via the water conduit W3.

Note that a water temperature sensor 47 for detecting a temperature of the engine cooling water is attached to the water jacket.

Thus, the engine cooling water is circulated between the engine body 3, the combustion heater 17 and the heater core 9 via the water conduits W1, W2 and W3.

Further, the ECU 46 is electrically connected to the temperature detection sensor 17*h*, the outside air temperature sensor 32, the water temperature sensor 47, the timer Tim, the air blow fan 45 and the fuel pump. Then, the CPU properly controls the combustion state of the combustion heater 17 in accordance with each parameter of the fuel pump and output values of the sensors 17*h*, 32 and 47, the timer Tim and the air blow fan 45, whereby a momentum, a size and a temperature of the flames in the combustion heater 17 are maintained in optimal states.

Furthermore, a temperature of the exhaust gas from the combustion heater 17 and an air/fuel ratio of the combustion heater 17 are controlled by the CPU controlling the combustion state of the combustion heater 17.

Figure 5:
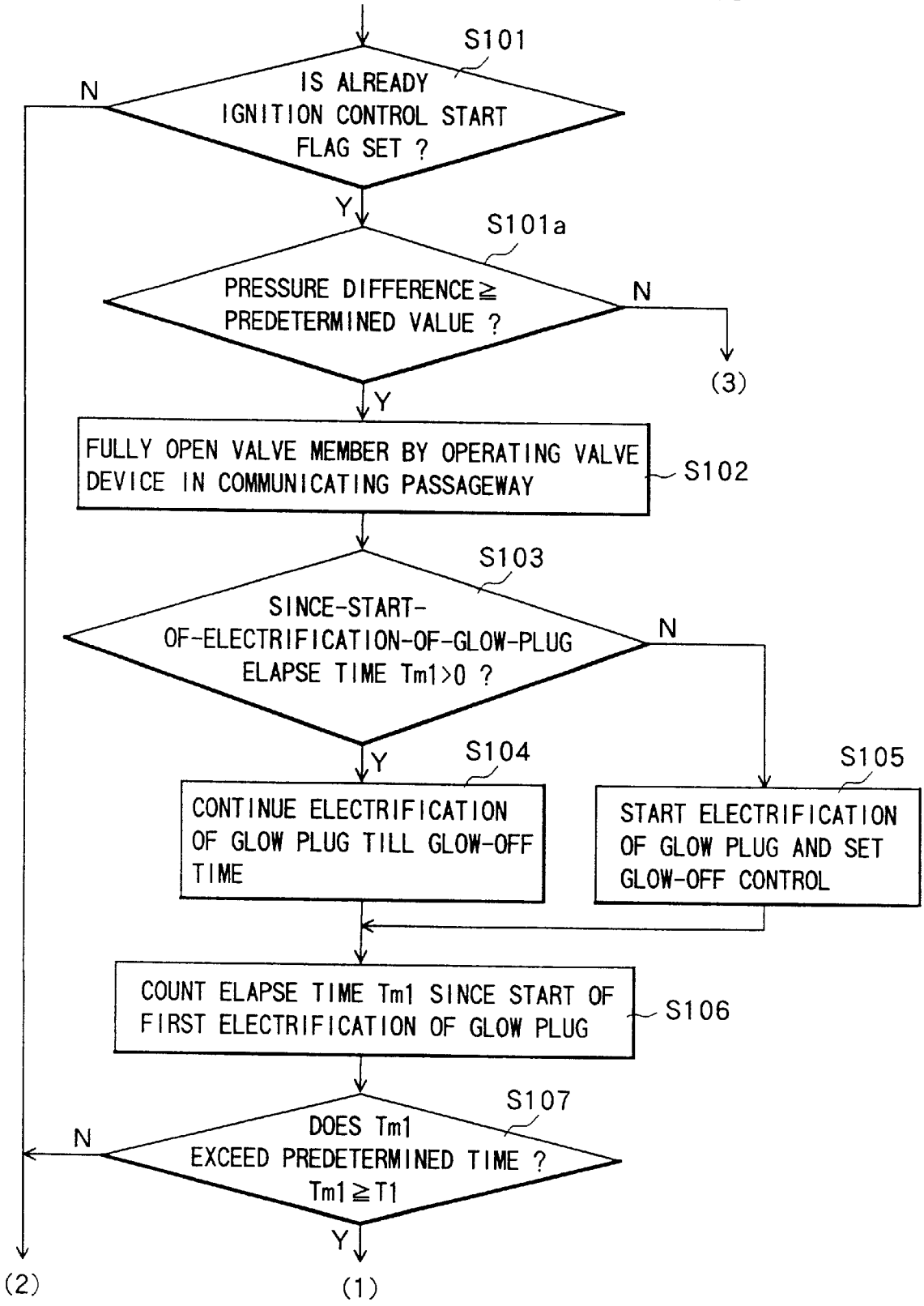
FIG. 5 is a diagram showing a part of a flowchart of an operation control execution routine of the combustion heater in the first embodiment of the present invention.
Figure 6:
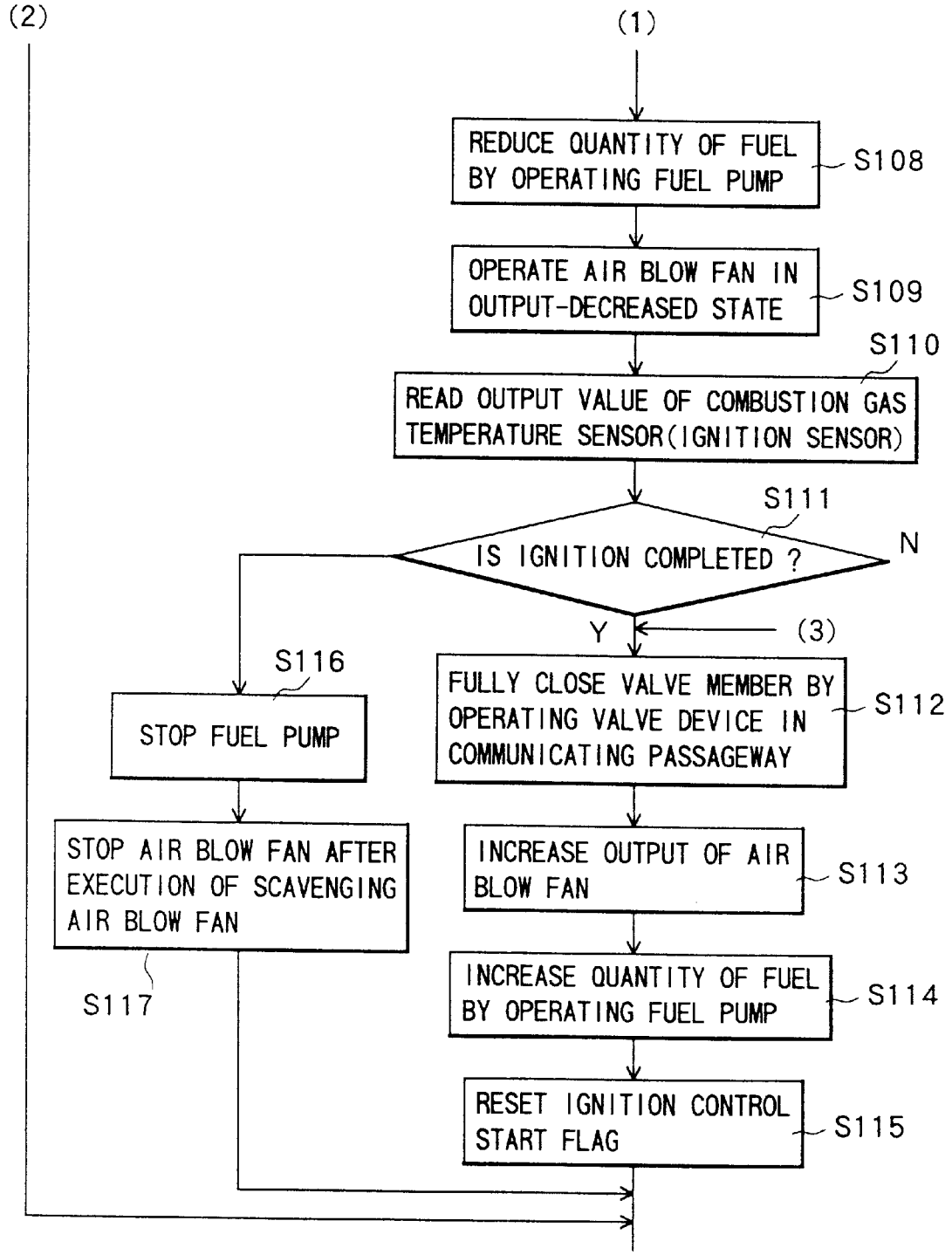
FIG. 6 is a diagram showing another part of the flowchart, continued from FIG. 5, of the operation control execution routine of the combustion heater in the first embodiment of the present invention.

Next, a program for actualizing an operation control execution routine of the combustion heater 17 is described referring to FIGS. 5 and 6. This program is a part of an unillustrated general program for driving the engine 1, and consists of steps S101–S117 which will be hereinafter explained. The ROM of the ECU 46 had stored therein the above program comprising these steps. Further, the ROM of the ECU 46 had also stored therein the programs for executing routines relating to embodiments from a second embodiment onward. Then, all the processes in the respective steps constituting the respective programs are executed by the CPU of the ECU 46.

Note that the illustrations in FIGS. 5 and 6 should be originally given en bloc on the same sheet and are separated in terms of a limited space on the sheet. The reference numerals (1) and (2) shown in FIG. 5 correspond to the numerals (1) and (2) shown in FIG. 6, which indicate where the processing is shifted to. For example, (1) in FIG. 5 corresponds to (1) in FIG. 6, and the process in a route relating to (1) in FIG. 5 implies that. the process shifts to a route relating to (1) in FIG. 6 and continues as it is in FIG. 6.

Furthermore, the symbol such as (1) formed by marking the numeral with parentheses "( )", which indicates where the processing is shifted to, has the same meaning in flowcharts of the operation control routine of the combustion heater in the second embodiment. Note that the steps are expressed by using the symbol S such as S101 in an abbreviated form in the case of, e.g., the step 101.

After starting the engine 1, when the processing shifts to this routine, to begin with, it is judged in S101 whether or not an ignition control start flag is already set, i.e., where or not the engine 1 is in an operation state where the combustion heater 17 needs to be actuated.

"The operation state where the combustion heater 17 needs to be actuated" implies that the engine 1 is in the following predetermined operation states such as, e.g., a time when the engine 1 operating at a cold time and an extremely cold time, or after the start of the internal combustion engine, or when an exothermic quantity of the internal combustion engine itself is small, and further when a heat receiving quantity of the engine cooling water is thereby small, and when warming up the engine immediately after being started at a normal temperature and the like.

Hence, when the engine 1 is in these operation states where the combustion heater 17 needs to be actuated, as a matter of course, a temperature of the engine cooling water is low. Therefore, to specifically describe a basis on which to judge whether or not the engine 1 is in a state where the combustion heater 17 needs to work, for instance, it is judged whether or not the temperature of the engine cooling water is lower than a predetermined temperature (e.g., 60° C.). The temperature of the engine cooling water is detected by the water temperature sensor 47 related to the water jacket of the engine body 3.

Then, if judge to be affirmative in S101, the processing proceeds to next S101*a*.

Further, whereas if negated in S101, this routine comes to an end.

It is judged in S101*a* whether or not a differential pressure caused between the combustion gas discharge passageway 35 and the air supply passageway 33 within the combustion chamber 17*d*, i.e., the differential pressure caused between the air supply port 17*d*1 communicating with the combustion chamber 17*d* and the exhaust gas discharge port 17*d*2, more specifically, between the connecting point C1 and the connecting point C2, is equal to or over a predetermined value. The predetermined value given herein means a minimum value of the differential pressures which are large enough to cause an air blow quantity produced in the combustion heater 17 excessive, due to such large differential pressure, thereby to make the ignition in the combustion heater 17 impossible.

Further, the detection of the differential pressure involves the use of an unillustrated pressure sensor. Then, a detected value of the pressure sensor is converted into an electric signal, and this signal is transmitted to an ECU 11. The ECU 11, based on the electric signal transmitted thereto, makes a judgement in S101*a*.

If judged to be affirmative in S101*a*, the processing proceeds to next S102. Whereas if negated, the processing diverts to S112.

In S102, the driving motor 44*b* is rotated to operate the opening/closing mechanism 44*c*, thereby fully opening the valve member 44*a* of the valve device 44 provided in the communicating passageway 36. In S112, the valve member 44*a* is fully closed.

With the full-opening of the valve 44*a* in S102, the air supply pipe 33 directly communicates via the communicating passageway 36 with the combustion gas discharge pipe 35, i.e., the communication therebetween is made. At this time, the air in the air supply pipe 33 flows out through the combustion gas discharge pipe 35 via the communicating passageway 36, and hence the above differential pressure becomes smaller than the predetermined value. Accordingly, it never occurs that the excessive air blow is caused within the combustion chamber 17*d* of the combustion heater 17.

By contrast, with the full-closing of the valve 44*a* in S112, the air supply pipe 33 does not communicate with the combustion gas discharge pipe 35. That is, the air in the air supply pipe 33 does not flow out through the combustion gas discharge pipe 35 via the communicating passageway 36. Hence, the air in the air supply pipe 33 flows directly to the combustion chamber 17*d*. There is, however, a relationship that the differential pressure given above is smaller than the predetermined value as a premise for executing the process in S112, so that the excessively strong air blow does not occur in the combustion chamber 17*d*.

When, for example, an engine speed increases, however, with this increase, the differential pressure gradually rises towards the predetermined value. Then, when executing a judging process in S101*a* next time, if the differential pressure becomes equal to or larger than the predetermined value, an affirmative judgement is to be made in S101*a*. The processing therefore proceeds to S102, wherein the process described above is executed.

Hence, based on the judgement in S101*a*, i.e., in accordance with the differential pressure caused between the combustion gas discharge passageway 35 and the air supply passageway 33 in the combustion chamber 17*d*, the communicating passageway 36 is opened and closed by the operation of the valve device 44. As a result, the quantity of the air flowing within the combustion chamber 17*d* is controlled, and therefore the communicating passageway 36, the valve device 44 as the communicating passageway opening/closing mechanism for opening and closing the communicating passageway 36 and the steps S101*a*, S102, S112 for controlling the operation of the valve device 44 may be called an air quantity control means. Note that the three steps S101*a*, S102 and S112 are stored in the ROM of the ECU 11, and therefore, the communicating passageway 36, the valve device 44 and the ECU 11 may be alternatively called the air quantity control means. Further, the air quantity control device may also be said to include the communicating passageway 36 and the valve device 44 as the communicating passageway 36 opening/closing mechanism, provided in this communicating passageway 36, for opening and closing the communicating passageway 36.

It is judged in S103 by using an inequality whether or not an actual elapse time Tm1 since the start of conduction of the glow plug 17 is larger than 0 (zero). Namely, if the elapse time Tm1>0, an affirmative judgement is made, and the CPU proceeds to S104. Whereas.3 if not, the judgement is negative, and the CPU advances to S105.

The judgement in S103 may also be a step of judging whether or not the glow plug 17*g* is conducted for the first time. That is, the negative judgement made in S103 implies that the glow plug 17*g* has not yet been conducted once, and therefore the elapse time Tm1 since the start of conduction of the glow plug 17*g* is invariably "0". Hence, the negative judgement is made, and the processing proceeds to S105, wherein the conduction of the glow plug 17*g* is started.

Further, in S105, if the glow plug 17*g* continues to be conducted, the battery is consumed up, and hence there is set control of stopping the conduction when the predetermined time is reached after starting the conduction for the first time (stopping of conduction is hereinafter referred to as "glow-OFF"). Thereafter, the CPU advances to S106. Note that the step of executing the glow-OFF is omitted for simplifying the explanation.

In S106, the elapse time Tm1 since the start of the first conduction of the glow plug 17*g* is counted.

Now, returning to the explanation of S103, if judged, to be affirmative in S103, this indicates a case of a routine after the second routine with the ignition control start flag being already set. More specifically, this is; the case of the routine after the second routine after making the negative judgement in S103 about the conduction of the glow plug 17*g*, i.e., after the timer Tim has counted the actual elapse time Tm1 since the start of the conduction of the glow plug 17*g* after the glow plug 17*g* has already once been conducted. Hence, the time Tm1 actually counted since the start of conduction of the glow plug 17*g* is a numerical value invariably larger than "0". Therefore, the affirmative judgement is made in S103 in this case, the processing proceeds to next S104.

In S104, the glow plug 17*g* continues to be conducted until a glow-OFF time, and thereafter, the CPU advances to S106.

It is judge in S107 by using the inequality containing an equal sign whether or not the elapse time Tm1 counted in S106 exceeds the predetermined time T1 which is a basis for executing the operation control of the fuel pump. That is, when the elapse time Tm1≧the predetermined time T1, the judgement is affirmative, and the CPU goes forward to next S108. Whereas if judged to be negative, this routine is finished.

Decreased in S108 is a quantity of the liquefied fuel supplied to the fuel vaporizing unit 17*f* from the fuel supply pipe 17*e* by operating fuel pump. This is because it might be sufficient to ensure a fuel quantity necessary for producing at first the latent flame.

In S109, the air blow fan 45 is operated in a state where the output is decreased. This is because it is preferable to restrain an air blow quantity by reducing the number revolutions of the air blow fan in order to facilitate making the latent flame.

In S110, an output value of the combustion gas temperature sensor 17*h* is read.

In S111, it is judged based on the output value of the combustion gas temperature sensor 17*h* in S110 whether or not the ignition is completed, i.e., whether or not the latent flame is produced. Whether the latent flame is produced or not depends upon a judgement about whether 03not the output value given in S110 is larger than a specified predetermined value. Upon confirming that the latent flame is ensured, the processing proceeds to next S112. When judging that the latent flame is not ensured, the CPU advances to S116.

Further, in the combustion heater 17, when the latent flame is ensured, the latent flame produced in S111 is set to have a magnitude enough to enable it to surely grow into the flames.

In next S113, the quantity of air flowing to the combustion chamber 17*d* is increased by raising the output of the air blow fan 45. The reason for this is that the latent flame has already been produced at that time and, as described above, has the magnitude large enough to surely grow into the flames, and therefore, even when the quantity of the air flowing to the combustion chamber 17*d* is increased by raising the output of the air blow fan 45, there is no possibility of extinguishing the latent flame.

In S114, a quantity of the liquefied fuel supplied to the fuel vaporizing unit 17*f* from the fuel supply pipe 17*e* is increased by operating the fuel pump. This is intended to grow the latent flame into the flames.

In S115, the ignition control start flag is reset in preparation for a next operation control execution of the combustion heater 17.

To get back to the discussion on S111, the negative judgement is made in S111, and, when proceeding to S116, the operation of the fuel pump is stopped. Then, the processing proceeds to S117. If judged to be negative in S111, this implies a state of no latent flame existing, and therefore, even if the fuel is supplied, the air/fuel ratio of the combustion heater 17 falls into a so-called over-rich state in which the fuel supply quantity is too much for the quantity of air existing within the combustion heater. Then, in this case, the fuel is simply vaporized, and consequently there might arise troubles such as an emission of white smokes, a smell of raw gas due to a generation of unburned hydrocarbon. The above operational stop of the fuel pump is intended to prevent these troubles.

After S116, the processing proceeds to S117.

In S117, the interior of the combustion chamber 17*d* of the combustion heater 17 is scavenged by operating the air blow fan 45, i.e., an extra fuel is swept out of the combustion chamber 17*d*. Then, after finishing the scavenging, the operation of the air blow fan 45 is halted, and this routine comes to an end. The reason why the operation of the air blow fan 45 is stopped is that there is no meaning in continuing to rotate the air blow fan 45 even after having finished scavenging.

The engine 1 in the first embodiment discussed above has the communicating passageway 36 through which the air supply pipe 33 communicates with the combustion gas discharge pipe 35. The communicating passageway 36 serves to flow the air between the air supply pipe 33 and the combustion gas discharge pipe 35. Hence, when the air flowing through the air supply pipe 33 arrives at the point connected to the communicating passageway 36, the air diverges separately to the communicating passageway 36 and to the combustion heater 17.

Further, in the communicating passageway 36, the valve member 44*a* of the valve device 44 provided therein opens when the glow plug 17*g* starts igniting (refer to S102). Therefore, even if the air with a momentum flows towards the combustion heater 17, the air having the momentum, at least when starting the ignition in the combustion heater 17, i.e., when the glow plug 17*g* evolves the heat upon its being the electrified, flows out to the combustion gas discharge pipe 35 via the communicating passageway 36, and the air momentum is attenuated.

Namely, if a degree of opening of the communicating passageway 36 by the valve member 44*a* is sufficiently enlarge, the quantity of the air flowing toward the combustion heater 17 can be amply reduced to such an extent that the ignition in the combustion heater 17 can be surely carried out, or reduced farther down to 0 (zero).

Hence, the air blow strong enough to make the ignition unable to be done does not occur in the combustion chamber 17*d* of the combustion heater 17. As a result, no strong wind flows within the air flow passageway, and hence ignition in the combustion heater can be surely attained at one time. Besides, it is feasible to prevent the emissions of the white smokes and of a disagreeable smell attributed to the generation of the unburned hydrocarbon.

Moreover, the combustion heater 17 includes the combustion gas temperature sensor 17*h* as the ignition sensor for detecting using the combustion gas temperature whether or not the combustion fuel is ignited by the glow plug 17*g* as the igniting device. When the combustion gas temperature sensor 17*h* detects the ignition, the output value of the combustion gas temperature sensor 17*h* is inputted to the CPU.

Then, when the CPU judges based on this output value that the combustion fuel has been ignited, i.e., that the latent flame has been ensured, the valve device 44 is closed. Thereupon, the air, which has flowed out to the combustion gas discharge pipe 35 so far via the communicating passageway 36, flows back to the air supply pipe 33, and therefore the flowing air quantity in the combustion chamber 17*d* of the combustion heater 17 is increased. Further, in combination with the increase in flowing air quantity with the operation of the air blow fan 45, the latent flame eventually grows into the flames.

For growing the latent flame into the flames, in addition to increasing the flowing air quantity, it is required that the fuel be supplied by the fuel pump and the fuel supply pipe 17*e* which constitute the fuel supplying mechanism. The CPU controls the fuel supply. The CPU, before the combustion gas temperature sensor 17*h* detects the ignition, restricts the fuel supply quantity, and cancels the restriction of the fuel supply quantity after detecting the ignition.

Thus, in the combustion heater 17, the existence of the latent flame is confirmed from the judgement made by the CPU on the basis of the detection by the combustion gas temperature sensor 17*h*. After confirming that the ignition has been done, the quantity of the air flowing through the combustion chamber 17*d* is increased, so that the latent flame can be certainly grown into the flames.

Further, in the combustion heater 17, before the combustion gas temperature sensor 17*h* detects the ignition, the CPU restricts the fuel supply quantity and, after detecting the ignition, cancels the restriction of the fuel supply quantity. Hence, after detecting the ignition, i.e., at a point of time when it becomes certain to ensure the latent flame, the fuel supply quantity is increased for the first time. Hence, it is feasible to prevent with further certainty the emissions of the white smokes and of the disagreeable smell due to the generation of the unburned hydrocarbon.

<Applied Examples>

Figure 7:
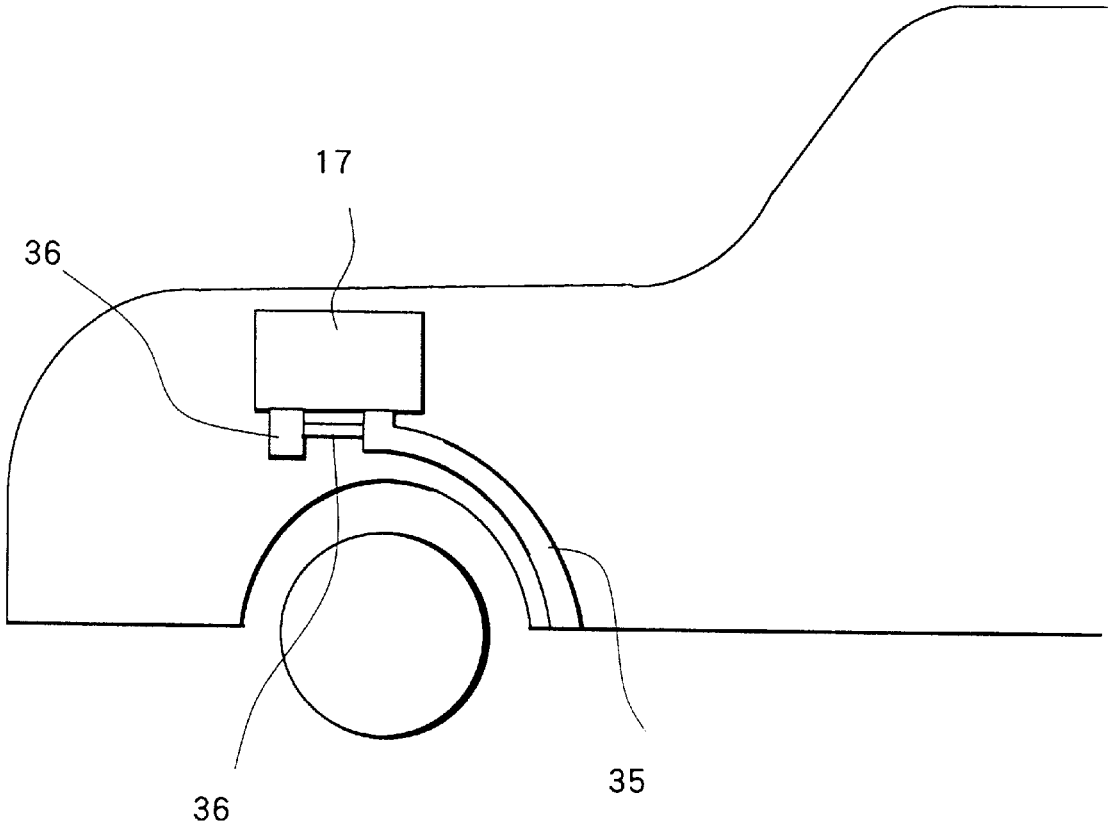
FIG. 7 is a view showing an applied example of the internal combustion engine having the combustion heater in the first embodiment of the present invention.

FIG. 7 is a conceptual diagram showing a state where a vehicle is mounted with the internal combustion engine having the combustion heater in the first embodiment.

What is exemplified in this case is an arrangement that the engine (of which the illustration is omitted in FIG. 7) 1 and the combustion heater 17 are disposed in a front part of the vehicle.

The combustion heater 17 makes both of the air supply pipe 33 and the combustion gas discharge pipe 35 open to the atmospheric air, but does not permit them to communicate with the intake passageway and the discharge passageway of the engine 1. Then, the air supply pipe 33 is disposed in the front part of the vehicle, while the combustion gas discharge pipe 35 is disposed in a rear part of the vehicle.

Accordingly, when the vehicle travels at a high speed, a negative pressure occurs in the combustion gas discharge pipe 35, and hence the air entering an inlet of the air supply pipe 33 flows via the combustion chamber 17*d* of the combustion heater 17. Thereafter, the air is discharged into the atmospheric air from the combustion gas discharge pipe 35. Accordingly, there is induced a large differential pressure therebetween. According to the present invention, however, as already explained, the air supply pipe 33 is connected via the communicating passageway 36 to the combustion gas discharge pipe 35, and the communicating passageway 36 is provided with the valve device 44 (omitted in FIG. 7). Hence, it never happens that the combustion heater undergoes a failure of ignition, and the accidental fire can be prevented.

<Second Embodiment>

A second embodiment will be discussed with reference to FIGS. 8 through 11.

Figure 8:
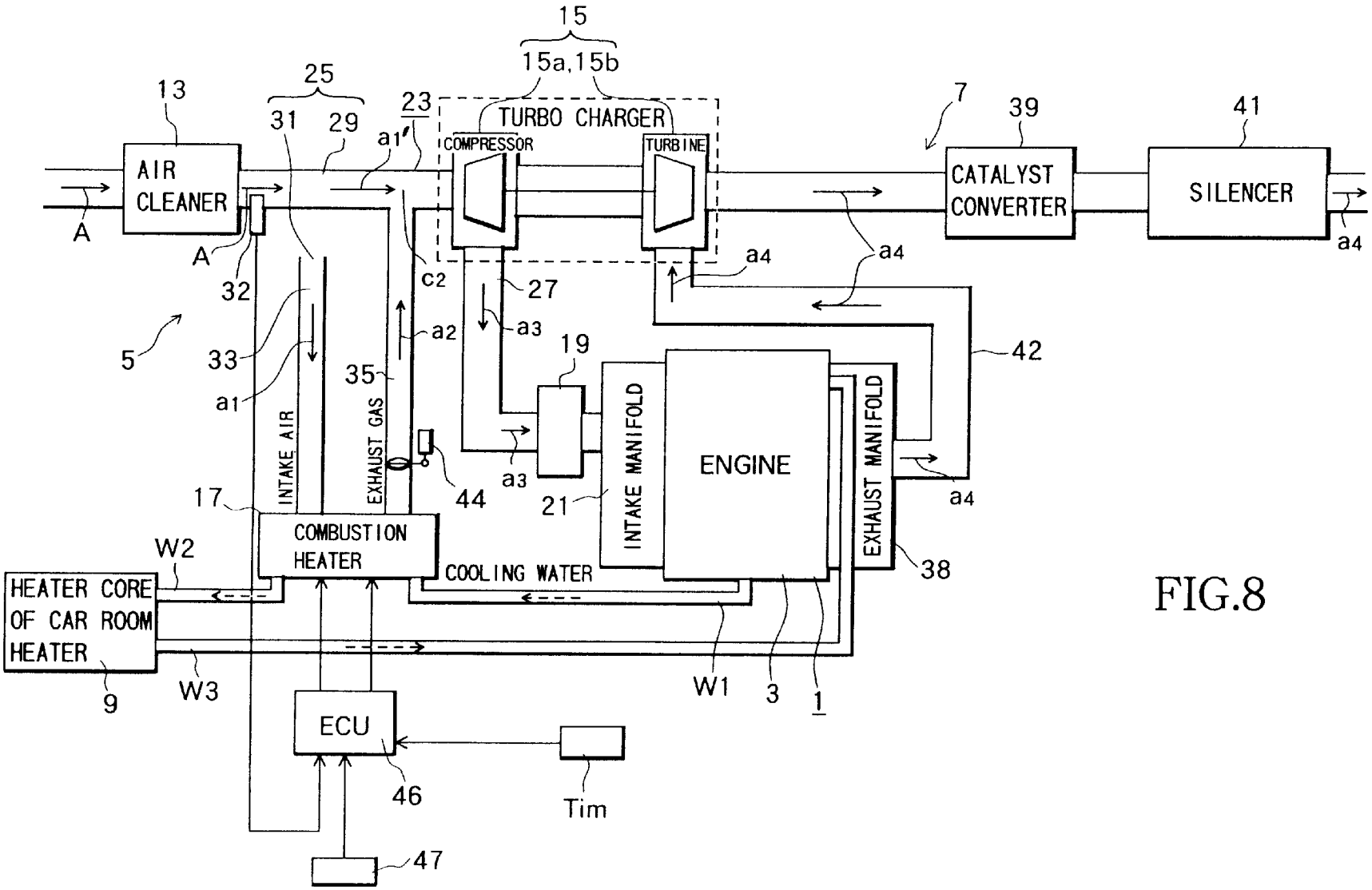
FIG. 8 is a schematic view showing a construction of the internal combustion engine having the combustion heater in a second embodiment of the present invention.
Figure 9:
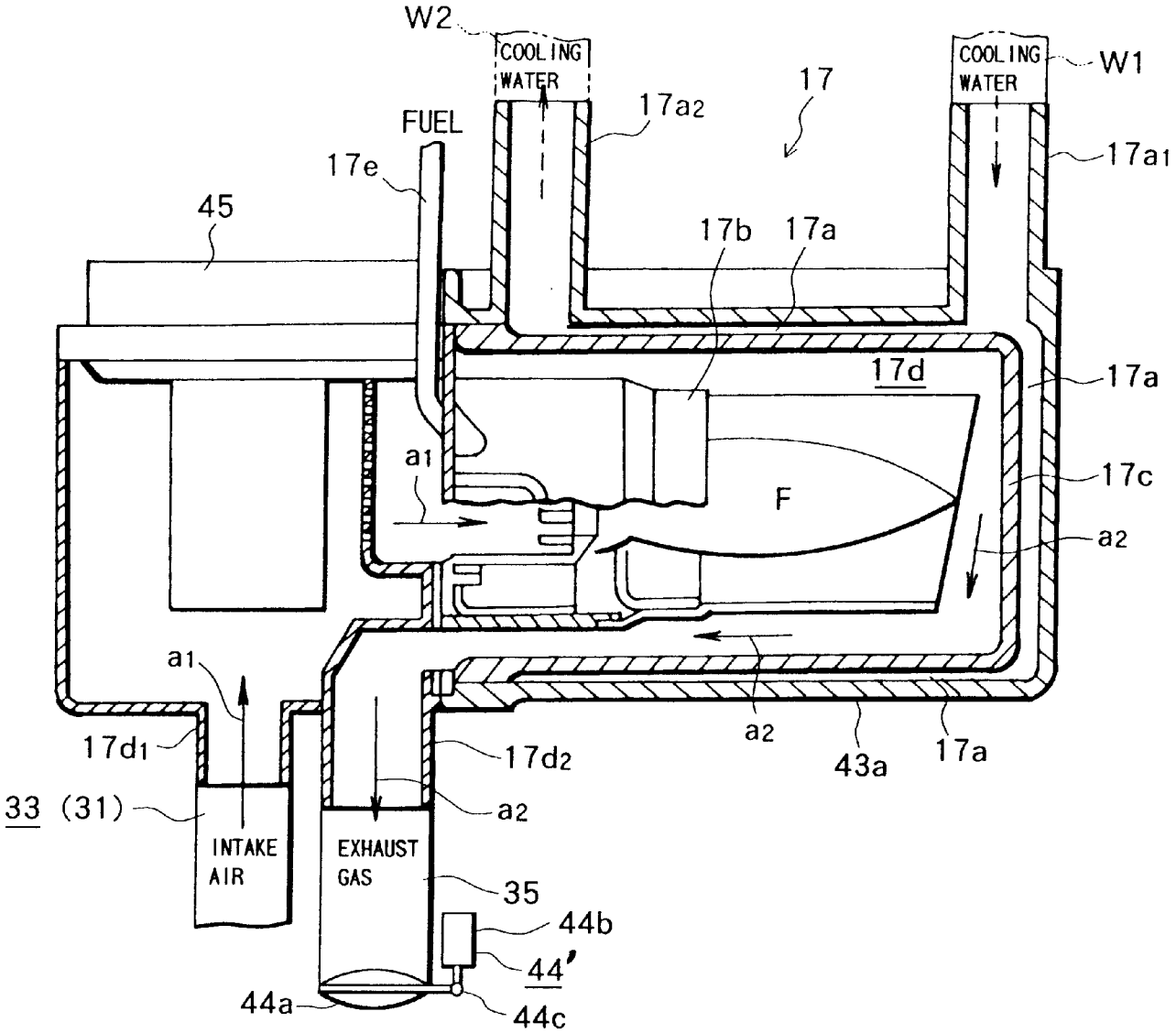
FIG. 9 is a schematic sectional view showing the combustion heater in the second embodiment of the present: invention.

The following four points are differences of the combustion heater 17 in the second embodiment from that in the first embodiment. First, as shown in FIG. 8, the combustion heater 17 has no communicating passageway 36 given in the first embodiment. Second, since there is no communicating passageway 36, the valve device 44 attached thereto is also not present here, but, instead, a valve device 44' is provided in the combustion gas discharge pipe 35. Third, a route for supplying the combustion heater 17 with the fresh air is different, and what is different as the fourth point is a content of the program of the operation control execution routine of the combustion heater 17. Hence, the discussion might be concentrated on only the different points from the first embodiment.

An air supply pipe 33' is, though corresponding to the air supply pipe 33 in the first embodiment, structured to take in the suction air not from the mainstream pipe 29 but directly from the atmospheric air. Therefore, the air flowing through the air supply pipe 33' becomes outside air A, and this outside air A turns out to be a combustion gas a2 through burning in the combustion heater 17, and flows to the combustion gas discharge pipe 35.

The valve device 44' in the second embodiment is attached to a portion, closer to the combustion heater 17, of the combustion gas discharge pipe 35, and is composed of substantially the same members as those of the valve device 44 in the first embodiment. Hence, the constructive members of the valve device 44' in the second embodiment are marked with the same numerals as those put on the constructive members of the valve device 44 in the first embodiment, and the repetitive explanations thereof are omitted. Further, the valve device 44' is substantially the same as the valve device 44, though different in terms of its installing place, serves to similarly control the flow quantity of the combustion gas flowing through the place where the valve device 44' is installed, and may therefore be called the flow quantity control mechanism.

Figure 10:
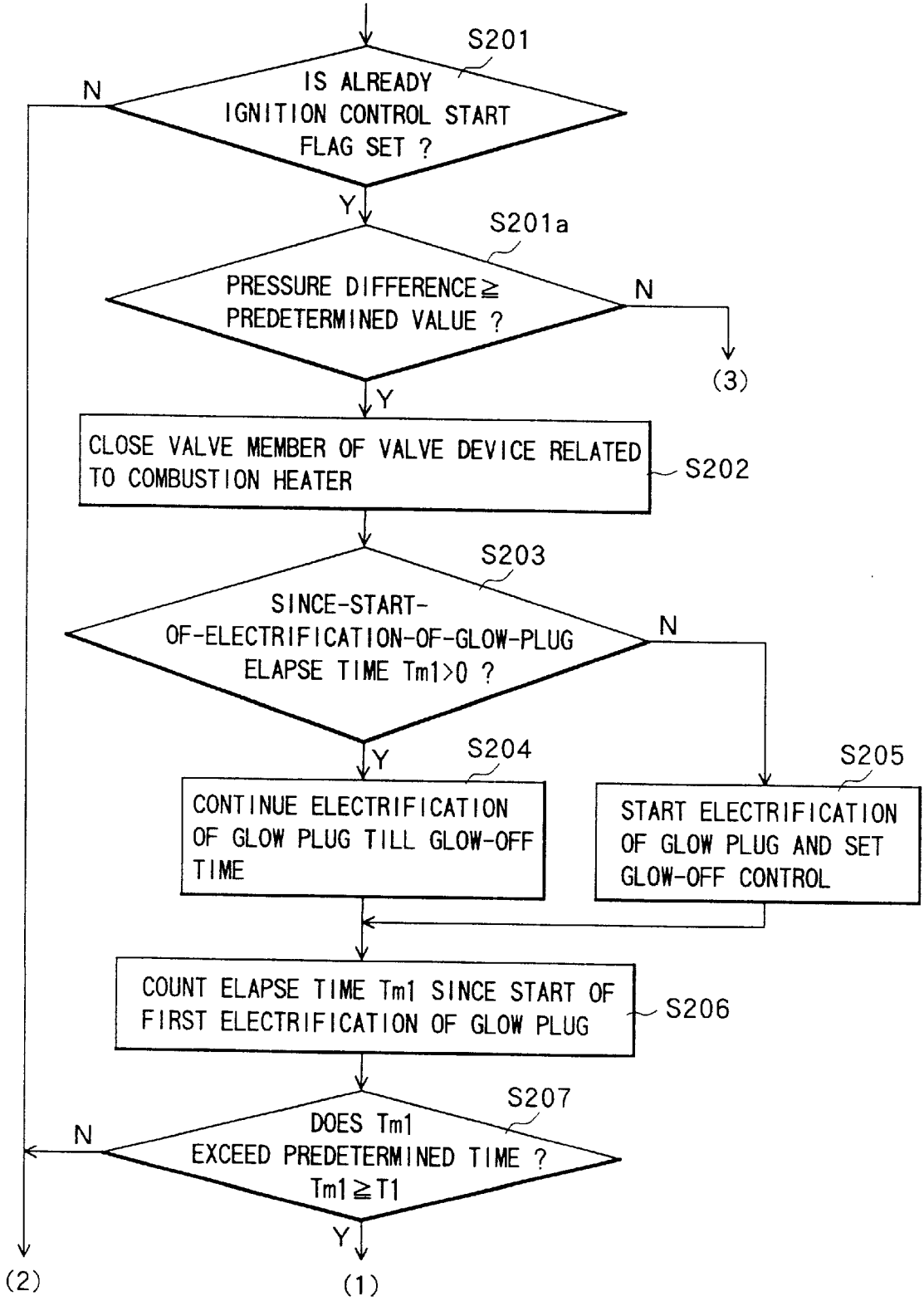
FIG. 10 is a diagram showing a part of a flowchart of an operation control execution routine of the combustion heater in the second embodiment of the present invention.
Figure 11:
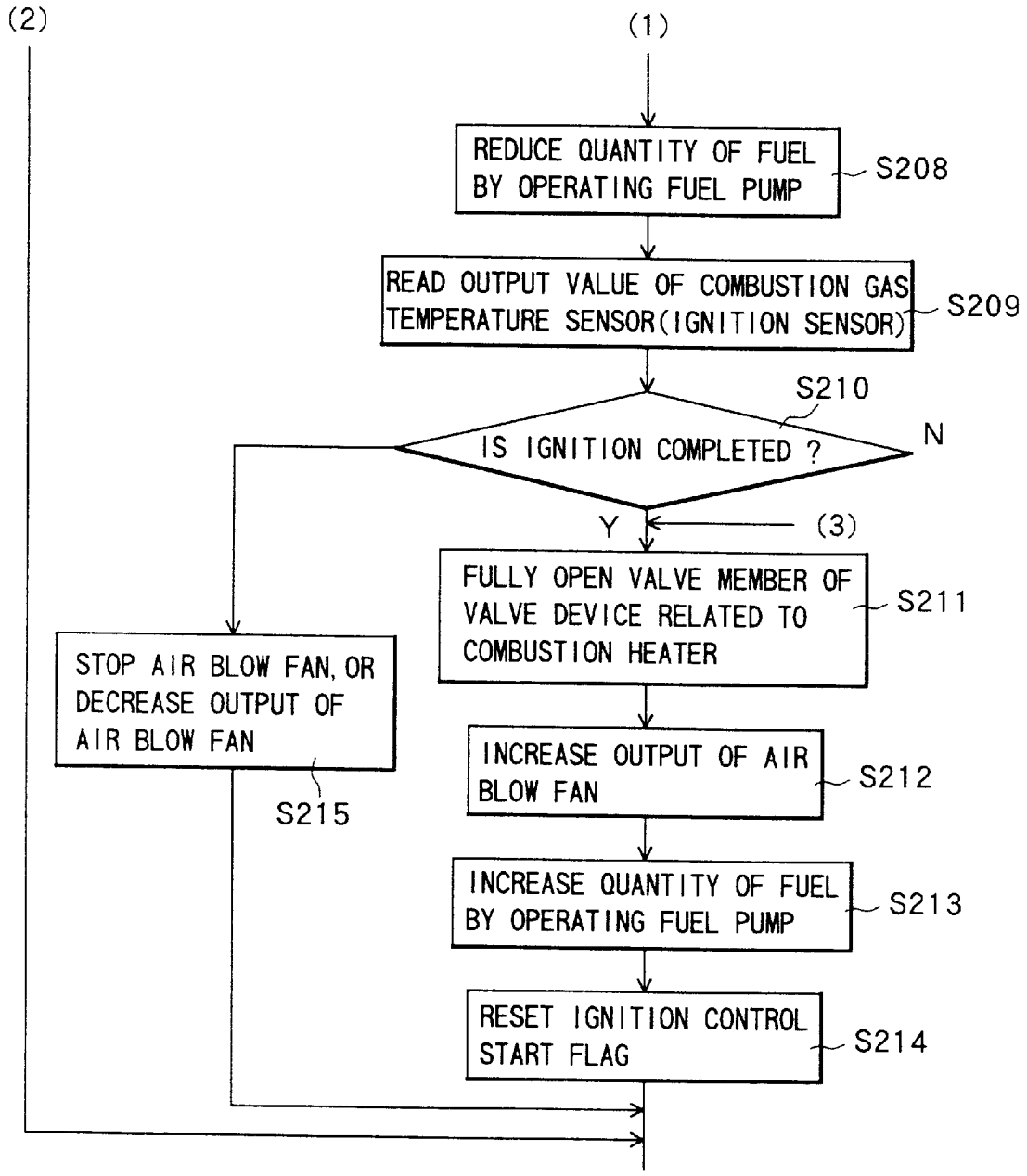
FIG. 11 is a diagram showing another part of the flowchart, continued from FIG. 10, of the operation control execution routine of the combustion heater in the second embodiment of the present invention.

Next, an operation control execution routine of the combustion heater 17 in the second embodiment will be explained referring to FIGS. 10 and 11.

A program of the operation control execution routine of the combustion heater 17 in the second embodiment consists of steps S201–S215 which will hereinafter be described. Further, S201–S208 excluding S201*a* and S202 correspond to and are substantially the same as S101–S108 excluding S101*a* and S102 of the program of the operation control execution routine of the combustion heater 17 in the first embodiment. The explanations of the corresponding steps (S201–S208 exclusive of S201*a* and S202) are therefore omitted, and the description is given with respect to S201*a*, S202 and S209 onward.

It is judged in S201*a* whether or not a differential pressure caused between the side supplied with the air and the side from which to discharge the combustion gas within the combustion chamber 17*d*, is over a predetermined value. The predetermined value given herein connotes a minimum value of the differential pressures large enough to produce an excessive air blow quantity in such a case that an air blow quantity produced within the combustion heater 17 due to the above differential pressure becomes excessive enough to make therefore the ignition in the combustion heater 17 impossible.

Further, the detection of the differential pressure involves the use of an unillustrated pressure sensor. Then, a detected value of the pressure sensor is converted into an electric signal, and this signal is transmitted to the ECU 11. The ECU 11, based on the electric signal transmitted thereto, makes a judgement in S201*a*.

If judged to be affirmative in S201*a*, the processing proceeds to next S202. Whereas if negated, the processing diverts to S211.

In S202, the valve member 44*a* of the valve device 44' of the combustion heater 17 is closed. With the valve member 44*a* closed, the flow of the combustion gas flowing through the combustion gas discharge pipe 35 is restrained, thereby decreasing the flow quantity of the combustion gas. Thereupon, the quantity of the combustion gas discharged from the combustion chamber 17*d* decreases, and hence, as a matter of course, the quantity of the air flowing within the combustion chamber 17*d* is also restricted. It is therefore feasible to prevent the production of the excessive strong air blow in the combustion chamber 17*d* of the combustion heater 17. Further, as described above, the valve device 44', when the glow plug 17*g* serving as the igniting device starts the ignition, in other words, if judged to be affirmative in S201, reduces the quantity of the combustion gas flowing through the combustion gas discharge pipe 35, and may therefore be conceived as a flow quantity decreasing device.

By contrast, in S211, the valve member 44*a* of the valve device 44' of the combustion heater 17 is fully opened, thus increasing the quantity of the combustion gas discharged from the combustion heater 17. Thereupon, the quantity of the combustion gas discharged from the combustion chamber 17*d* augments, and hence, naturally, there increases the quantity of the air flowing within the combustion chamber 17*d*. Therefore, based on the judgement in S201*a*, that is to say, corresponding to the differential pressure produced between the side of the air supply passageway 33 and the side of the combustion gas discharge passageway 35 in the combustion chamber 17*d*, the combustion gas discharge pipe 35 is opened and closed by operating the valve device 44'. As a result, the quantity of the air flowing within the combustion chamber 17*d* is controlled, and hence the valve device 44' and the respective steps S201*a*, S202 and S212 for controlling the operation of the valve device 44' may be called an air quantity control means. Note that since the three steps S201*a*, S202 and S212 are stored in the ROM of the ECU 11, and therefore, the valve device 44' and the ECU 11 may alternatively be called the air quantity control means. Hence, the valve device 44' is, it may be said, embraced by the air quantity control means.

When processing proceeds S209 via S201–S208, an output value of the combustion gas temperature sensor 17*h* is read in S209.

It is judged based on the output value in S209 whether or not the ignition is completed, i.e., whether or not the latent flame is produced. Whether or not the latent flame is produced depends upon a judgement about whether the output value given in S209 is smaller or larger than a specified predetermined value. With the confirmation that the latent flame is ensured, the processing proceeds to next S211. When judging that the latent flame is not ensured, the CPU advances to S215. Further, in the combustion heater 17 according to the present invention, when the latent flame is ensured, the latent flame produced in this step has a magnitude enough to enable it to surely grow into the flames.

In next S212, the quantity of air flowing within the combustion heater 17, i.e., in the combustion chamber 17*d* is increased by raising the output of the air blow fan 45. The reason for this is that the latent flame has already been produced at that stage, and therefore, even when the quantity of the air flowing in the combustion chamber 17*d* is increased by raising the output of the air blow fan 45, there is no possibility of extinguishing the latent flame.

In S213, a quantity of the liquefied fuel supplied to the fuel vaporizing unit 17*f* from the fuel supply pipe 17*e* is increased by operating the fuel pump. This is intended to grow the latent flame into the flames.

In S214, the ignition control start flag is reset in preparation for a next operation control execution of the combustion heater 17.

To get back to the discussion on S210, the negative judgement is made in S210, and, when proceeding to S215, the air blow fan 45 is stopped, or the output thereof is decreased. Thereafter, this routine is halted. This is because there is no necessity for enhancing the output of the air blow fan 45 with the latent flame being not yet produced.

The combustion heater 17 in the second embodiment described above has the valve device 44', provided in the combustion gas discharge pipe 35, for controlling the quantity of the air flowing through the combustion chamber 17*d*. The valve device 44' restricts the flow of the combustion gas through the combustion gas discharge pipe 35, whereby the quantity of the air flowing through the combustion chamber 17*d* can be also restricted.

Accordingly, at least when the combustion heater 17 starts the ignition, if the quantity of the air flowing through the combustion chamber 17*d* is reduced enough to produce the latent flame or further down to 0 (zero) by the restriction described above, there might be no possibility in which the wind with the momentum strong enough to make the ignition unable to be done occurs in the combustion chamber 17*d*.

Hence, because of no strong wind occurring in the combustion chamber 17*d*, the ignition in the combustion heater 17 can be certainly effected at one time. Moreover, it is feasible to prevent the emissions of the white smokes and of the disagreeable smell due to the generation of the unburned hydrocarbon.

Further, when the combustion heater 17 is not operated, the valve member 44*a* of the valve device 44' is shut off, whereby foreign matters such as mud and water etc can be prevented from permeating the combustion heater 17.

Note that what has been exemplified in the second embodiment is the configuration that the valve device 44' is provided in the combustion gas discharge pipe 35. The valve device 44' may be, however, provided in the air supply pipe 33, or in both of the combustion gas discharge pipe 35 and the air supply pipe 33. Namely, the valve device 44' is provided in at least either the air supply pipe 33 or the combustion gas discharge pipe 35, and controls the flow quantity of either the air flowing through the air supply pipe 33 or the combustion gas flowing through the combustion gas discharge pipe 35. Since, the valve device 44' is the constructive element of the air quantity control means, the air quantity control means is, it may be said, provided at least in either the air supply pipe or the combustion gas discharge pipe.

If the valve devices 44' are provided in both of the combustion gas discharge pipe 35 and the air supply pipe 33, the valve members 44*a* of the two valve devices 44', 44' are closed only when controlling the ignition, and an igniting property can be also enhanced by minimizing the differential pressure in the combustion chamber when in the ignition.

Further, the effect of preventing the permeation of the foreign matters into the combustion heater 17 can be further enhanced by shutting off the valve members 44*a* of the two valve devices 44', 44'.

<Third Embodiment>

A third embodiment will be described with reference to FIGS. 12–14.

The engine 1 serving as the internal combustion engine is classified as a diesel engine or a gasoline direct injection lean-burn engine. The engine 1 includes, as the whole structure thereof is schematically illustrated in FIG. 12, the engine body 3 equipped with the unillustrated water jacket containing the engine cooling water, the air intake device 5 for supplying inside a plurality of unillustrated cylinders of the engine body 3 with the air needed for combustion, the exhaust device 7 for discharging into the atmospheric air an exhaust gas emitted from the cylinders after burning in the combustion chamber the air-fuel mixture composed of the air supplied to the cylinders via the air intake device 5 and an engine fuel supplied by injection into the cylinders, an exhaust gas recirculation (EGR) device 8 fcr restraining an occurrence of nitrogen oxide within the cylinders by recirculating the exhaust gas toward the air intake device 5 from the exhaust device 7, a combustion heater 91 for burning the fuel separately from the engine 1 and raising temperatures of the engine related elements with the heat of the combustion gas produced when burned, a heater core 10 of a car-room heater as an intra car room heating device for raising a temperature in the room of the vehicle mounted with the engine, and an ECU 11 defined an engine controller for controlling the whole engine.

The air intake device 5 has an intake pipe (an intake passageway) 14 starting with the air cleaner 13 for filtering the outside air and terminating with an unillustrated intake port of the engine body 3.

Disposed in sequence along the intake pipe 14 from the air cleaner 13 down to the intake port are the compressor 15*a* of the turbo charger 15 as a supercharger for raising a pressure of the suction air in the intake pipe 14, the inter cooler 19 for cooling a raised temperature of the suction air due to compression heat evolved when operating the compressor 15*a*, and an intake manifold 22 classified as a suction branch pipe.

A suction air throttle valve 51 for controlling a quantity of the suction air flowing through the intake pipe 14, is provided between the inter cooler 19 and the intake manifold 22. The combustion heater 91 is fitted to a portion, between the inter cooler 19 and the suction air throttle valve 51, of the intake pipe 14.

The exhaust device 7 includes the exhaust pipe 42 structurally starting with an unillustrated exhaust port of the engine body 3 and terminating with an unillustrated silencer.

From the exhaust port down to the silencer, along the exhaust pipe 42, there are disposed in sequence an exhaust manifold 28 as an exhaust gas collecting pipe, the turbine 15*b* of the turbo charger 15 and the catalyst converter 39 defined as the exhaust gas purifying device.

What can be exemplified as a catalyst contained in the catalyst converter 39 may be the selective reduction type NOx catalyst, then occlusion reducing type NOx catalyst, or the DPF bearing the oxide catalyst.

The EGR device 8 includes an EGR passageway 81, bypassed from the engine body 3, through which to connect the intake pipe 14 to the exhaust pipe 42 and flow the exhaust gas from the exhaust port back to the intake side, and an EGR valve 30 for controlling a quantity of the exhaust gas flowing through the EGR passageway 81.

The combustion heater 91 raises a temperature of the suction air flowing through the intake device 5 by introducing into the intake pipe 14 the combustion gas generated by burning the same fuel as the fuel used in the engine 1 and utilizing the heat held by the combustion gas.

The intake air, of which the temperature has been raised by the combustion heater 91, flows in a state of containing the combustion gas through the intake pipe 14 toward the cylinders.

Further, the combustion heater 91 warms the engine cooling water with the heat of the combustion gas, and the warmed engine cooling water is supplied to places requiring the rise in temperature such as the heater core 10 and the engine body 3 etc, thus increasing temperatures of the necessary-for-raising-temperature places (of which illustrations are limited to only the heater core 10 and the engine body 3 in the drawings).

Then, for supplying the necessary-for-raising-temperature places with the engine cooling water warmed by the combustion heater 91, the engine 1 is provided with a thermal medium circulation passageway W through which the engine cooling water warmed by the combustion heater 91 is supplied by the unillustrated engine water pump to the necessary-for-raising-temperature places.

The thermal medium circulation passageway W includes a water conduit W1 through which to connect the engine body 1 to the combustion heater 91 and guide the engine cooing water to the combustion heater 91 from the water jacket of the engine body 3, a water conduit W2 for guiding the engine cooling water warmed by the combustion heater 91 to the heater core 10, and a water conduit W3 for returning the engine cooling water flowing out of the heater core 10 to the water jacket of the engine body 3.

Further, a motor-operated water pump 50 is provided in the water conduit W1, and operates to accelerate the circulation of the engine cooling water through within the thermal medium circulation passageway W. Alternatively, the motor-operated water pump 50 circulates the engine cooling water, thereby enabling the heater core 10 to operate even during the halt of the engine.

Herein, a specific construction of the combustion heater 91 is explained with reference to FIGS. 12–14.

The combustion heater 91 internally has a heater inside cooling water passageway 37 communicating with the water conduits W1, W2 and thus serving as a part of the thermal medium circulation passageway W.

The heater inside cooling water passageway 37 includes a cooling water intake port 37*a* connected to the water conduit W1 and a cooling water discharge port 37*b* connected to the water conduit W2. Further, the heater inside cooling water passageway 37 is formed extending round the combustion chamber of the combustion heater 91.

The combustion chamber 48 is constructed of a combustion cylinder 40 as a combustion source from which the flames F are produced, and a cup-shaped partition wall 40a for preventing the flames F from leaking outside by covering the combustion cylinder 40.

The partition wall 40a is covered with the combustion cylinder 40, whereby the combustion chamber 48 is defined inside the partition wall 40*a*. Then, the partition wall 40*a* is also covered with an outer wall 43 of the combustion heater 91.

Furthermore, an annular spacing is formed between the partition wall 40*a* and the outer wall 43, and functions as the heater inside cooling water passageway 37. The engine cooling water flows through within the heater inside cooling water passageway 37, during which the engine cooling water receives the heat from the combustion chamber 48. That is, the engine cooling water exchanges the heat with the high heat combustion gas in the combustion chamber 48, and thus raises its temperature.

Further, the combustion chamber 48 is formed with air flow ports through which the air flows in and out the combustion chamber 48. To be more specific, the combustion chamber 48 has an air supply port 62 through which the air for combustion flows in the combustion chamber 48, and combustion gas discharge ports 63, 65 through which the combustion gas is discharged out of the combustion chamber 48. Then, in the combustion chamber 48, the air supply port 62 is positioned on the opposite side to the side on which the flames F are emitted from the combustion cylinder 40. The combustion gas discharge port 63 is provided in the vicinity of the proximal end of the combustion cylinder 40 within the combustion chamber 48.

Further, the combustion gas discharge port 65 is provided facing to the flames F and penetrating the partition wall 40*a* and the outer wall 43 as well on the side where the flames F are emitted from the combustion cylinder 40.

The combustion gas discharge ports 63, 65 are connected to each other via a parallel connecting pipe 74 extending in parallel with a longitudinal direction of the combustion heater 91. Then, the air supply port 62 and the combustion gas discharge ports 63, 65 each communicate with the intake pipe 14.

More specifically, the air supply port 62 communicates with the intake pipe 14 via an air supply pipe (air supply passageway) 71 for introducing the suction air, of which the pressure is increased by the turbo charger 15, as the air for combustion into the combustion heater 91 from the intake pipe 14.

Moreover, the combustion gas discharge port 63 communicates with the intake pipe 14 via the parallel connecting pipe 74 and a combustion gas discharge pipe 73, confluents with this parallel connecting pipe 74 and extending to the intake pipe 14, for discharging the combustion gas to the intake pipe 14. Further, the combustion gas discharge port 65 communicates with the intake pipe 14 via only the combustion gas discharge pipe 73.

Note that the connecting point C1 of the air supply pipe 71 to the intake pipe 14 is in close proximity to the connecting point C2 of the combustion gas discharge pipe 73 to the intake pipe 14, and the connecting point C2 is disposed more downstream than C1. In other words, the connecting point C2 may be a point of the intake pipe 14, which is disposed more downstream than the connecting point C1 of the air supply pipe 71 to the intake pipe 14.

Further, both of the connecting points C1, C2 are located upstream of the suction air throttle valve 51 but downstream of the inter cooler 19.

The combustion gas discharge pipe 73 has midways a valve device 78 located upstream of the combustion gas discharge pipe 73, and a three-way switching valve 86 located downstream of the combustion gas discharge pipe 73.

The valve device 78 located upstream serves to connect the combustion gas discharge pipe 73 to the combustion gas heater 91 through the valve device 78, and operates to control the opening/closing of the combustion gas discharge port 65.

Moreover, the valve device 78 has a valve chamber 79 accommodating inside a valve member 80 for opening and closing the combustion gas discharge port 65. The valve chamber 79 includes two openings 79*a*, 79*b* communicating with the combustion gas discharge port 65 and the combustion gas discharge pipe 73, respectively.

Then, the valve device 78 has an actuator 82 for driving the valve member 80. When the valve member 80 is operated by this actuator 82, an opening 79*a* is opened and closed, thereby opening and closing the combustion gas discharge port 65.

Further, the three-way switching valve 86 located downstream of the combustion gas discharge pipe 73 functions as a combustion gas route switching device for switching over a route of the combustion gas. Then, the three-way switching valve 86 is formed inside with three ports, i.e., a first port kept open at all times, and second and third ports which are opened and closed by the operation of the three-way switching valve 86.

The first port is so connected to the combustion gas discharge pipe 73 as to lead to the valve device 78.

Further, the second port is so connected to the combustion gas discharge pipe 73 as to lead to the intake pipe 14. Then, the third port is connected to the exhaust pipe 42 via a branch pipe 84 defined as a bypass pipe which bypasses the engine body 3 (i.e., extends round the cylinders of the engine body 3) and is connected to a connecting point C3 at a portion, disposed upstream in the vicinity of the catalyst converter 39, of the exhaust pipe 42. With this arrangement, the third port leads to the exhaust pipe 42. Note that the connecting point C3 may be conceived as a point, disposed more downstream than the connecting point C1 of the air supply passageway 71 to the intake pipe 14, of this intake pipe 14.

The three-way switching valve 86 selectively switches over the flow of the combustion gas toward the intake pipe 14 or the connecting point C3 existing upstream in the vicinity of the catalyst converter 39. Namely, if the combustion gas is made to flow toward the intake pipe 14, the three-way switching valve 86 operates to open the second port but close the third port. If the combustion gas is made to flow toward the connecting point C3, the three-way switching valve 86 operates to open the third port but close the second port.

Hence, when the combustion gas flows toward the intake pipe 14, the combustion gas entering the three-way switching valve 86 via the first port flows to the intake pipe 14 via the second port. Further, when the combustion gas flows toward the exhaust pipe 42, the combustion gas entering the three-way switching valve 86 via the first port flows through the third port, and thereafter flows to the connecting point C, disposed upstream in the vicinity of the catalyst converter 39, of the exhaust pipe 42 through the branch pipe 84.

Note that the case where the three-way switching valve 86 makes the combustion gas flow toward the intake pipe 14 implies a case where the combustion heater 91 is normally used such as working the car room heater during the operation of the engine 1, and the case where the three-way switching valve 86 makes the combustion gas flow toward the connecting point C3 of the exhaust pipe 42 implies a case such as speeding up the warm-up of the catalyst converter 39, executing a process for recovering the catalyst converter 39 from Sox poisoning or SOF poisoning (which is hereinafter termed a poisoning recovery process), and executing a reducing process with respect to the catalyst converter 39.

Figure 14:
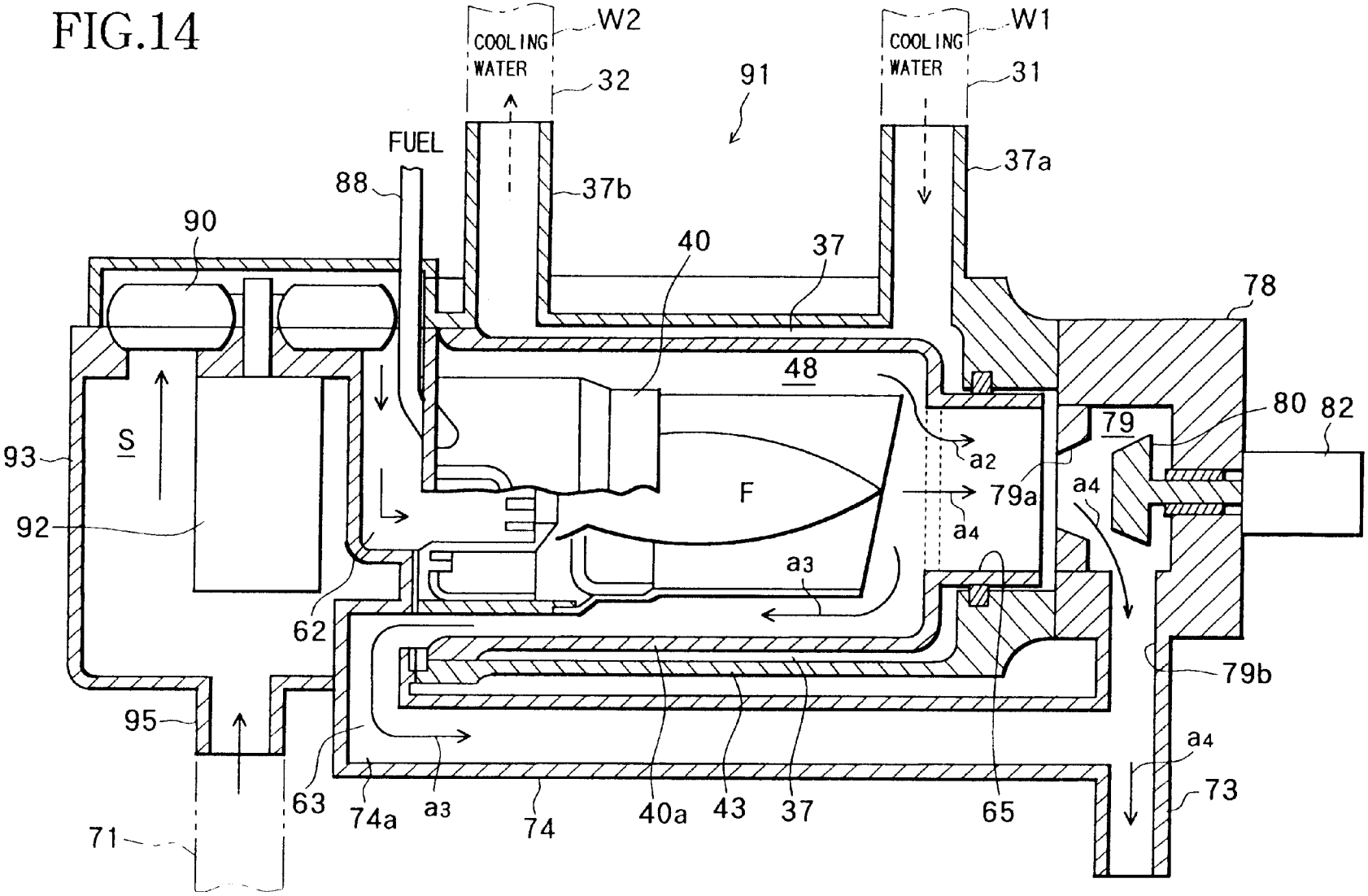
FIG. 14 is a sectional view showing another operating state of the combustion heater shown in FIG. 13.

On the other hand, a fuel supply pipe 88 for introducing the fuel from outside to the combustion cylinder 40, is as shown in FIG. 14 connected to the combustion cylinder 40. The fuel supply pipe 88 is connected to a fuel pump 89, wherein the fuel is, upon undergoing a pump pressure of the fuel pump 89, jetted out to the combustion cylinder 40 from the fuel supply pipe 88. Further, the combustion cylinder 40 has a glow plug (not shown) for igniting the fuel supplied through the fuel supply pipe 88.

A housing 93 embracing an air blow rotational fan (an air blow device) 90, including a motor 92 serving as a drive source, for supplying the combustion air introduced from the air supply passageway 71 into the combustion chamber 48, is secured also to the outer wall 43 of the combustion heater 91 on the side opposite to the side where the flames F are emitted with respect to the combustion cylinder 40.

The housing 93 has an air inlet 95 for taking in the air from the outside, to which the air supply pipe 71 is connected. Further, the housing 93 includes its internal space S communicating with the air supply port 62. Hence, the air supply port 62 is connected indirectly via the internal space S to the air supply pipe 71.

Then, when the rotational fan is rotated by the motor 92, the air is introduced into the housing 93 from the intake pipe 14 via the air supply pipe 71. The air introduced into the housing 93 is supplied to the combustion cylinder 40 via the internal space S from the air supply port 62. The combustion gas produced after the fuel has been burned with the air for combustion, and, thereafter introduced to the intake pipe 14 or the exhaust pipe 42 via the combustion gas discharge pipe 73 from the combustion heater 91.

A quantity of the combustion gas introduced to the intake pipe or the exhaust pipe 42, i.e., the quantity of the air introduced into the combustion cylinder 40, is determined by the number of rotations of the rotational fan 90. Namely, the air quantity becomes larger with the greater number of rotations of the fan, and the combustion cylinder 40 is supplied with the air of which the quantity is proportional to the number of rotations of the fan. Then, the air turns out to be the combustion gas after being burned and is discharged out of the combustion heater 91. Hence, the rotational fan 90 may be called an air supply device. The number of rotations of the rotational fan 90 is determined by the ECU 11 controlling the motor 92. That is to say, the ECU 11 controls the rotational fan 90, thereby controlling the quantity of the air flowing through the combustion heater. The ECU 11 may therefore be called an air quantity control means.

Figure 12:
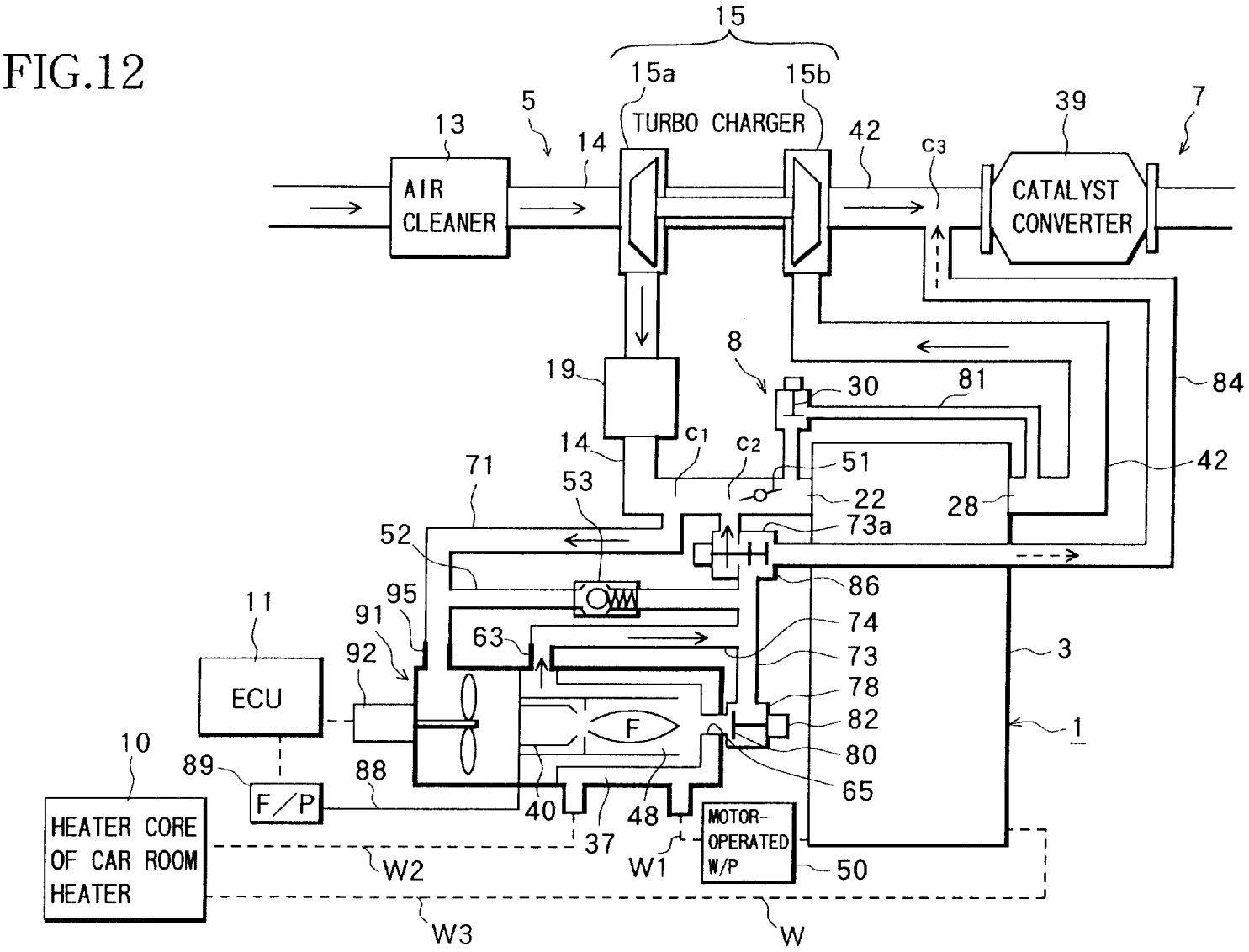
FIG. 12 is a schematic view showing a construction of the internal combustion engine having the combustion heater in a third embodiment of the present invention.

Furthermore, as illustrated in FIG. 12, the air supply pipe 71 is connected via a heater bypass pipe (a communicating passageway) 52 to a point, located more downstream than the connecting point of the parallel connecting pipe 74 to the combustion gas discharge pipe 73 but more upstream than the three-way switching valve 86, of the combustion gas discharge pipe 73.

The heater bypass pipe 52 has a check valve 53 which permits the air to flow to the combustion gas discharge pipe 73 from the air supply pipe 71, and hinders the air to flow to the air supply pipe 71 from the combustion gas discharge pipe 73, in other words, sets the flow of the fluid in only one direct and automatically shuts off the passageway for the back flow.

A valve opening pressure of this check valve 53 is set to a predetermined value. Then, if a pressure of the air (viz., the air pressure in the air supply pipe 71) on the upstream-side of a fitting position of the check valve 53 to the heater bypass pipe 52, becomes equal to or larger by the predetermined value than a pressure (viz., a combustion gas pressure in the combustion gas discharge pipe 73) on the downstream-side, i.e., if a difference between the above two pressures becomes equal to or larger than the predetermined value, the check valve 53 opens and, if not over the predetermined value, closes. When the check valve 53 opens, the air flows through the heater bypass pipe 52 toward the combustion gas discharge pipe ,73 from the air supply pipe 71. Whereas if the check valve 53 does not open, as a matter of course, the air does not flow.

Hence, the predetermined value is, it may be said, a yardstick value for determining whether the check valve 53 as a valve mechanism should be opened or closed. In other words, there becomes excessive the quantity of the air blow caused within the combustion heater 91 due to the differential pressure between the air pressure on the upstream-side of the check valve 53 and the combustion gas pressure on the downstream-side of the check valve 53. Therefore, the predetermined value implies, in the case where the ignition cannot be effected, the minimum value of the differential pressures which may produce the excessive air blow quantity. Note that the predetermined value might differ depending on the types of the combustion heaters.

Hence, the check valve 53 is provided in the heater bypass pipe 52 and may be conceived as an air quantity control device for regulating the quantity of the air flowing within the combustion chamber 48 by controlling the flow quantity of the air flowing through the heater bypass pipe 52 if the pressure in the air supply pipe 71 becomes equal to or larger by the predetermined value than the pressure in the combustion gas discharge pipe 73, viz., if the differential pressure therebetween comes a value over the predetermined value. In other words, the check valve is classified as the air quantity control device for controlling the quantity of the air flowing within the combustion chamber in accordance with the differential pressure between the differential pressure caused between the side of the air supply pipe 71 and the side of the combustion gas discharge pipe 73 in the combustion chamber 48.

The ECU 11 is constructed of the central processing unit (CPU), the read-only memory (ROM), the random access memory (RAM), and input interface circuit, and an output interface circuit, which are mutually connected through a bidirectional bus.

Then, various sensors are connected via electric wires to the input interface circuit. Connected via electric wires to the output interface circuit are the EGR valve 30, the motor-operated water pump 50, the glow plug of the combustion cylinder 40, the valve device 78, the three-way switching valve 86, the fuel pump 89 and the motor 92.

What can be exemplified as the sensors connected to the input interface circuit may be an airflow meter attached to the intake pipe 14, a catalyst temperature sensor attached to the catalyst converter 39, a water temperature sensor for detecting a temperature of the cooling water contained in the water jacket, an accelerator position sensor fitted to an accelerator pedal or an accelerator lever which operates interlocking with the accelerator pedal, an ignition switch and a starter switch etc. These sensors output electric signals corresponding to detected values and transmit these signals to the ECU 11.

The illustrations of the various sensors exemplified herein are omitted.

The ECU 11 judges the operation state of the engine 1 based on the values of output signals from the various sensors given above. Then, the ECU 11, based on a result of the judgement, controls the fuel injection and the operation of the combustion heater 91 as well.

Figure 13:
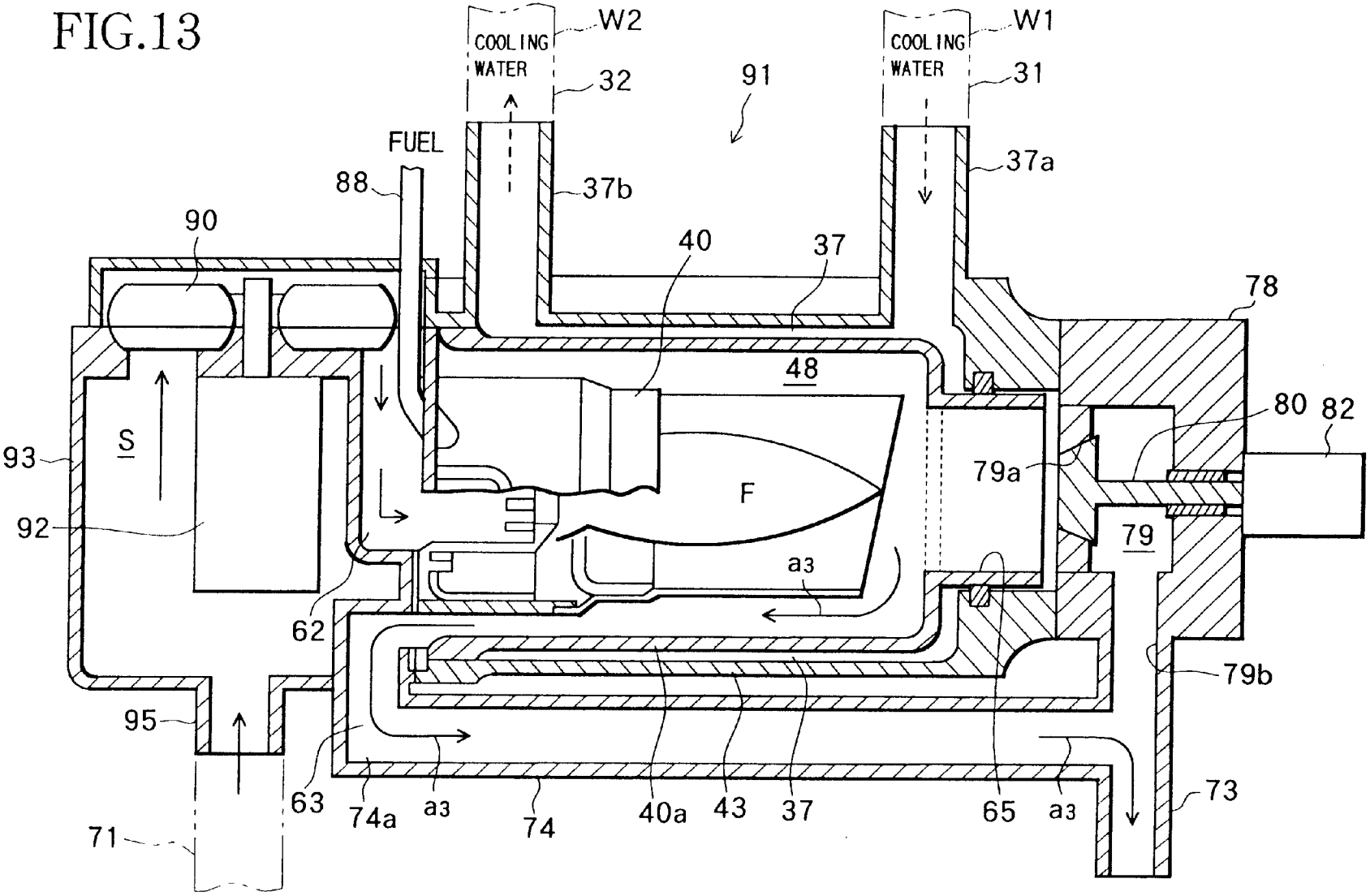
FIG. 13 is a sectional view showing an operating state of another combustion heater in the embodiment of the present invention.

In the thus constructed combustion heater 91, as explained above, with the operations of the valve device 78, as shown in FIG. 13, the valve member 80 is closed and the combustion gas discharge port 65 is shut off, and further the branch pipe 84 is closed by controlling the three-way valve 86 in the normal use such as working the car room heater during the operation of the engine 1.

Then, with the rotations of the rotational fan 90, some proportion of the suction air flowing through the intake pipe 14 is introduced into the combustion cylinder 40 of the combustion heater 91 via the air supply pipe 71. Further, the fuel is sucked up from an unillustrated fuel tank by the fuel pump 89, and jetted out to the combustion cylinder 40 from the fuel supply pipe 88.

Moreover, the engine cooling water in the water jacket of the engine 1 is supplied by pressurization to the heater inside cooling water passageway 37 of the combustion heater 91 by operating the engine water pump and the motor-operated water pump 50.

In addition, the air-fuel mixture composed of the intake air supplied to the combustion cylinder 40 by the rotational fan 90 and the fuel supplied to the combustion cylinder via the fuel supply pipe 88, is ignited by the glow plug, and the flames F are produced within the combustion cylinder 40, thus starting the combustion.

The high-temperature combustion gas evolved by the combustion flows along an air flow generated by rotating the rotational fan 90 through the combustion chamber 48 toward the combustion gas discharge port 63. Thereafter, the combustion gas is discharged to the parallel connecting pipe 74 connected to the combustion gas discharge port 63 and further discharged to the combustion gas discharge pipe 73 (see a solid-line arrow a3 in FIG. 13).

On the other hand, the engine cooling water supplied by pressurization to the heater inside cooling water passageway 37 of the combustion heater 91 via the water conduit W1 from the water jacket, flows round through the heater inside cooling water passageway 37 along the entire outer surface of the partition wall 40*a*, during which the engine cooling water absorbs the heat held by the combustion gas. Viz., the thermal exchange is effected between the combustion gas and the engine cooling water over the entire area in the heater inside cooling water passageway 37.

Then, the engine cooling water having absorbed the heat of the combustion gas, is introduced into the heater core 10 via the water conduit W2 from the heater inside cooling water passageway 37. The engine cooling water flowing out of the heater core 10 is discharged to the water conduit W3 and flows back to the water jacket of the engine body 3 (see the thermal medium circulation passageway W indicated by the broken line in FIG. 12 as well as by the broken-line arrow in FIG. 13). Note that in the heater core 10, some of the heat held by the engine cooling water is exchanged with the air for warming, thereby raising the temperature of the air for warming. As a result, the hot air blows out in the room of the vehicle.

The engine cooling water assuming the high heat by being warmed by the combustion heater 91 in the way described above, flows to the water jacket of the engine body 3 and to the heater core 10. As a consequence, there are speeded up the warm-up of the internal combustion engine and enhanced the starting property thereof, and also enhanced the performance of the heater core 10.

Further, the combustion gas discharged to the combustion gas discharge pipe 73 flows through the three-way switching valve 86 and returns to the intake pipe 14, and is supplied to the combustion chamber of the engine body 3, together with the suction air which has not been introduced into the combustion heater 91, wherein the combustion gas is mixed with the fuel injected from the unillustrated fuel injection valve and an air-fuel mixture formed therein is used for combustion of the engine (see the solid-line arrow in FIG. 12).

On this occasion, the combustion chamber of the engine body 3 is supplied with the combustion gas, of which a temperature has been decreased after the thermal exchange with the cooling water in the combustion heater 91, and hence there is prevented a thermal damage to the engine 1 due to long-time suctioning of the high-temperature suction air.

Furthermore, a small amount of combustion gas exhibiting a comparatively high $CO_2$ concentration is supplied to the combustion chamber of the engine body 3, thereby making it feasible to reduce at a high efficiency a quantity of NOx produced by the combustion in the combustion chamber of the engine body 3.

Further, the combustion gas discharged from the combustion heater 91 is re-burned in the combustion chamber of the engine body 3, and besides the exhaust gas discharged from the combustion chamber of the engine body 3 is purified by the catalyst converter 39. Accordingly, the combustion gas discharged from the combustion heater 91 can be released outside after being purified.

Moreover, the combustion gas discharged from the combustion heater 91 flows to the point in the intake pipe 14, the point which is located downstream of the inter cooler 19 and therefore flows to neither the compressor 15*a* of the turbo charger 15 nor the inter cooler 19, whereby the thermal damages to these intake system structures are prevented.

In terms of a relationship of loading property when loading the engine 1 into the vehicle, in some cases, there might be no alternative but to enlarge a fitting interval between the connecting point C1 of the air supply pipe 71 to the intake pipe 14 and the connecting point C2 of the combustion gas discharge pipe 73 to the intake pipe 14, or but to change a configuration of the portion between the connecting points C1 and C2 of the intake pipe 14.

Such a configuration being thus given, the differential pressure between the connecting points C1 and C2 might easily increase and, if a supercharging pressure of the turbo charger 15 rises, becomes by far larger.

If the differential pressure between the connecting points C1 and C2 increases, the air flows toward the combustion gas discharge port 63 from an intake port 95 in the combustion heater 91 because of the differential pressure if neither the heater bypass pipe 52 nor the check valve 53 is provided. With the result that a larger amount of air than an air quantity normally given by the rotations of the rotational fan 90 flows through the combustion cylinder 40. Then, this excessive air flow might induce problems, wherein the igniting property of the combustion heater 91 declines, a lean accidental fire happens when an air/fuel ratio of the air-fuel mixture in the combustion cylinder 40 becomes excessively lean during the operation of the combustion heater 91, the flames are destabilized when the air/fuel ratio of the air-fuel mixture in the combustion cylinder 40 becomes lean, and the combustion becomes unstable.

The combustion heater 91 is, however, provided with the heater bypass pipe 52 and the check valve 53, and, with this construction, if the differential pressure between the upstream-side and the downstream-side of the check valve 53 (which may be conceived substantially the same as the differential pressure between the air intake port 95 and the combustion gas discharge port 63) exceeds a valve opening pressure of the check valve 53, viz., if the pressure in the air supply pipe 71 is equal to or larger by the predetermined value than the pressure in the combustion gas discharge pipe 73, the check valve 53 opens, whereby the intake air flowing through the air supply pipe 71 comes to flow through the heater bypass pipe 52 toward the combustion gas discharge pipe 73. As a result, the differential pressure between the air intake port 95 and the combustion gas discharge port 63 decreases, whereby the excessive air can be prevented from flowing to the combustion cylinder 40 of the combustion heater 91. That is, the excessive air flow can be reduced enough to enable the combustion heater to certainly execute the ignition, or down to 0 (zero). As a consequence, it is possible to ensure both of the preferable igniting property of the combustion heater 91 and the stable combustion, and also prevent the lean accidental fire.

Note that the check valve 53 closes when the differential pressure between the upstream-side and the downstream side thereof is smaller than the valve opening pressure. Therefore, in this case, the combustion gas discharged from the combustion heater 91 and flowing through the combustion gas discharge pipe 73 is hindered from flowing through the heater bypass pipe 52 toward the air supply pipe 71.

Next, if there arises a necessity for raising the temperature of the catalyst converter 39 when executing the poisoning recovery process described above and reducing process with respect to the catalyst converter 39, as shown in FIG. 14, the valve device 78 operates to open an opening 79*a* by the valve member 80, thereby letting the combustion gas discharge port 65 open.

Further, the intake pipe 14 is shut off by closing the second port of the three-way switching valve 86 while controlling the three-way switching valve 86. At this time, the third port is simultaneously opened, thereby letting the branch pipe 84 open.

Subsequently, the rotational fan 90 is rotated by the motor 92, and some of the suction air flowing inside the intake pipe 14 is thereby supplied to the combustion cylinder 40 of the combustion heater 91. Further, the fuel pump 89 sucks up the fuel from within the fuel tank, and the sucked fuel is supplied to the combustion cylinder 40 via the fuel supply pipe 88.

Then, the glow plug of the combustion cylinder 40 is electrified, and the air-fuel mixture composed of the suction air supplied by the rotational fan 90 and the fuel supplied from the fuel supply pipe 88, is burned in the combustion cylinder 40.

The high-temperature combustion gas evolved by this combustion flows along the air flow generated with the rotations of the rotational fan 90 through the combustion chamber 48 toward the combustion gas discharge port 65. Then, a large proportion of the combustion gas flows through the combustion gas discharge port 65 and further through the opening 79*a* of the valve device 78, and is discharged to the combustion gas discharge pipe 73 (see the solid-line arrow a4 in FIG. 14).

In contrast with this, there becomes minute the quantity of the combustion gas flowing to the combustion gas discharge pipe 73 via the parallel connecting pipe 74 from the combustion gas discharge port 63. The reason why minute is that a loss coefficient of a friction loss of this route is larger than a loss coefficient of the friction loss of a route such as the combustion gas discharge port 65→the opening 79*a*→the combustion gas discharge pipe 73.

Herein, the combustion gas flowing via the combustion gas discharge port 63 is cooled off by the thermal exchange with the engine cooling water, whereas the combustion gas flowing via the combustion gas discharge port 65 undergoes almost no thermal exchange with the engine cooling water and is therefore by far higher in temperature than the combustion gas discharged from the combustion gas discharge port 63.

Then, the high-temperature combustion gas discharged via the combustion gas discharge port 65 to the combustion gas discharge pipe 73, arrives at the three-way switching valve 86. In the three-way switching valve 86, as described above, the second port is closed, whereas the third port remains open, so that the combustion gas does not flow toward the intake pipe 14 and diverges via the branch pipe 84 to the connecting point C3, disposed upstream of the catalyst converter 39, of the exhaust pipe 42 (see the broken-line arrow in FIG. 12). Note that the combustion gas discharge passageway in the third embodiment is constructed of the portion, extending between the valve device 78 and the three-way switching valve 86, of the combustion gas discharge pipe 73, and of the branch pipe 84.

Accordingly, the connecting point C3 to the exhaust pipe 42 is supplied with the high-temperature combustion gas discharged from the combustion gas discharge port 65, whereby the temperature of the catalyst converter 39 can be raised at an early stage.

When the engine 1 is on its operation, the exhaust gas pressure at a portion, disposed upstream of the catalyst converter 39, of the exhaust pipe 42, is normally higher than the combustion gas pressure. In the third embodiment, however, the engine is equipped with the turbo charger 15, and the air for combustion of the combustion heater 91 is sucked from the portion, disposed downstream of the compressor 15*a* of the turbo charger 15, of the intake pipe 14. It is therefore feasible to make the combustion gas pressure of the combustion heater 91 higher than the exhaust gas pressure by dint of the supercharging pressure of the turbo charger 15.

Consequently, the combustion gas of the combustion heater 91 can be discharged to the exhaust pipe 42 on the upstream-side of the catalyst converter 39 even during the operation of the engine 1.

Further, the back flow of the exhaust gas does not occur in the combustion cylinder 40 of the combustion heater 91, and the accidental fire caused by a back fire can be prevented.

Moreover, the supercharging pressure of the turbo charger 15 rises, and therefore, even if the differential pressure between the air intake port 95 and the combustion gas discharge port 63 becomes large due to an increased differential pressure between the connecting point C1 in the intake pipe 14 and above-described connecting point C3, because of the combustion heater 91 including the heater bypass pipe 52 for connecting the air supply pipe 71 to the exhaust gas discharge pipe 73 and the check valve 53 provided in the heater bypass pipe 52, when the differential pressure between the upstream-side and the downstream-side with the check valve 53 being a boundary therebetween, i.e., between the air intake port 95 and the combustion gas discharge port 63 reaches a valve opening pressure of the check valve 53, this check valve 53 opens. As a result, the suction air flowing through the air supply pipe 71 comes to flow via the heater bypass pipe 52 toward the combustion gas discharge pipe 73, with the result that there decreases the differential pressure between the air intake port 95 and the combustion gas discharge pipe 73. Hence, it is possible to prevent the excessive air from flowing to the combustion cylinder 40 of the combustion heater 91 and stabilize the air/fuel ratio of the air-fuel mixture supplied to the combustion cylinder 40 of the combustion heater 91. In addition, the stabilized combustion can be secured, and further the lean accidental fire can be prevented.

Moreover, the combustion gas discharged from the combustion heater 91 flows out via the branch pipe 84 to the connecting point C3, disposed downstream of the turbine 15*b* of the turbo charger 15 but upstream of the catalyst converter 39, of the exhaust pipe 42, and therefore flows to neither the turbo charger 15 nor the exhaust manifold 28.

Accordingly, it never happens that the combustion gas is cooled off by flowing though those exhaust system structures, and the high-temperature combustion gas can be utilized much more for heating the catalyst, whereby it is feasible to enhance a warm-up property of the catalyst and raise the temperature of the catalyst at a high efficiency.

Moreover, the combustion gas discharged from the combustion heater 91 does not flow to the compressor 15*a* of the turbo charger 15 and the inter cooler 19, and therefore the thermal damages to those intake system structures by the combustion gas can be prevented.

As discussed above, in accordance with the third embodiment, there are provided the heater bypass pipe 52 which bypasses the combustion heater 91 and connects the air supply pipe 71 to the combustion gas discharge pipe 73, and the check valve 53, thereby preventing the excessive air from flowing into the combustion cylinder 40 of the combustion heater 91. Further, it is consequently possible to ensure the preferable igniting property and the stable combustion in the combustion heater 91 and prevent the lean accidental fire.

<Fourth Embodiment>

Next, a fourth embodiment of the internal combustion engine having the combustion heater according to the present invention will be discussed referring to FIGS. 15 to 17.

Figure 15:
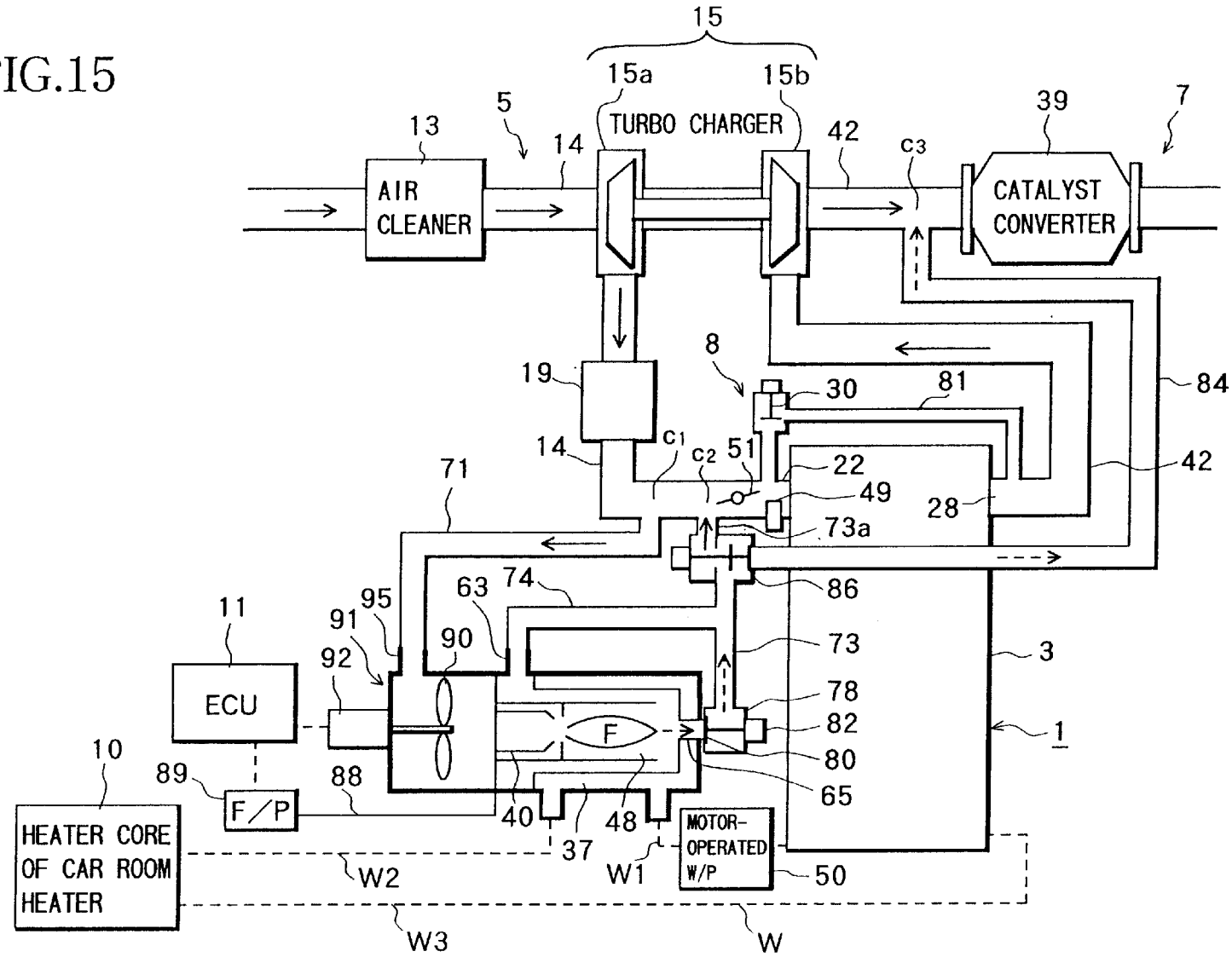
FIG. 15 is a schematic view showing a construction of the internal combustion engine having the combustion heater in a fourth embodiment of the present invention.

FIG. 15 schematically shows a construction of the internal combustion engine in the fourth embodiment, wherein the great majority of components thereof are the same as those of the internal combustion engine in the third embodiment discussed above. Now, in the discussion of the fourth embodiment, the members in the same modes as those in the third embodiment are marked with the like numerals in the drawings with an omission of the repetitive explanations thereof, and the explanation will be concentrated on only differences from the third embodiment.

The internal combustion engine in the fourth embodiment has neither the heater bypass pipe 52 for connecting the air supply pipe 71 to the combustion gas discharge pipe 73, and the check valve 53. Instead, an intake pressure sensor 49 is provided in the intake manifold 22. The intake pressure sensor 49 detects an intake pressure in the intake manifold 22, and outputs an electric signal corresponding to a detected value thereof to the ECU 11. Note that the intake pressure detected by the intake pressure sensor 49 might be a substitute for the supercharging pressure of the turbo charger 15 in the fourth embodiment.

Further, it should be noted that, in the third embodiment, the check valve 53 opens when the air pressure in the air supply pipe 71 becomes equal to or larger by the predetermined value than the combustion gas pressure in the combustion gas discharge pipe 73, and as a result the air flows through the heater bypass pipe 52 toward the combustion gas discharge pipe 73 from the air supply pipe 71, thereby to prevent the excessive air from flowing to the combustion heater. In the fourth embodiment, however, there are provided neither the heater bypass pipe 52 for connecting the air supply pipe 71 to the combustion gas discharge pipe 73, nor the check valve 53.

In the fourth embodiment, the excessive air is prevented from flowing into the combustion cylinder 40 of the combustion heater 91 even if the combustion gas discharged from the combustion heater 91 flows back to the intake pipe 14 from the connecting point C2 when the supercharging pressure of the turbo charger 15 is high. More specifically, the locations of the connecting points C1, C2 and a configuration of the intake pipe 14 between the connecting points C1, C2 are set so that the differential pressure between the pressure at the air intake port 95 and the pressure at the combustion gas discharge port 63 is smaller than the predetermined value, and, at the same time, an output of the combustion heater 91 is controlled, thereby the excessive air does not flow into the combustion cylinder 40 of the combustion heater 91.

Note that the predetermined value connotes a minimum value of the differential pressures large enough to produce an excessive air blow quantity in such a case that an air blow quantity produced within the combustion heater 17 due to the above difference between the pressure at the connecting point C1 on the side of the air supply passageway of the combustion chamber 48 and the pressure at the connecting point C2 on the side of the combustion gas discharge passageway becomes excessive enough to make therefore the ignition in the combustion heater 17 impossible and cause the accidental fire.

On the other hand, the following operation is performed so that the excessive air does not flow into the combustion cylinder 40 even when the combustion gas discharged from the combustion heater 91 flows back to the exhaust pipe 42 via the branch pipe 84 at the connecting point C3 disposed upstream of the catalyst converter 39.

To be specific, the ECU 11 judges based on a magnitude of the supercharging pressure of the turbo charger 15 whether or not the excessive air flows into the combustion cylinder 40. When judging that the excessive air flows thereinto, the ECU 11 controls the rotational fan 90 of the combustion heater 91 so that the number of rotations thereof is smaller than a number of normal control rotations. With the control thus performed, an air pressurizing quantity by the rotational fan 90 is reduced, whereby the quantity of air blow through the combustion cylinder 40 can be properly controlled.

Further, also when the combustion gas flows via the branch pipe 84 back to the exhaust pipe 42 at the connecting point C3 disposed upstream of the catalyst converter 39, whether or not the excessive air flows into the combustion cylinder 40 of the combustion heater 91 and the quantity of the excessive air flowing thereinto, are determined based on a magnitude of the differential pressure between the air intake port 95 on the side of the air supply passageway 71 and the combustion gas discharge port 65 on the side of the combustion gas discharge passageway 73.

It has proven that when the combustion gas discharged from the combustion gas discharge port 65 of the combustion heater 91 flows via the branch pipe 84 back to the exhaust pipe 42 at the connecting point C3 disposed upstream of the catalyst converter 39, the magnitude of the differential pressure produced between the air intake port 95 and the combustion gas discharge port 65 has a close relationship with a magnitude of the supercharging pressure of the turbo charger 15, in which as the supercharging pressure becomes larger, the differential pressure produced between the air intake port 95 and the combustion gas discharge port 65 increases more.

Figure 16:
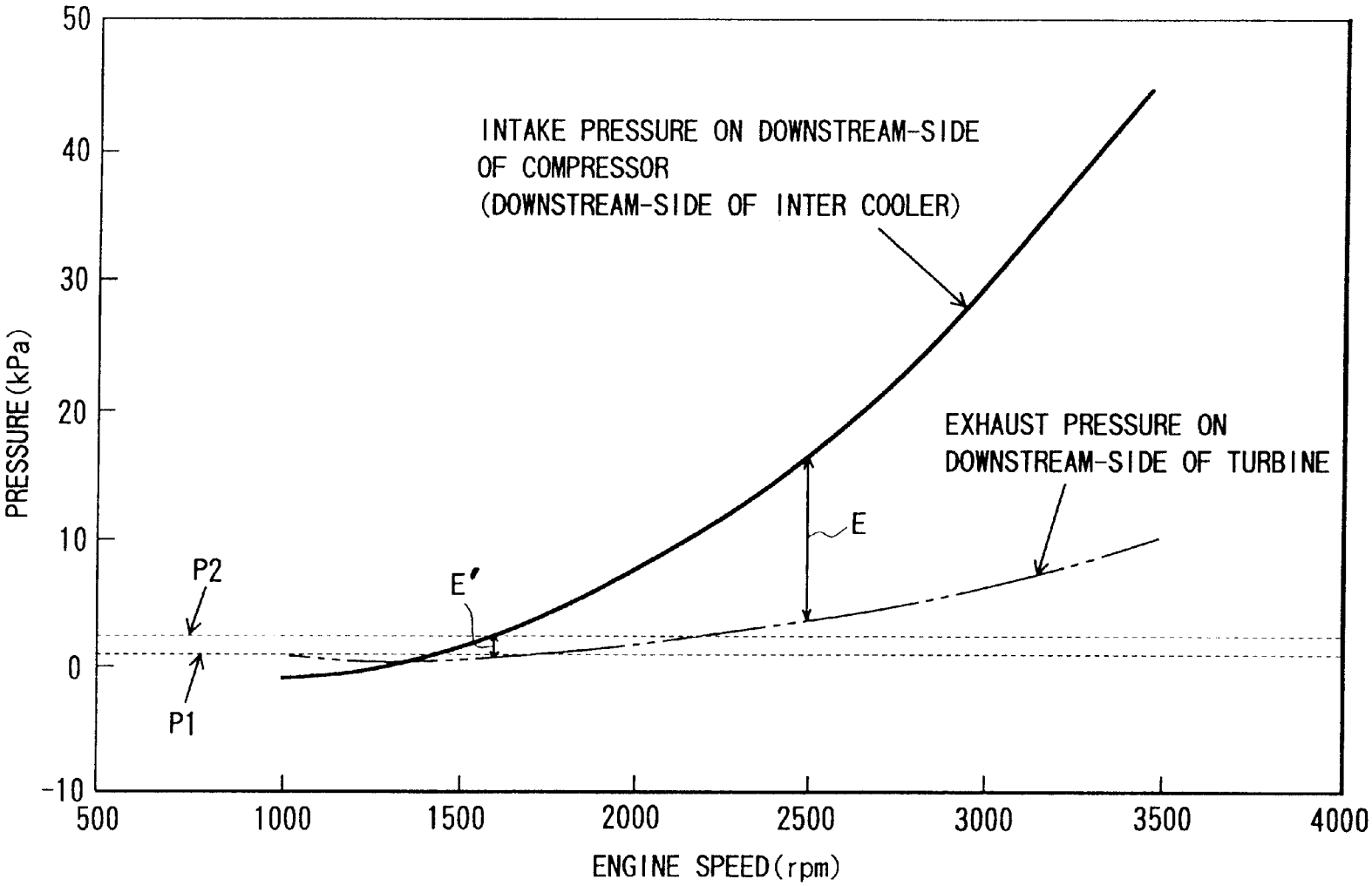
FIG. 16 is a graphic chart of a pressure versus engine speed, showing a pressure change subsequent to a change in the engine speed when in an operation of a turbo charger.
Figure 17:
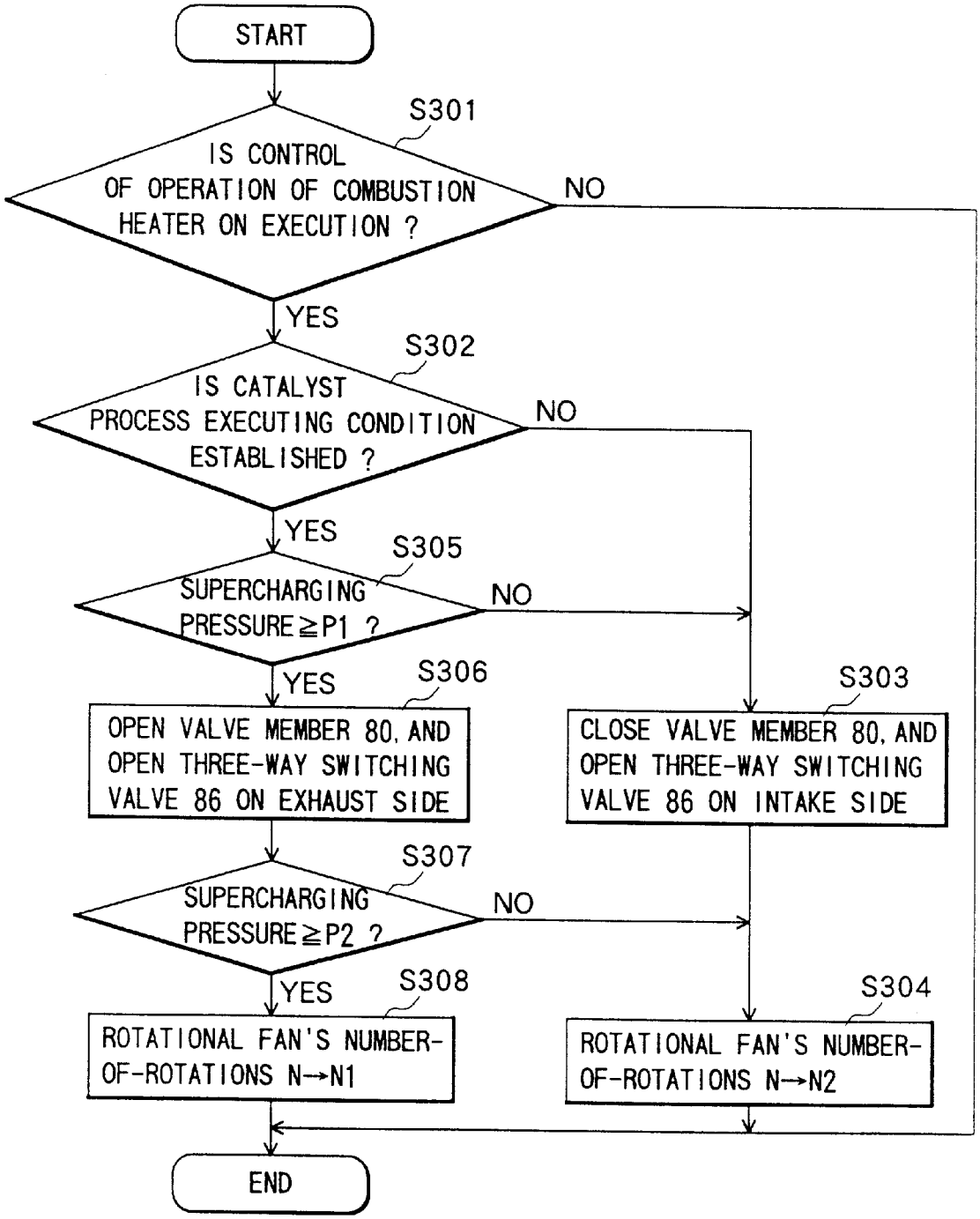
FIG. 17 is a diagram showing a flowchart of an operation control execution routine of the combustion heater in a fourth embodiment of the present invention.

FIG. 16 is a graphic chart showing one example of a pressure versus an engine speed, wherein the axis of ordinates indicates the pressure, and the axis of abscissas indicates the engine speed.

In the graphic chart, a graph of bold solid line and a graph of two-dotted chain line respectively indicate an intake pressure at a portion, disposed downstream of the inter cooler 19, of the intake pipe 14 and an exhaust pressure, at a portion, disposed downstream of the turbine 15*b*, of the exhaust pipe 42 in a case where the combustion gas discharged from the combustion gas discharge port 65 of the combustion heater 91 is discharged to the connecting point C3 to the exhaust pipe 42 via the branch pipe 84.

The intake pressure indicated by the bold solid line graph is, it may be said, a pressure at the air intake port 95 in terms of such a configuration that the air intake port 95 of the combustion heater 91 communicates with the portion, disposed downstream of the inter cooler 19, of the intake pipe 14 through the air supply pipe 71.

Further, the exhaust pressure indicted by the two-dotted chain line graph is, it may also be said, a pressure at the combustion gas discharge port 65 in terms of such a configuration that the combustion gas discharge port 65 communicates with the portion, disposed downstream of the turbine 15*b*, of the exhaust pipe 42 through the branch pipe 84 and a part of the combustion gas discharge pipe 73.

Moreover, a broken line indicated by the symbol P1 in FIG. 16 connotes a predetermined pressure value as a basis for judging whether or not the three-way switching valve 86 should be opened on the side of the branch pipe 84 when the turbo charger 15 operates.

Similarly, a broken line indicated by the symbol P2 connotes a predetermined supercharging pressure value as a basis for judging whether or not the excessive air flows to the combustion cylinder 40 when the turbo charger 15 operates.

The pressure values P2 and P1 have a relationship such as P2>P1. Note that the intake pressure detected by the intake pressure sensor 49 may be, as described above, a substitute for the supercharging pressure.

As can be understood from FIG. 16, when the engine speed rises and the supercharging pressure exceeds the predetermined pressure P2, the intake pressure on the downstream-side of the inter cooler thereafter estranges largely from the exhaust pressure on the downstream-side of the turbine, and the differential pressure between the air intake port 95 and the combustion gas discharge port 65, i.e., a quantity of estrangement (an estrangement quantity) of the bold solid line graph from the two-dotted chain line graph gradually increases. Note that the estrangement quantity is designated by the symbol E, and FIG. 16 exemplifies an estrangement quantity at an engine speed of approximately 1600 rpm when the bold solid line graph intersects the broken line P2, and an estrangement quantity at another engine speed of 2500 rpm. The estrangement quantity at the above engine speed when the bold solid line graph intersects the broken line P2, is designated by the symbol E' for convenience to distinguish from another estrangement quantity.

Then, if the estrangement quantity E is over the estrangement quantity E' at the above engine speed when the bold solid line graph intersects the broken line P2, the operation of the rotational fan 90 is controlled in such a direction as to reduce the intake quantity of the air for combustion into the combustion chamber 48. In other words, if the engine speed rises and the pressure in the air supply pipe 71 becomes equal to or greater by the estrangement quantity E' as a predetermined value than the pressure in the combustion gas discharge pipe 73, viz., if the differential pressure between the air intake port 95 and the combustion gas discharge port 65 comes to the estrangement quantity E' or more, the operation of the rotational fan 90 is controlled in such a direction as to decrease the intake quantity of the air for combustion into the combustion chamber 48.

Accordingly, to define the estrangement quantity E' as the predetermined value, the estrangement quantity E' implies a minimum value of the differential pressures large enough to produce an excessive air blow quantity in such a case that an air blow quantity produced within the combustion heater due to the difference between the pressure at the connecting point C11 on the side of the air supply passageway of the combustion chamber 48 and the pressure at the connecting point C3 on the side of the combustion gas discharge passageway becomes excessive enough to make therefore the ignition unable to be done and cause the accidental fire.

Hence, the supercharging pressure of the turbo charger 15 increases, and the differential pressure between the air intake port 95 and the combustion gas discharge port 65 becomes large, viz., the differential pressure caused between on the side of the air supply passageway and on the side of the combustion gas discharge passageway comes to the estrangement quantity E' or greater, and, when the excessive air flows within the combustion cylinder 40 due to the above differential pressure, the pressurization quantity by the rotational fan 90 is reduced by decreasing the number of rotations of the rotational fan 90. Then, with this reduction, the flow quantity of the air flowing through within the combustion cylinder 40 is controlled to a proper air flow quantity normally required by diminishing the differential pressure between the air intake port 95 and the combustion gas discharge port 65.

Then, a test is performed beforehand on the engine 1, thereby obtaining a magnitude of the supercharging pressure of the turbo charger 15 when the excessive air starts flowing within the combustion cylinder 40 of the combustion heater 91. Moreover, there are obtained data on how much the number of rotations of the rotational fan 90 should be reduced in order to set the air flow quantity to the normal proper quantity in accordance with the magnitude of the supercharging pressure, in other words, in accordance with the flow quantity of the excessive air. Then, from these data, a number-of-control-rotations map at the time of occurrence of the excessive air flow is prepared, and this map is stored in the ROM of the ECU 11.

Next, a program for carrying out a number-of-rotations control execution routine of the combustion heater 91 which is executed by the ECU 11, will be explained with reference to a flowchart of FIG. 17.

To begin with, the ECU 11 judges in S301 whether or not the operational control of the combustion heater 91 is on the execution, i.e., whether or not the combustion heater 91 is in an operating state.

The ECU 11, when judging in S301 that the combustion heater 91 is a non-operating state, temporarily finishes executing the present routine. Note that the valve device 78 closes its valve member 80, while the three-way switching valve 86 shuts off the branch pipe 84 in the non-operating state of the combustion heater 91.

While on the other hand, the ECU 11, when judging in S301 that the combustion heater 91 is in the operating state, advances to S302 and judges therein whether or not a catalyst process executing condition is established. The catalyst process executing condition may be exemplified such as, the time when warming-up of the catalyst converter 39 is being accelerated, a poisoning recovery process timing and a reducing process timing of the catalyst converter 39.

The ECU 11, when judging in S302 that the catalyst process executing condition is not established, advances to S303. Then, the ECU 11 controls the valve device 78 to operate to close the valve member 80 and also the threeway switching valve 86 to shut off the branch pipe 84, and further controls the three-way switching valve 86 to open on the intake side.

Moreover, the ECU 11 proceeds to S304, and controls a number-of-rotations N of the rotational fan 90 to a normal number-of-control-rotations N2 set when there is almost no differential pressure between the air intake port 95 and the combustion gas discharge port 65 (63).

At this time, the high-temperature combustion gas evolved by the combustion in the combustion cylinder 40 of the combustion heater 91 flows along the air flow produced with the rotations of the rotational fan 90 through the combustion chamber 48 toward the combustion gas discharge port 63. Thereafter, the combustion gas is discharged to the parallel connecting pipe 74 connected to the combustion gas discharge port 63 and further discharge to the combustion gas discharge pipe 73.

On the other hand, the engine cooling water, which is supplied by pressurization by the engine water pump or motor-operated water pump 50 to the heater inside cooling water passageway 37 of the combustion heater 91 via the water conduit W1 from the water jacket, flows round through the heater inside cooling water passageway 37 along the entire outer surface of the partition wall 40*a*. Then, for the duration of such a round flow, the engine cooling water absorbs the combustion heat of the combustion gas and thus rises in temperature. Viz., the thermal exchange takes place between the engine cooling water and the combustion gas over the whole area of the heater inside cooling water passageway 37.

Then, the engine cooling water having absorbed the combustion heat circulates through the thermal medium circulation passageway W indicated by the broken line in FIG. 15. That is, the engine cooling water is led into the heater core 10 via the water conduit W2 from the heater inside cooling water passageway 37 and is, upon an, exit from the heater core 10, discharged to the water conduit W3, thus flowing back to the water jacket of the engine body 3. This flow loop is repeated as the necessity may arise.

Thus, the engine cooling water assuming the high temperature by its being warmed in the combustion heater 91 flows to the water jacket of the engine body 3 or to the car room heater 10, and, as a result, it is feasible to speed up the warm-up of the internal combustion engine and improve the starting property thereof, and enhance the performance of the heater core 10.

Note that some of the heat held by the engine cooling water is exchanged with the air for heating in the heater core 10, and a temperature of the air for heating rises. As a consequence, the hot air blows into the room of the vehicle.

Further, the combustion gas discharged to the combustion gas discharge pipe 73 flows back to the intake pipe 14, as indicated by the solid line arrow in FIG. 15, via the three-way switching valve 86, and is supplied to the combustion chamber of the engine body 3 together with the suction air which is not led into the combustion heater 91. The, the combustion gas is mixed with the fuel injected out of the unillustrated fuel injection valve, and the thus formed air-fuel mixture is used for the combustion.

On this occasion, the combustion chamber of the engine body 3 is supplied with the combustion gas, of which a temperature has been decreased after the thermal exchange with the cooling water in the combustion heater 91, and hence there is prevented a thermal damage to the engine 1 due to long-time suctioning of the high-temperature suction air.

Furthermore, a small amount of combustion gas exhibiting a comparatively high $CO_2$ concentration is supplied to the combustion chamber of the engine body 3, thereby making it feasible to reduce at a high efficiency a quantity of NOx produced by the combustion in the combustion chamber of the engine body 3.

Further, the combustion gas discharged from the combustion heater 91 is re-burned in the combustion chamber of the engine body 3, and besides the exhaust gas discharged from the combustion chamber of the engine body 3 is purified by the catalyst converter 39. Accordingly, the combustion gas discharged from the combustion heater 91 is released outside after being substantially purified.

Moreover, the combustion gas discharged from the combustion heater 91 flows to the intake pipe 14 disposed downstream of the inter cooler 19 and therefore flows to neither the compressor 15*a* of the turbo charger 15 nor the inter cooler 19, whereby the thermal damages thereto are also prevented. While on the other hand, the ECU 11, when judging in S302 that the catalyst process executing condition is established, advances to S305 and judges therein whether or not the supercharging pressure of the turbo charger 15 exceeds a predetermined pressure P1.

The ECU 11, when judging in S305 that the supercharging pressure of the turbo charger 15 does not exceed the predetermined pressure P1, namely, smaller than P1, goes forward to S303 and, as explained above, controls the three-way switching valve 86 to shut off the branch pipe 84. This is because there might be a possibility in. which the exhaust gas pressure in the exhaust pipe 42 located upstream of the catalyst converter 39 is larger than the intake pressure in the intake pipe 14 located downstream of the inter cooler 19, and, when the three-way switching valve 86 opens on the side of the branch pipe 84 in such a case, the exhaust gas might flow back to the combustion heater 91 via the branch pipe 84 and the threeway switching valve 86 as well, which must therefore be prevented.

The ECU 11, when judging in S305 that the supercharging pressure of the turbo charger 15 exceeds the predetermined pressure P1, namely, equal to or larger than P1, advances to S306 and controls the operation of the valve device 78 to open the valve member 80 and also the three-way switching valve 86 to shut off the route of the combustion gas discharge pipe 73 which leads to the intake pipe 14 and to open the route of the branch pipe 84.

In addition, the high-temperature combustion gas evolved by the combustion in the combustion cylinder 40 of the combustion heater 91 flows along the air flow generated with the rotations of the rotational fan 90 through the combustion chamber 48 toward the combustion gas discharge port 65. Then, a large proportion of the combustion gas flows through the combustion gas discharge port 65 and further through the opening 79*a* of the valve device 78, and is discharged to the combustion gas discharge pipe 73.

Herein, the combustion gas flowing via the combustion gas discharge port 63 is cooled off by the thermal exchange with the engine cooling water, however, the combustion gas flowing via the combustion gas discharge port 65 undergoes almost no thermal exchange with the engine cooling water. Therefore, the combustion gas discharged from the combustion gas discharge port 65 has the temperature which is by far higher than the combustion gas discharged from the combustion gas discharge port 63.

Then, as indicated by the broken line arrow in FIG. 15, the high-temperature combustion gas discharged to the combustion gas discharge pipe 73 via the combustion gas discharge port 65 arrives at the three-way switching valve 86 , of which the port on the side of the intake pipe 14 is shut off, and therefore flows to the branch pipe 84. Then, the combustion gas is discharged to the exhaust pipe 42 from the connecting point C3 existing upstream of the catalyst converter 39.

Accordingly, the high-temperature combustion gas discharged from the combustion gas discharge port 65 is supplied to the connecting point C3, whereby the temperature of the catalyst converter 39 can be raised at the early stage.

Next, the ECU 11 advances to S307, and judges whether or not the supercharging pressure of the turbo charger 15 exceeds a predetermined pressure P2.

The ECU 11, when judging in S307 that the supercharging pressure of the turbo charger 15 does not exceed the predetermined pressure P2, namely, smaller than P2, moves forward to S304, and controls the number-of-rotations N of the rotational fan 90 to the normal number-of-control-rotations N2 set when there is almost no differential pressure between the air intake port 95 and the combustion gas discharge port 65 (63).

An implication that the supercharging pressure of the turbo charger 15 does not exceed the predetermined pressure P2, is that the excessive air does not flow into the combustion cylinder 40 of the combustion heater 91, and therefore, if the number-of-rotations N of the rotational fan 90 is controlled to the normal number-of-control-rotations N2, a desired proper air blow quantity is obtained.

While on the other hand, the ECU 11, when judging in S307 that the supercharging pressure of the turbo charger 15 exceeds the predetermined pressure P2, namely, equal to or larger than P2, diverts to S308, and, referring to the number-of-control-rotations map for the excessive air flow time which is stored in the ROM, controls the number-of-rotations N of the rotational fan 90 to the number-of-control-rotations N1 for the excessive air flow time, corresponding to a magnitude of that supercharging pressure.

Herein, the number-of-control-rotations N1 for the excessive air flow time is smaller than the normal number-of-control-rotations N2 when there is almost no differential pressure between the air intake port 95 and the combustion gas discharge port 65. Thus, the number-of-control-rotations N of the rotational fan 90 is controlled to the number-of-control-rotations N1, thereby flowing of the excessive air into the combustion cylinder 40 of the combustion heater 91 is suppressed, and making it possible to set the air blow quantity through within the combustion cylinder 40 to the desired proper air blow quantity.

Accordingly, the air having the proper air blow quantity can be flowed into the combustion cylinder 40 of the combustion heater 91 irrespective of the magnitude of the supercharging pressure of the turbo charger 15. As a result, it is feasible to stabilize the air-fuel ratio of the air-fuel mixture in the combustion cylinder 40 of the combustion heater 91, ensure the stable combustion and prevent the lean accidental fire.

During the operation of the engine 1, there arises the exhaust gas pressure within at the portion, disposed upstream of the catalyst converter 39, of the exhaust pipe 42, however, the air for combustion in the combustion heater 91 is sucked from downstream of the compressor 15*a* of the turbo charger 15. As a result, the combustion gas pressure in the combustion heater 91 can be set higher than the exhaust gas pressure in the exhaust pipe 42 at the connecting point C3 by utilizing the supercharging pressure of the turbo charger 15. It is therefore possible to discharge the combustion gas of the combustion heater 91 to the exhaust pipe 42 disposed upstream of the catalyst converter 39 during the operation of the engine 1. Further, the back flow of the exhaust gas does not occur in the combustion cylinder 40 of the combustion heater 91 even when supercharged by the turbo charger 15, and the accidental fire caused by the back fire can be prevented.

Further, the combustion gas discharged from the combustion heater 91 flows out, via a branch pipe 84, to the portion of the exhaust pipe 42, located downstream of the turbine 15*b* of the turbo charger 15 but upstream of the catalyst converter 39, and therefore flows to neither the turbo charger 1 nor the exhaust manifold 28 with no possibility of being cooled therein. Hence, the high-temperature combustion gas can be much more utilized for heating, corresponding to a degree to which the combustion gas is not cooled off., and it is feasible to enhance the catalyst warm-up property and raise the catalyst temperature at a high efficiency.

Further, the combustion gas discharged from the combustion heater 91 does not flow to the compressor 15*a* of the turbo charger 15 and the inter cooler 19, so that the thermal damage thereto can be also prevented.

As discussed above, in accordance with the fourth embodiment, the excessive air is prevented from flowing into the combustion cylinder 40 of the combustion heater 91 by controlling the number of rotations of the rotational fan 90 of the combustion heater 91, and in an extensive term it is possible to ensure both of the preferable igniting property and the stable combustion in the combustion heater 91, and prevent the lean accidental fire.

Note that an element for executing S308 among a series of signal processes by the ECU 11 may be called an air intake quantity reduction control means for controlling an operation of the rotational fan 90 in such a direction as to reduce an intake quantity of the air for combustion. Further, this step is stored in the Rom of the ECU 11, and therefore the ECU 11 may also be called the air intake quantity reduction control means. If the pressure in the air supply pipe 71 becomes equal to or greater by a predetermined value than a pressure in the combustion gas discharge pipe 73, the ECU 11 defined as the air intake quantity reduction control means controls the operation of the rotational fan (air blow device) 90, and the intake quantity of the air for combustion into the combustion chamber 48 is thereby reduced. Consequently, the quantity of the air flowing through within the combustion chamber 48 is restricted, and the ECU 11 and the rotational fan 90 constitute an air quantity control means for controlling the quantity of the air flowing in the combustion chamber in accordance with the differential pressure between the side of the air supply pipe 71 and the side of the combustion gas discharge pipe 73 in the combustion chamber 48 as well as being the air intake quantity reduction control means.

<Fifth Embodiment>

Next, a fifth embodiment of the internal combustion engine having the combustion heater according to the present invention will be discussed referring to FIGS. 18 and 19.

Figure 18:
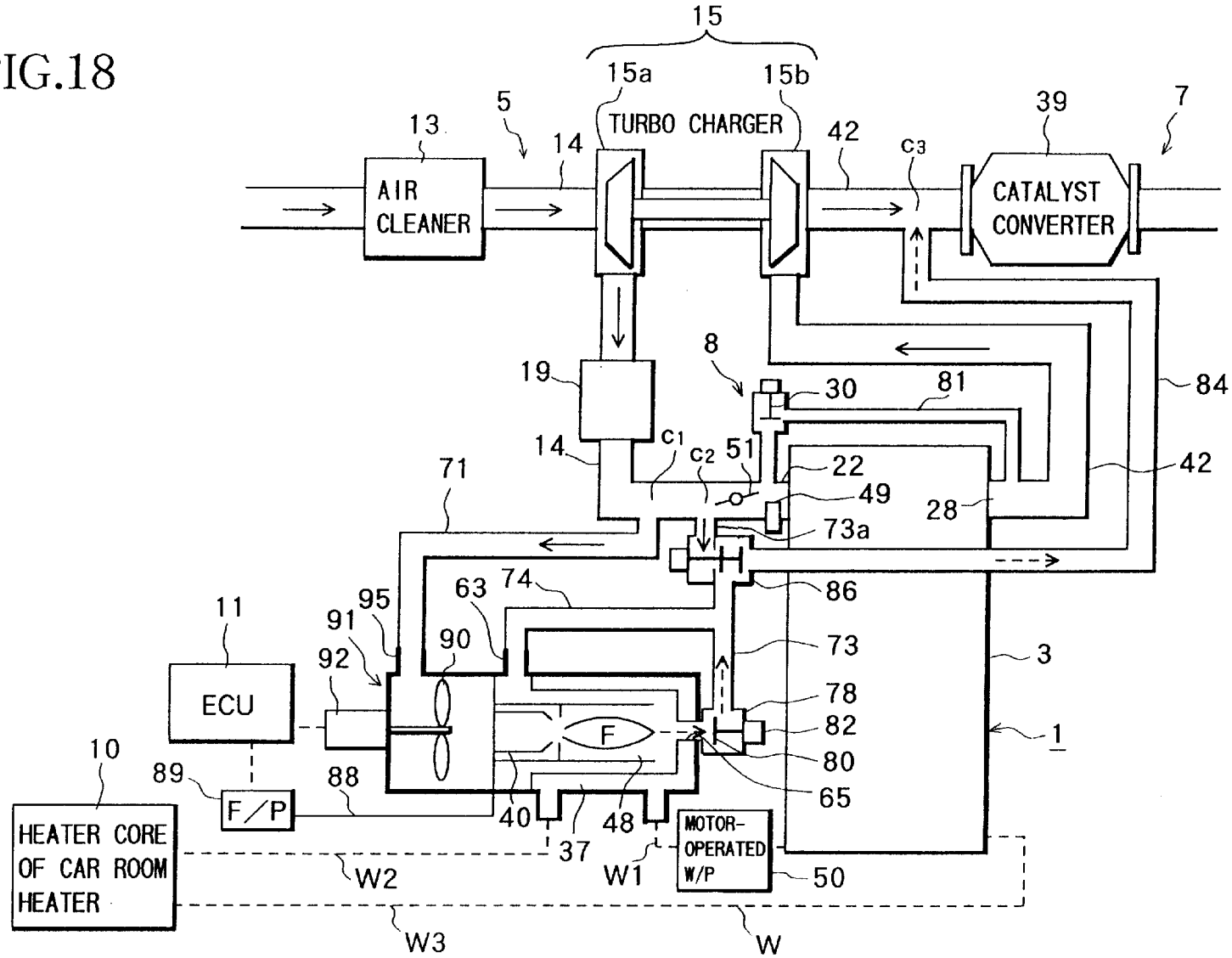
FIG. 18 is a schematic view showing a construction of the internal combustion engine having the combustion heater in a fifth embodiment of the present invention.

FIG. 18 schematically shows a construction of the internal combustion engine in the fifth embodiment, which is the same as that of the internal combustion engine in the fourth embodiment discussed above, wherein the members in the same modes as those in the fourth embodiment are marked with the like numerals in the drawings with an omission of the explanation of the construction in the fifth embodiment.

What is different in the fifth embodiment from the fourth embodiment is a control method of preventing the excessive air from flowing to the combustion cylinder 40 of the combustion heater 91. This control method will hereinafter be described in details.

In the fourth embodiment, when the supercharging pressure of the turbo charger 15 exceeds the predetermined pressure P2, viz., when the differential pressure between the air intake port 95 and the combustion gas discharge port 65 comes to the condition under which the excessive air flows to the combustion cylinder 40, the excessive air is prevented from flowing to the combustion cylinder 40 by decreasing the number of rotations of the rotational fan 90 of the combustion heater 91.

By contrast, according to the fifth embodiment, when coming to the condition under which the excessive air flows to the combustion cylinder 40 as described above, the normal number-of-rotation control is carried out without decreasing the number of rotations of the rotational fan 90. Then, the combustion gas discharge port 65 is made to communicate with the intake pipe 14 disposed downstream of the compressor 15*a* of the turbo charger 15. With this arrangement, the combustion gas pressure at the combustion gas discharge port 65 is increased, while the differential pressure between the air intake port 95 and the combustion gas discharge port 65 is decreased, thereby preventing the flow of the excessive air to the combustion cylinder 40.

This will hereinafter be explained in greater detail.

According to the fifth embodiment, as in the fourth embodiment, it is so arranged that the excessive air does not flow into the combustion cylinder 40 of the combustion heater 91 even if the combustion gas in the combustion heater 91 flows back to the intake pipe 14 via the connecting point C2 when the supercharging pressure of the turbo charger 15 is high. In other words, the locations of the connecting points C1, C2 and the configuration of the intake pipe 14 between the connecting points C1, C2 are so set that the differential pressure between the air intake port 95 and the combustion gas discharge port 63 fall within and equal to the predetermined pressure or under.

Accordingly, in the fifth embodiment, what is considered as a measure for preventing the excessive air from flowing into the combustion cylinder 40 of the combustion heater 91, may simply be to return the combustion gas discharged from the combustion heater 91 to the exhaust pipe 42 at the connecting point C3 existing upstream of the catalyst converter 39.

As given in the discussion on the fourth embodiment, the magnitude of the differential pressure occurred between the air intake port 95 and the combustion gas discharge port 65 when returning the combustion gas discharged from the combustion heater 91 to the exhaust pipe 42 at the connecting point C3 existing upstream of the catalyst converter 39, has a close relationship with the magnitude of the supercharging pressure of the turbo charger 15, wherein the above differential pressure increases as the supercharging pressure augments.

When returning the combustion gas discharged from the combustion gas discharge port 65 to the exhaust pipe 42 disposed upstream of the catalyst converter 39, the three-way switching vale 86 is controlled to close the second port of the three-way switching valve 86, thereby shutting off the intake pipe 14. At this time, the third port is opened, thereby letting the branch pipe 84 open.

Herein, as described above, when the supercharging pressure of the turbo charger 15 equals to or larger than the predetermined pressure P2 in the state where the branch pipe 84 is made communicative by opening the third port, viz., when the differential pressure between the air intake port 95 and the combustion gas discharge port 65 becomes large enough to satisfy the condition under which the excessive air flows to the combustion cylinder 40, the second port is slightly opened by operating the three-way switching valve 86, thereby executing the control on the side of the intake pipe 14 to communicate with the combustion gas discharge pipe 73.

As a result, the high-pressure suction air in the intake pipe 14 is led into the three-way switching valve 86 via the connecting point C2, and the pressure at the combustion gas discharge port 65 communicating with the three-way switching valve 86 via the combustion gas discharge pipe 73 and the valve device 78, is substantially equalized to an intake pressure at the connecting point C2 in the intake pipe 14. Namely, the intake high pressure at the connecting point C2 and the lower pressure at the combustion gas discharge port 65 which is lower than the intake pressure, are averaged.

On the other hand, the air intake port 95 of the combustion heater 91, as described above, leads to the connecting point C1 in the intake pipe 14 through the air supply pipe 71. The pressure at the air intake port 95 is therefore equalized to the pressure at the connecting point C1.

Both of the connecting points C1 and C2 in the intake pipe 14 take the pressures at the portions disposed downstream of the inter cooler 19 along the intake pipe 14.

Then, as discussed above, when the supercharging pressure of the turbo charger 15 is high, even if the combustion gas discharged from the combustion heater 91 flows back to the intake pipe 14 via the connecting point C2, the excessive air does not flow into the combustion cylinder 40 of the combustion heater 91. That is to say, the locations of the connecting points C1, C2 and the configuration of the intake pipe 14 between the connecting points C1, C2 are set so that the differential pressure between the air intake port 95 and the combustion gas discharge port 63 falls within and equal to the predetermined pressure or under. Further, at the connecting point C2, the combustion gas discharge port 65 is connected therewith via the combustion gas discharge pipe 73.

Accordingly, the pressures at the air intake port 95 and at the combustion gas discharge port 65, which respectively lead to the connecting points C1, C2, are substantially the same or has a mere difference to such a extent that the excessive air does not flow into the combustion cylinder 40 of the combustion heater 91.

Hence, it is possible to prevent the excessive air from flowing into the combustion cylinder 40 and control the air blow quantity through within the combustion cylinder 40 to a proper air blow quantity normally required.

Note that a series of passageway consisting of a pipe segment of the combustion gas discharge pipe 73 which connects the valve device 78 to the three-way switching valve 86 and the branch pipe 84, is called an exhaust-side combustion gas discharge passageway. Further, the entire passageway of the combustion gas discharge pipe 73 extending from the connecting point C2 of the intake pipe 14 to the valve device 78 is termed an intake-side combustion gas discharge passageway. Moreover, in a case where the exhaust-side combustion gas discharge passageway is called the combustion gas discharge passageway, the intake-side combustion gas discharge passageway may also be called another combustion gas discharge passageway by contrast with the exhaust-side combustion gas discharge passageway.

Further, the combustion gas discharge pipe 73 has the pipe segment as a part thereof extending from the connecting point C2 to the three-way switching valve 86, through which the exhaust-side combustion gas discharge passageway communicates with the connecting point C2 of the intake pipe 14. Hence, the pipe segment from the connecting point C2 to the three-way switching valve 86 may be called a communicating passageway 73*a*. The intake pressure of the intake pipe 14 is led via the combustion gas discharge pipe 73 embracing the communicating passageway 73*a* to the combustion gas discharge port 65 from the connecting point C2. Therefore, the entire area of the combustion gas discharge passageway 73 may be termed a pressure leading passageway.

Furthermore, the combustion gas discharge pipe 73 embracing the communicating passageway 73*a* has the three-way switching valve 86 provided midways thereof, and the three-way switching valve 86 is a valve mechanism for opening and closing the communicating passageway 73*a*. The three-way switching valve 86 classified as the valve mechanism is capable of performing selective switching of introducing the combustion gas to the exhaust pipe 42 via the exhaust-side combustion gas discharge passageway or to the intake pipe 14 via the intake-side combustion gas discharge passageway. Moreover, the three-way switching valve 86 is the valve mechanism provided in the communicating passageway 73*a* opens the communicating passageway 73 or in an extensive term the combustion gas discharge pipe 73 when the pressure in the air supply pipe 71 becomes equal to or larger by the predetermined value than the pressure in the exhaust-side combustion gas discharge passageway, and closes the pipe 73 when less than the predetermined value. The three-way switching valve 86 regulates the quantity of the air flowing within the combustion chamber 48 by the operation thereof, and may therefore be also called an air quantity control device for controlling the quantity of the air flowing within the combustion chamber in accordance with the differential pressure between the side of the air supply pipe 71 and the side of the combustion gas discharge pipe 73 in the combustion chamber 48.

In the fifth embodiment also, a test is effected beforehand on the engine 1, a magnitude P2 of the supercharging pressure of the turbo charger 15 when the excessive air starts flowing into the combustion cylinder 40 of the combustion heater 91, is thereby obtained and stored in the ROM of the ECU 11.

Further, as explained above, a position of the valve member when making the three-way switching valve 86 communicate with both of the intake pipe 14 and the branch pipe 84, is previously determined by performing the test. On the occasion of determining the position of the valve member, an aperture of the second port on the side of the intake pipe 14 should be diminished to the greatest possible degree within a range in which the excessive air does not flow into the combustion cylinder 40. If the second port is excessively opened, it follows that the cold suction air in the intake pipe 14 before being heated by the combustion heater 91 comes to flow into the catalyst converter 39 via the branch pipe 84, which hinders a rise in temperature of the catalyst converter 39.

Figure 19:
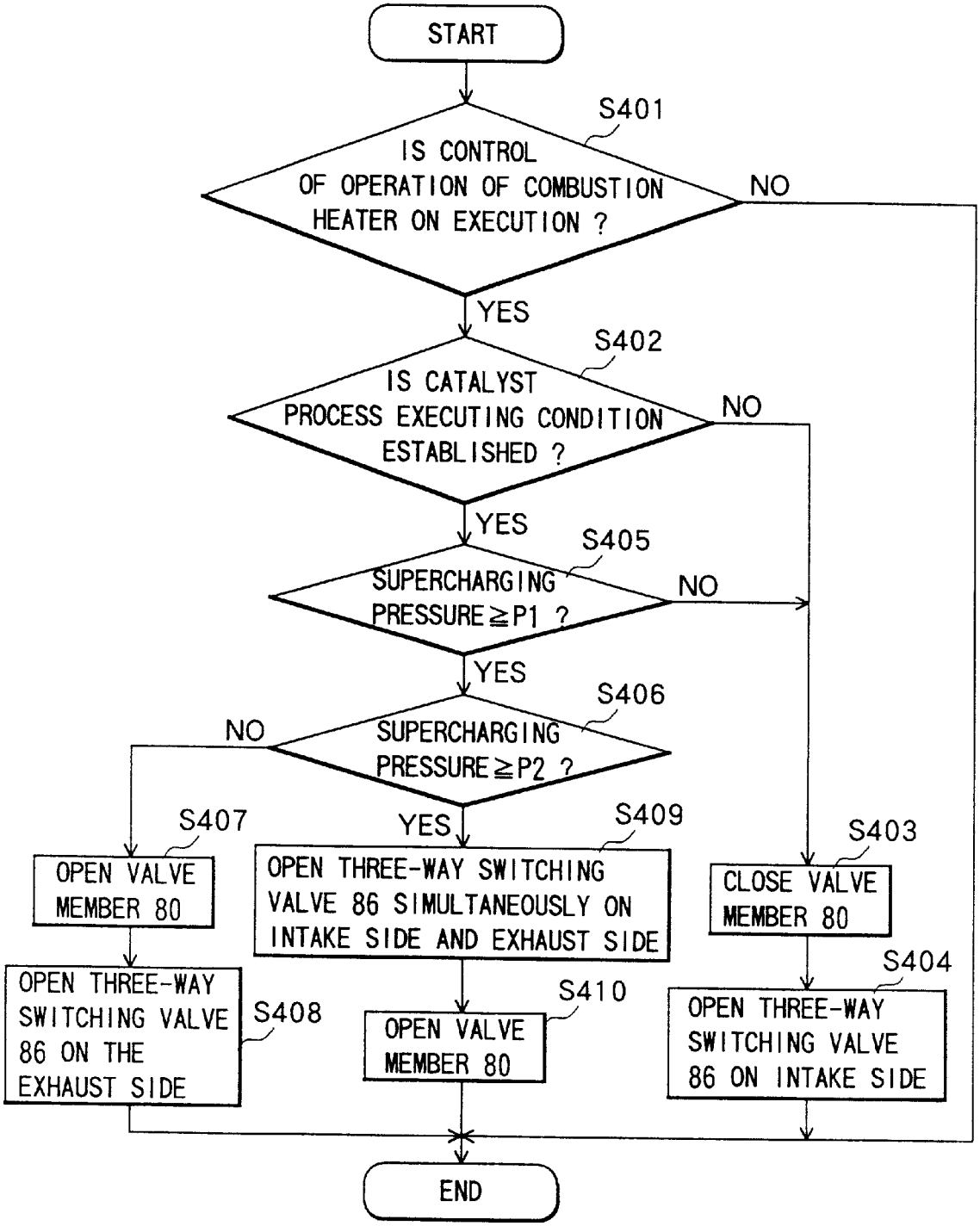
FIG. 19 is a diagram showing a flowchart of an operation control execution routine of the combustion heater in the fifth embodiment of the present invention.

Next, a program for actualizing a number-of-rotations control execution routine of the combustion heater 19, which is executed by the ECU 11, is described referring to a flowchart of FIG. 19.

To begin with, the ECU judges in S401 whether or not the control of the operation of the combustion heater 91 is on the execution, i.e., whether or not the combustion heater 91 is in the operating state.

The ECU 11, when judging in S401 that the combustion heater 91 is a non-operating state, temporarily finishes executing the present routine. Note that the valve device 78 closes its valve member 80, while the three-way switching valve 86 shuts off the branch pipe 84 in the non-operating state of the combustion heater 91.

While on the other hand, the ECU 11, when judging in S401 that the combustion heater 91 is in the operating state, advances to S402 and judges therein whether or not the catalyst process executing condition is established. The catalyst process executing condition is the same as that in the fourth embodiment, and hence its explanation is omitted.

The ECU 11, when judging in S402 that the catalyst process executing condition is not established, advances to S403, wherein the valve device 78 operates to close the valve member 80. The ECU 11 further advances to S404, wherein the ECU 11 controls the three-way switching valve 86 to shut off the branch pipe 84 and to open the port on the side of the intake pipe 14.

The operation and the flow of the combustion gas discharged from the combustion heater 91 at that time are absolutely the same as those when executing S303, S304 in the fourth embodiment discussed above, and therefore its explanation is omitted.

While on the other hand, the ECU 11, when judging in S402 that the catalyst process executing condition is established, advances to S405 and judges therein whether or not the supercharging pressure of the turbo charger 15 exceeds the predetermined pressure P1.

The ECU 11, when judging in S405 that the supercharging pressure of the turbo charger 15 does not exceed the predetermined pressure P1, namely, smaller than P1, goes forward to S403 and S404, and, as explained above, closes the valve member 80, and controls the three-way switching valve 86 to shut off the branch pipe 84 and to open the side of the intake pipe 14. This is because there might be a possibility in which the exhaust gas pressure in the exhaust pipe 42 located upstream of the catalyst converter 39 is larger than the intake pressure in the intake pipe 14 located downstream of the inter cooler 19, and, when the three-way switching valve 86 opens on the side of the branch pipe 84 in such a case, the exhaust gas might flow back to the combustion heater 91 via the branch pipe 84 and the three-way switching valve 86 as well, which must therefore be prevented.

The ECU 11, when judging in S405 that the supercharging pressure of the turbo charger 15 exceeds the predetermined pressure P1, namely, equal to or larger than P1, advances to S406 and judges whether or not the super charging pressure of the turbo charger 15 exceeds the predetermined pressure P2. Herein, the predetermined pressure P2 is larger than the predetermined pressure P1 (see FIG. 16).

The ECU 11, when judging in S406 that the supercharging pressure of the turbo charger 15 does not exceed the predetermined pressure P2, namely, smaller than P2, moves forward to S407 opens the valve member 80 by operating the valve device 78. Then, the ECU 11 further advances to S408, and controls the three-way switching valve 86 to close the second port of the three-way switching valve 86, thereby shutting off the intake pipe 14. At this time, the branch pipe 84 is simultaneously made communicative by opening the third port.

An implication that the supercharging pressure of the turbo charger 15 does not exceed the predetermined pressure P2, is that the excessive air does not flow into the combustion cylinder 40 of the combustion heater 91 even by controlling the three-way switching valve 86 in the way described above, and a desired proper air blow quantity is obtained.

Then, the high-temperature combustion gas evolved by the combustion in the combustion cylinder 40 of the combustion heater 91 flows along the air flow generated with the rotations of the rotational fan 90 through the combustion chamber 48 toward the combustion gas discharge port 65. Thereafter, a large proportion of the combustion gas is discharged to the combustion gas discharge pipe 73 through the combustion gas discharge port 65 and further through the opening 79*a* of the valve device 78.

Herein, the combustion gas flowing via the combustion gas discharge port 63 is cooled off by the thermal exchange with the engine cooling water, however, the combustion gas flowing via the combustion gas discharge port 65 undergoes almost no thermal exchange with the engine cooling water. Therefore, the combustion gas discharged from the combustion gas discharge port 65 has the temperature which is by far higher than the combustion gas discharged from the combustion gas discharge port 63.

Then, as indicated by the broken line arrow in FIG. 18, the high-temperature combustion gas discharged to the combustion gas discharge pipe 73 via the combustion gas discharge port 65 arrives at the three-way switching valve 86. As explained above, the port of the three-way switching valve 86 on the side of the intake pipe 14 is shut off, whereas the port on the side of the branch pipe 84 is opened. The combustion gas therefore flows to the branch pipe 84 and is discharged to the exhaust pipe 42 from the connecting point C3 existing upstream of the catalyst converter 39.

Accordingly, the high-temperature combustion gas discharged from the combustion gas discharge port 65 is supplied to the connecting point C3, disposed upstream of the catalyst converter 39, of the exhaust pipe 42, whereby the temperature of the catalyst converter 39 can be raised at the early stage.

While on the other hand, the ECU 11, when judging in S406 that the supercharging pressure of the turbo charger 15 exceeds the predetermined pressure P2, namely, equal to or larger than P2, moves forward to S409, and controls the three-way switching valve 86 to make the intake-side combustion gas discharge passageway communicative with both of the intake pipe 14 and the branch pipe 84. Note that the valve position of the three-way switching valve 86, which is, i.e., its aperture on the side of the intake pipe 14, is set to the position obtained previously from the test as described above.

Next, the ECU 11 advances to S410 and opens the valve member 80 by operating the valve device 78. Thereupon, a large proportion of the high-temperature combustion gas evolved by the combustion in the combustion cylinder 40 of the combustion heater 91, as indicated by the broken line arrow in FIG. 18, flows through the combustion gas discharge port 65, and thereafter arrives at the three-way switching valve 86 via the combustion gas discharge pipe 73. Then, the combustion gas further flows through the branch pipe 84 out to the exhaust pipe 42 from the connecting point C3 disposed upstream of the catalyst converter 39.

Simultaneously with this operation, some of the high-pressure suction air, of which the pressure is has been increased by the turbo charger 15 in the intake pipe 14, flows through the communicating passageway 73*a* from the connecting point C2 existing upstream of the intake throttle valve 51, and further flows by a small quantity into the three-way switching valve 86 (see the solid-line arrow directed to the three-way switching valve 86 from the connecting point C2 in FIG. 18). Then, the suction air is mixed at the three-way switching valve 86 with the combustion gas from the combustion gas heater 91, and flows out together with the combustion gas to the exhaust pipe 42 from the connecting point C3 provided upstream of the catalyst converter 39 via the branch pipe 84.

Thus, the small quantity of some high-pressure suction air is introduced into the three-way switching valve 86, whereby the pressure at the combustion gas discharge port 65 communicating with the three-way switching valve 86 through the combustion gas discharge pipe 73 and the vale device 78, can be substantially equalized to the intake pressure at the connecting point C2 of the intake pipe 14.

Namely, almost no differential pressure occurs between the air intake port 95 and the combustion gas discharge port 65. This makes is feasible to prevent the excessive air from flowing into the combustion cylinder 40, and the air blow quantity through inside the combustion cylinder 40 can be controlled to the proper air blow quantity normally required.

It is to be noted that the supercharging pressure of the turbo charger 15 is, it has been confirmed in S405, equal to or larger than the predetermined pressure P1, and therefore, as described above, even if the three-way switching valve 86 is made communicative with the intake pipe 14, it never happens that the exhaust gas from the exhaust pipe 42 flows back through the branch pipe 84 into the three-way switching valve 86.

As discussed so far, in the fifth embodiment, it is feasible to let the proper amount of air flow into the combustion cylinder 40 of the combustion heater 91 by controlling the operation of the three-way switching valve 86 regardless of the magnitude of the supercharging pressure of the turbo charger 15. Then, as a result, the air/fuel ratio of the air-fuel mixture supplied to the combustion cylinder 40 of the combustion heater 91 can be stabilized, the stable combustion can be ensured, and the lean accidental fire can be also prevented.

As discussed above, the internal combustion engine having the combustion heater according to the present invention is, with no such possibility that the air blow strong enough to make the ignition unable to be done when in the ignition of the combustion heater occurs in the combustion chamber of the combustion heater, therefore capable of surely effecting the ignition of the combustion heater. Further, the internal combustion engine of the invention is capable of stably operating and executing the ignition with certainty, and therefore preventing emissions of the white smokes and of disagreeable smell attributed to the unburned hydrocarbon produced.

The many features and advantages of the invention are apparent from the detailed specification and, thus, it is intended by the appended claims to cover all such features and advantages of the invention which fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. An internal combustion engine having a combustion heater operating and raising temperatures of engine related elements when said internal combustion engine is in a predetermined operating state, said engine comprising:

igniting means for making a latent flame by igniting a combustion fuel of said combustion heater;

a combustion chamber for growing the latent flame formed by said igniting means into a flame;

an air supply passageway for supplying said combustion chamber with the air for combustion;

a combustion gas discharge passageway for discharging a combustion gas out of said combustion chamber; and an air quantity control means for controlling a quantity of the air flowing within said combustion chamber in accordance with a differential pressure that occurs between the air supply passageway side of said combustion chamber and the combustion gas discharge passageway side of said combustion chamber.

2. An internal combustion engine having a combustion heater according to claim 1, wherein said air quantity control means, when the differential pressure comes to a predetermined value or over, restricts the quantity of the air flowing within said combustion chamber.

3. An internal combustion engine having a combustion heater according to claim 1, further comprising a communicating passageway for connecting said air supply passageway to said combustion gas discharge passageway.

4. An internal combustion engine having a combustion heater according to claim 1, wherein said air quantity control means restricts the quantity of the air flowing within said combustion chamber by controlling an air flow quantity through a communicating passageway for connecting said air supply passageway to said combustion gas discharge passageway.

5. An internal combustion engine having a combustion heater according to claim 4, wherein said air quantity control means includes a communicating passageway opening/closing mechanism, disposed in said communicating passageway, for opening and closing said communicating passageway.

6. An internal combustion engine having a combustion heater according to claim 5, wherein said communicating passageway is a pipe member opened when said igniting means starts the ignition and making said air supply passageway and said combustion gas discharge passageway communicate with each other.

7. An internal combustion engine having a combustion heater according to claim 6, wherein said communicating passageway is, after said igniting means has completed the ignition, closed to avoid the communication between said air supply passageway and said combustion gas discharge passageway.

8. An internal combustion engine having a combustion heater according to claim 1, wherein a supercharger is provided in an intake passageway of said internal combustion engine.

9. An internal combustion engine having a combustion heater according to claim 1, wherein said air quantity control means includes a flow quantity control mechanism for controlling a flow quantity of at least one of the air flowing through said air supply passageway and the combustion gas flowing through said combustion gas discharge passageway.

10. An internal combustion engine having a combustion heater according to claim 9, wherein said flow quantity control mechanism is a flow quantity reducing means for reducing the flow quantity of at least one of the air flowing through said air supply passageway and the combustion gas flowing through said combustion gas discharge passageway.

11. An internal combustion engine having a combustion heater according to claim 1, wherein said air quantity control means includes an air supply means for supplying said combustion chamber with the air.

12. An internal combustion engine having a combustion heater according to claim 11, wherein said air supply means is provided in said combustion chamber on the side of said air supply passageway.

13. An internal combustion engine having a combustion heater according to claim 1, wherein the combustion heater introduces the air for combustion from the intake passageway of the internal combustion engine and raises temperatures of engine related elements by utilizing heat held by a combustion gas produced by burning the air-fuel mixture by mixing a fuel for combustion with the air for combustion in the combustion chamber;

the intake passageway includes a supercharger for increasing a pressure of intake air in the intake passageway;

the air supply passageway introduces, from the intake passageway, the intake air, of which the pressure has been increased by the supercharger, as the air for combustion into the combustion chamber;

the combustion gas discharge passageway, bypassing cylinders of the internal combustion engine, discharges the combustion gas to an exhaust passageway of the internal combustion engine; the air supply passageway is communicated with the combustion gas discharge passageway by a communicating passageway; and the air quantity control means, provided in the communicating passageway, for controlling a flow quantity of the air flowing through the communicating passageway when a pressure in the air supply passageway becomes equal to or larger by a predetermined value than a pressure in the combustion gas discharge passageway.

14. An internal combustion engine having a combustion heater according to claim 13, wherein said air quantity control means is a valve mechanism which opens when the pressure in said air supply passageway becomes equal to or larger by the predetermined value than the pressure in said combustion gas discharge passageway, otherwise closes.

15. An internal combustion engine having a combustion heater according to claim 14, wherein said valve mechanism is a check valve for permitting a unidirectional flow of a fluid and automatically shutting off the passageway with respect to a back flow.

16. An internal combustion engine having a combustion heater according to claim 1, wherein the combustion heater introduces the air for combustion from an intake passageway of the internal combustion engine and raises temperatures of engine related elements by utilizing heat held by a combustion gas produced by burning the air-fuel mixture by mixing a fuel for combustion with the air for combustion in the combustion chamber;

the intake passageway includes a supercharger for increasing a pressure of intake air in the intake passageway;

the air supply passageway introduces, from the intake passageway, the intake air, of which the pressure has been increased by the supercharger, as the air for combustion into the combustion chamber;

the introduced air for combustion is supplied to the combustion chamber by an air blower means; the combustion gas discharge passageway, bypassing cylinders of the internal combustion engine, discharges the combustion gas to an exhaust passageway of the internal combustion engine; and the air quantity control means controls a flow quantity of the air flowing through the combustion chamber by controlling the operation of the air blower means when a pressure in the air supply passageway becomes equal to or larger by a predetermined value than a pressure in the combustion gas discharge passageway.

17. An internal combustion engine having a combustion heater according to claim 16, wherein said air quantity control means decreases an introduction quantity of the air for combustion into said combustion chamber by controlling the operation of said air blowing means.

18. An internal combustion engine having a combustion heater according to claim 17, wherein said air blowing means is a rotational fan, and the operation control of said air blowing means by said air quantity control means is reduction control of reducing the number of rotations of said rotational fan.

19. An internal combustion engine having the combustion heater according to claim 18, wherein a portion of the intake passageway located more downstream than a connecting point of the air supply passageway to the intake passageway is connected to the combustion gas discharge passageway via combustion gas route switching means capable of selectively switching over the exhaust passageway and the intake passageway to introduce the combustion gas into either the exhaust passageway or the intake passageway.

* * * * *